United States Patent [19]

Inoue et al.

[11] Patent Number: 4,968,596

[45] **Date of Patent: * Nov. 6, 1990**

[54] METHOD FOR FORMING A DIRECT POSITIVE IMAGE

[75] Inventors: Noriyuki Inoue; Shigeo Hirano; Tetsuro Kojima; Mitsura Yamamoto; Satoshi Nagaoka, all of Kanagawa, Japan

[73] Assignee: Fuji Photo Film Co. Ltd., Kanagawa, Japan

[ * ] Notice: The portion of the term of this patent subsequent to Aug. 22, 2006 has been disclaimed.

[21] Appl. No.: 266,605

[22] Filed: Nov. 2, 1988

[30] Foreign Application Priority Data

| | | | |
|---|---|---|---|
| Nov. 2, 1987 | [JP] | Japan | 62-277578 |
| Nov. 30, 1987 | [JP] | Japan | 62-301888 |
| Dec. 10, 1987 | [JP] | Japan | 62-312870 |

[51] Int. Cl.[5] ..... G03C 1/485; G03C 1/10

[52] U.S. Cl. ..... 430/598; 430/378; 430/406; 430/409; 430/410; 430/547; 430/552; 430/550; 430/559; 430/940

[58] Field of Search ..... 430/409, 410, 406, 378, 430/940, 547, 55 L, 554, 558, 598

[56] References Cited

U.S. PATENT DOCUMENTS

| | | | |
|---|---|---|---|
| 4,115,122 | 3/1981 | Adachi et al. | 430/596 |
| 4,471,044 | 7/1983 | Parton et al. | 430/217 |
| 4,871,653 | 10/1989 | Inoue . | |

FOREIGN PATENT DOCUMENTS

| | | | |
|---|---|---|---|
| 0276842 | 10/1982 | European Pat. Off. . | |
| 2655870 | 6/1979 | Fed. Rep. of Germany . | |
| 3721570 | 1/1988 | Fed. Rep. of Germany | 430/378 |

*Primary Examiner*—Paul R. Michl
*Assistant Examiner*—Thorl Chea
*Attorney, Agent, or Firm*—Sughrue, Mion, Zinn, Macpeak & Seas

[57] ABSTRACT

A method for forming a direct positive image comprising the steps of:

(a) imagewise exposing a photographic light-sensitive material composed of a support having thereon at least one unprefogged internal latent image type silver halide light-sensitive emulsion layer; and (b) developing the exposed photographic light-sensitive material to form a direct positive image in the presence of at least one nucleating agent represented by formula (N-I);

(N-I)

wherein $Z^1$ represents nonmetal atomic group necessary for forming a 5-membered or 6-membered heterocyclic ring, a 5-membered or 6-membered heterocyclic ring fused with an aromatic ring, or a 5-membered or 6-member heterocyclic ring fused with another heterocyclic ring; $R^1$ represents an aliphatic group; X represents $$=\underset{|}{C}- \text{ or } -\underset{|}{N}-;$$

Q represents a nonmetallic atomic group necessary for forming a 4-membered to 12-membered nonaromatic hydrocarbon ring or a 4-membered to 12-membered nonaromatic heterocyclic ring; provided that at least one of $R^1$, $Z^1$ and Q is substituted with an alkynyl group; Y represents a counter ion required for charge balance; and n is a number required for charge balance; or $Z^1$ contains a heterocyclic quaternary ammonium salt completed by said $Z^1$ via a linkage group.

28 Claims, No Drawings

METHOD FOR FORMING A DIRECT POSITIVE IMAGE

FIELD OF THE INVENTION

The present invention relates to a method for forming a photographic image, and more particularly, to a method for forming a direct positive image.

BACKGROUND OF THE INVENTION

Methods of forming a direct positive image, which involve using unprefogged internal latent-image type silver halide photographic emulsions, and subjecting them to surface development subsequently to or simultaneous with a fogging processing performed after imagewise exposure, are well known.

The term "internal latent-image type silver halide photographic emulsions" as used above refers to silver halide photographic emulsions of the type which have light-sensitive nuclei mainly inside the silver halide grains, and form a latent image predominantly inside the grains by exposure.

Various methods are known in this field, and the principal ones are described, e.g., in U.S. Pat. Nos. 2,592,250, 2,466,957, 2,497,875, 2,588,982, 3,317,322, 3,761,266, 3,761,276 and 3,796,577, British Pat. Nos. 1,151,363, 1,150,533 and 1,011,062.

These known methods can generally provide photographic light-sensitive materials having a comparatively high photographic speed, considering that they are direct positive type.

Details of the mechanisms of the direct-positive image formation are described, e.g., in T. H. James, The Theory of the Photographic Process, (4th ed.), chap. 7, pp. 182–193, and U.S. Pat. No. 3,761,276.

Specifically, it is believed that the surface desensitization attributable to the internal latent image produced inside silver halide grains by the first imagewise exposure brings about selective formation of fogged nuclei at only the individual surfaces of silver halide grains present in unexposed areas, and a conventional surface-development processing subsequent to the imagewise exposure produces a photographic image (direct-positive image) in the unexposed areas.

As the means of selectively forming fogged nuclei, as described above, there are known a method of giving a second exposure to the whole surface of a light-sensitive layer, which is generally called "an optical fogging method" (as described, e.g., in British Pat. No. 1,151,363), and a method using a nucleating agent, which is called "a chemical fogging method". Details of the latter method are described, e.g., in *Research Disclosure,* vol. 151, No. 15162, pp. 76–78 (November, 1976).

Formation of direct-positive (color) images can be achieved by subjecting silver halide photographic materials of the internal latent-image type to a surface color development-processing after or as they undergo a fogging treatment, and then (to a bleach processing and) a fixation processing successively (or a bleach-fix processing). After (bleach and) fixation processings, washing and/or stabilization is performed. (In parentheses processes for obtaining color images are shown.)

As for the nucleating agent used in the foregoing "chemical fogging method", hydrazine compounds are well known.

The nucleating agents of hydrazine type, though superior in discrimination because they generally cause a great difference between the maximum density and the minimum density, have the disadvantage that they require a high pH condition (pH 12) in the development-processing.

As for the nucleating agents which can function under a lower pH processing condition (pH≦12), heterocyclic quaternary ammonium salts are known, and described, e.g., in U.S. Pat. Nos. 3,615,615, 3,719,494, 3,734,738, 3,759,901, 3,854,956, 4,094,683 and 4,306,016, British Pat. No. 1,283,835, JP-A-Nos. 52-3426 and 52-69613 (The term "JP-A" as used herein means an "unexamined published Japanese patent application"). In particular, propargylor butinyl-substituted heterocyclic quaternary ammonium salts disclosed in U.S. Pat. No. 4,115,122 are excellent nucleating agents in respect of discrimination in direct positive silver halide emulsions. However, they are unsatisfactory because, e.g., when sensitizing dyes are added to the foregoing silver halide emulsions for the purpose of spectral sensitization, competitive adsorption to silver halide emulsion grains occurs between the sensitizing dyes and the nucleating agents of heterocyclic quaternary ammonium salts. This requires the addition of a large quantity of quaternary salt type nucleating agent because of its weak adsorptivity, to cause uneven density and loss of color balance, particularly in the case of multilayer color photographic materials. Undesirable influences of this phenomenon tend to become more serious under running processing or upon storage under high temperature and high humidity conditions.

With the intention of solving the foregoing problem, U.S. Pat. No. 4,471,044 discloses a quaternary salt type nucleating agent which contains a thioamide group as a group for accelerating the adsorption to silver halide grains. Though introduction of the adsorption accelerating group can reduce the addition amount of the nucleating agent required for achievement of sufficiently high Dmax and reduces the a decrease in Dmax upon storage under high temperatures, the effect is not yet satisfactory.

SUMMARY OF THE INVENTION

A first object of the present invention is to provide a method for forming a direct positive image having a high maximum image density (Dmax) and a low minimum image density (Dmin), even in processing with a developer of relatively low pH.

A second object of the present invention is to provide a method for forming a direct positive image with a high Dmax and a low Dmin as described above even when running processing is performed.

A third object of the present invention is to provide a method for forming a direct positive image which limits changes in photographic properties, including a decrease in Dmax, an increase in Dmin even when the photographic material is stored at a high temperature and/or a high humidity.

It has now been found that these and other objects are attained by a method for forming a direct positive image including the steps of:

(a) imagewise exposing a photographic light-sensitive material composed of a support having thereon at least one unprefogged internal latent image type silver halide light-sensitive emulsion layer; and (b) developing the exposed photographic light-sensitive material to form a direct positive image in the presence of at least one nucleating agent represented by formula (N-I);

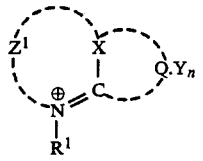

(N-I)

wherein $Z^1$ represents nonmetal atomic group necessary for forming a 5-membered or 6-membered heterocyclic ring, a 5-membered or 6-membered heterocyclic ring fused with an aromatic ring, or a 5-membered or 6-membered heterocyclic ring fused with another heterocyclic ring; $R^1$ represents an aliphatic group; X represents $$=\underset{|}{C}- \text{ or } -\underset{|}{N}-;$$

Q represents a nonmetallic atomic group necessary for forming a 4-membered to 12-membered nonaromatic hydrocarbon ring or a 4-membered to 12-membered nonaromatic heterocyclic ring; provided that at least one of $R^1$, $Z^1$ and Q is substituted with an alkynyl group; Y represents a counter ion required for charge balance; and n is a number required for charge balance. At least one among $R^1$, $Z^1$ and Q may have a substituent containing a group capable of accelerating adsorption to silver halide grains.

DETAILED DESCRIPTION OF THE INVENTION

The nucleating agent represented by the foregoing general formula (N-I) is illustrated in detail below.

Specific examples of a heterocyclic ring completed by $Z^1$ include quinolinium, benzimidazolium, pyridinium, thiazolium, selenazolium, imidazolium, tetrazolium, indolenium, pyrrolinium, acridinium, phenanthridinium, isoquinolinium and naphthopyridinium nuclei. $Z^1$ may be substituted by a substituent group, such as an alkyl group, an alkenyl group, an aralkyl group, an aryl group, an alkynyl group, a hydroxyl group, an alkoxy group, an aryloxy group, a halogen atom, an amino group, an alkylthio group, an arylthio group, an acyloxy group, an acylamino group, an aliphatic and aromatic sulfonyl group, an aliphatic and aromatic sulfonyloxy group, an aliphatic and aromatic sulfonylamino group, a carboxyl group, an acyl group, a carbamoyl group, a sulfamoyl group, a sulfo group, a cyano group, a ureido group, a urethane group (including an alkoxyamido group and a carbamoyloxy group), a carboxylate group (having a structure of ROCOO—), a hydrazino group, a hydrazono group, and an imino group. As for the substituent groups by which $Z^1$ may be substituted, at least one substituent is chosen from those cited above. When $Z^1$ has two or more of groups as substituents, these groups may be the same or different. The substituent groups as set forth above may further be substituted by any of them. The carbon number in an aryl moiety or an aralkyl moiety in the substituents is preferably from 6 to 20 and in an alkyl moiety in the substituents is preferably from 1 to 18.

Further, $Z^1$ may contain a heterocyclic quaternary ammonium salt completed by $Z^1$ via an appropriate linkage group $L^1$. Two $Z^1$ groups may be the same or different. In this case, the nucleating agent assumes, for example, a structure of a bis-compound.

Preferred examples of the heterocyclic nucleus completed by $Z^1$ include quinolinium, benzimidazolium, pyridinium, acridinium, phenanthridinium, naphthopyridinium and isoquinolinium nuclei. Of these nuclei, quinolinium, naphthopyridinium and benzimidazolium nuclei are more preferred, and a quinolinium nucleus is most preferred.

An aliphatic group represented by $R^1$ is preferably a unsubstituted alkyl group containing 1 to 18 carbon atoms, or a substituted alkyl group whose alkyl moiety contains 1 to 18 carbon atoms. As for the substituent group by which the aliphatic group may be substituted, those described as substituent groups of $Z^1$ are suitable.

A group preferred as $R^1$ is an alkynyl group having from 2 to 18 carbon atoms, especially a propargyl group.

Q represents an atomic group necessary to complete a 4- to 12-membered nonaromatic hydrocarbon or nonaromatic heterocyclic ring. These rings may be substituted by groups described as substituents of $Z^1$.

A nonaromatic hydrocarbon ring completed by Q is one which contains a carbon atom as X, and specific examples thereof include cyclopentane, cyclohexane, cyclohexene, cycloheptane, indane, tetralin and like rings.

A nonaromatic heterocyclic ring completed by Q is one which contains at least one of nitrogen, oxygen, sulfur, or selenium or/and so on as hetero atom(s). When X represents a carbon atom, specific examples of such a ring include tetrahydrofuran, tetrahydropyran, butyrolactone, pyrrolidone, tetrahydrothiophene and like rings. Examples of a nonaromatic hetero ring completed by Q when X represents a nitrogen atom include pyrrolidine, piperidine, pyridone, piperazine, perhydrothiazine, tetrahydroquinoline, indoline and like rings.

Preferred rings completed by Q are those containing a carbon atom as X, especially cyclopentane, cyclohexane, cycloheptane, cyclohexene, indane, tetrahydropyran, tetrahydrothiophene and the like.

Specific examples of the alkynyl group substituent by which $R^1$, $Z^1$ or/and Q are substituted, though already been mentioned above, are described below in further detail. They are preferably those containing 2 to 18 carbon atoms, such as an ethynyl group, propargyl group, 2-butynyl group, 1-methylpropargyl group, 1,1-dimethylpropargyl group, 3-butynyl group and 4-pentynyl group. More preferred alkynyl groups are those which has a triple bond between 2- and 3-carbon atoms in the hydrocarbon chain, such as propargyl group.

These groups may further be substituted by groups cited as examples of substituent groups by which $Z^1$ may be substituted.

Among the above-cited alkynyl groups, a propargyl group is preferred over others. In particular, $R^1$ preferably represents an alkynyl group and more preferably it represents a propargyl group.

As for the substituent having a group capable of accelerating the adsorption to silver halide grains, with which at least one of $R^1$, Q and $Z^1$ is optionally substituted, those represented by the formula $X^1$-$(L^2)$m- are preferred. Therein, $X^1$ represents a group capable of accelerating the adsorption to silver halide grains, $L^2$ represents a divalent linkage group, and m is 0 or 1. Preferred examples of the adsorption accelerating group represented by $X^1$ include a thioamido group (preferably containing 1 to 20 carbon atoms), mercapto group and 5- or 6-membered nitrogen-containing heterocyclic groups.

These groups may be substituted by those described as substituent groups of $Z^1$. As for the thioamido group, acyclic thioamido groups (e.g., thiourethane, thioureido) are preferred.

As for the mercapto group represented by $X^1$, heterocyclic mercapto groups (e.g., 5-mercaptotetrazole, 3-mercapto-1,2,4-triazole, 2-mercapto-1,3,4-thiadiazole, 2-mercapto-1,3,4-oxadiazole) are preferred.

As for the 5- or 6-membered nitrogen-containing heterocyclic group represented by $X^1$, those containing nitrogen, oxygen, sulfur and carbon atoms as constituent elements, preferably they are capable of producing iminosilver, such as benzotriazole, and aminothiatriazole.

A divalent linkage group represented by $L^1$ and $L^2$ each represents an atom or atomic group containing at least one C, N, S and O, with specific examples including an alkylene group, an alkenylene group, an alkynylene group, an arylene group (each preferably having 1 to 12, 2 to 12, 2 to 12 and 6 to 20 carbon atoms, respectively), —O—, —S—, —NH—, —N=, —CO—, —$SO_2$— (these groups may have a substituent, such as alkyl, alkenyl, alkynyl, aryl, halogen atoms, alkoxy, alkylthio, acylamino, acyloxy, sulfonylamino and ureido), and combinations of two or more thereof, such as —COO—, —CONH—, —$SO_2$NH—, —OCONH—, —NHCONH—, —NH$SO_2$NH—, —(alkylene)—CONH—, —(arylene)—$SO_2$NH—, —(arylene)—NHCONH—, and —(arylene)—CONH—.

Examples of a counter ion Y for charge balance, include bromide ion, chloride ion, iodide ion, a p-toluenesulfonic acid ion, an ethylsulfonic acid ion, a perchloric acid ion, a trifluoromethanesulfonic acid ion, a thiocyanic acid ion, $BF_4^-$, and $PF_6^-$.

Among the compounds represented by the general formula (N-I), those containing a group capable of accelerating the adsorption to silver halide grains, especially those containing a thioamido group, an azolyl group or a heterocyclic mercapto group as the adsorption accelerating group $X^1$, are preferred.

Specific examples of these compounds and synthetic methods therefor are described, e.g., in JP-A-No. 62-17984 (European Patent Application No. 0,276,842A), and the patents or references cited therein.

Specific examples of the compound represented by the general formula (N-I) are illustrated below. However, the invention is not to be construed as being limited to these examples.

(N-I-1)

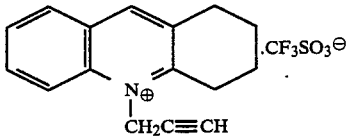

(N-I-2)

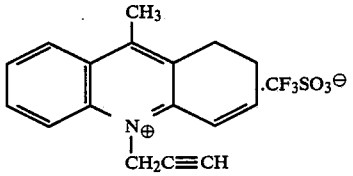

(N-I-3)

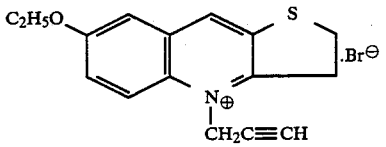

(N-I-4)

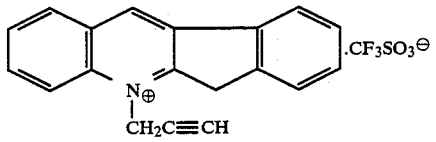

(N-I-5)

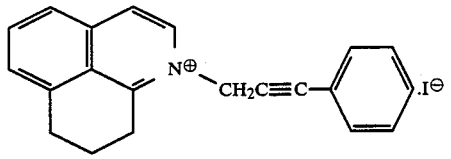

(N-I-6)

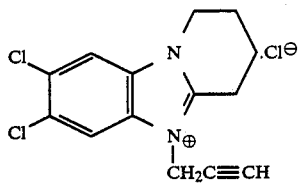

-continued
(N-I-7)
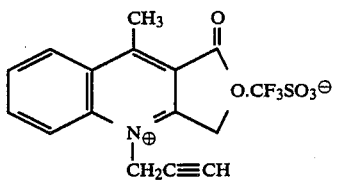
(N-I-8)
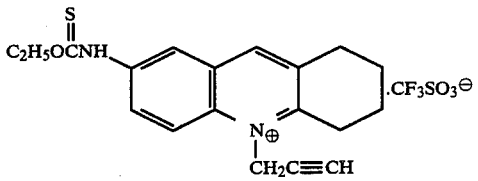
(N-I-9)
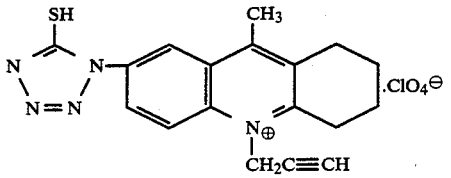
(N-I-10)
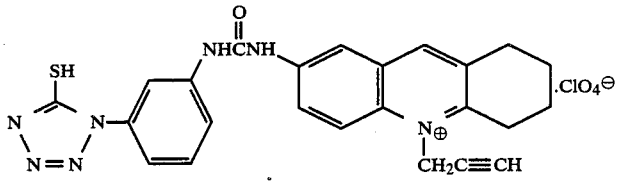
(N-I-11)
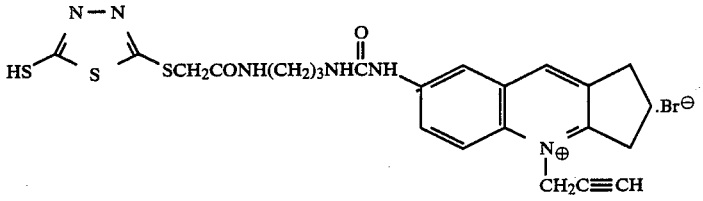
(N-I-12)
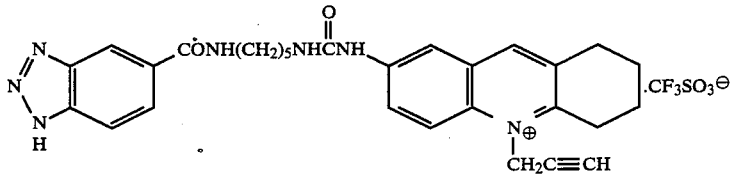
(N-I-13)
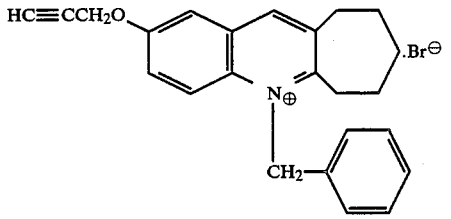
(N-I-14)
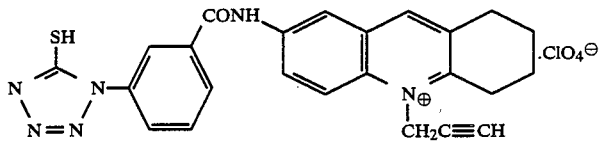

-continued
(N-I-15)
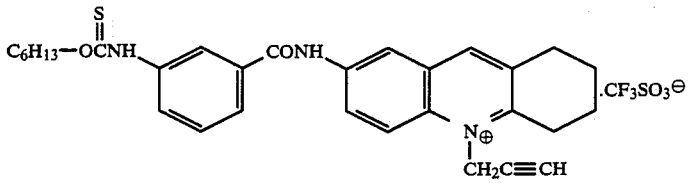
(N-I-16)
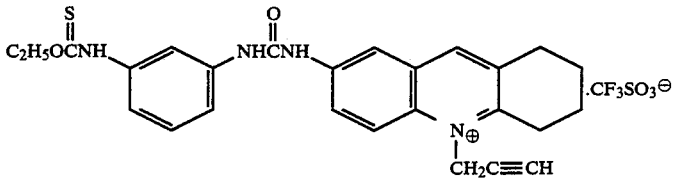
(N-I-17)
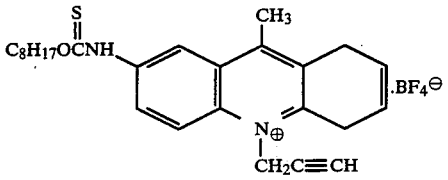
(N-I-18)
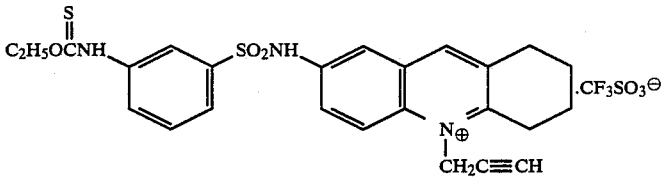
(N-I-19)
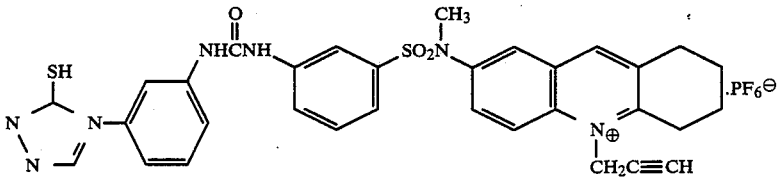
(N-I-20)
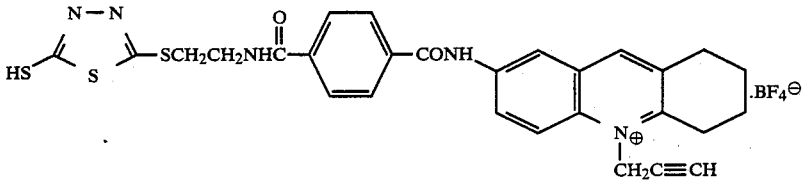
(N-I-21)
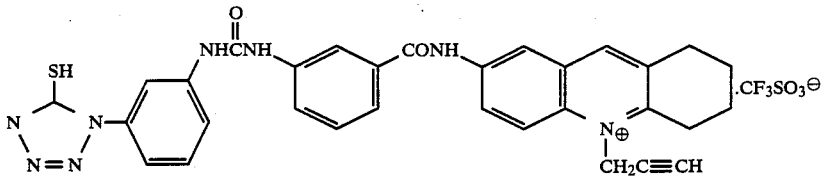
(N-I-22)
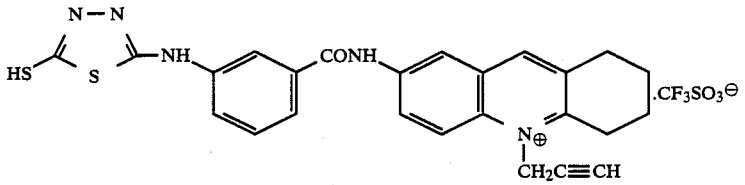

-continued

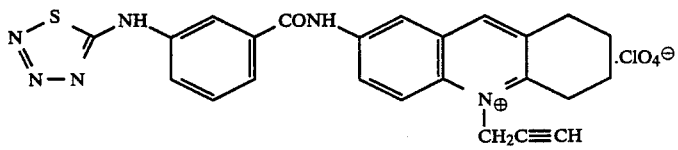

(N-I-23)

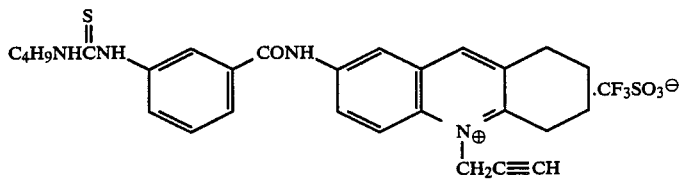

(N-I-25)

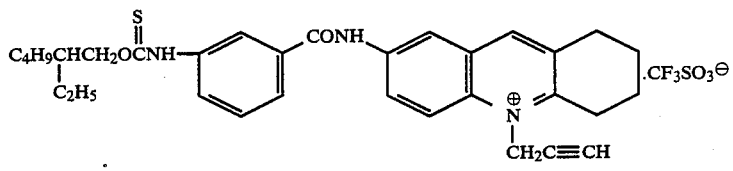

N-I-25)

In incorporating the compounds represented by the foregoing general formula (N-I) into the photographic light-sensitive material to be used in the present invention, they are first dissolved in an organic solvent miscible with water, such as alcohols (e.g., methanol, ethanol), esters (e.g., ethyl acetate), ketones (e.g., acetone), or the like, or in water when they are soluble in water, and then added to a hydrophilic colloidal solution.

The addition to a photographic emulsion may be carried out at any time as long as it is within the period from the start of chemical ripening till the start of coating. However, it is desirable to carry out the addition after the conclusion of chemical ripening.

In the present invention, the nucleating agent represented by the general formula (N-I), may be contained in a hydrophilic colloid layer adjacent to a silver halide emulsion layer. It is preferably incorporated in a silver halide emulsion layer. Although the amount of the nucleating agent to be added can vary over a wide range because it depends on characteristics of the silver halide emulsion used, the chemical structure of the nucleating agent and the developing condition adopted, a practically useful amount ranges from about $1\times10^{-8}$ mole to about $1\times10^{-2}$ mole, particularly from about $1\times10^{-7}$ mole to about $1\times10^{-3}$ mole, per mole of silver in the silver halide emulsion layer. When the nucleating agent is incorporated in a layer adjacent to a silver halide emulsion layer, it is preferably incorporated in an amount of from $1.0\times10^{-8}$ to $1.0\times10^{-3}$ g/m$^2$, more preferably $3.0\times10^{-8}$ to $1.0\times10^{-4}$ g/m$^2$.

When the nucleating agent is added in an amount much larger than that of the above-described ranges the Dmin of a fresh photographic material tends to increase, and Dmin also tends to increase when the photographic material is stored at a higher temperature for a long period of time.

When the nucleating agent is incorporated in a developing solution and/or a prebath thereof, it is preferably incorporated in an amount of from $1\times10^{-5}$ to $1\times10^{-1}$ mol/l, more preferably $1\times10^{-4}$ to $1\times10^{-2}$ mol/l. In the prebath compounds other than uucleating agent may also be added.

The unprefogged, internal latent-image type silver halide emulsion employed in the present invention contains silver halide grains whose surfaces are not prefogged, and which form the latent image predominantly inside the grain. More specifically, it is defined as the emulsion which gains at least 5-fold, preferably at least 10-fold, maximum density when a silver halide emulsion is coated on a transparent support at a prescribed coverage (e.g., 0.5 to 3 g/m$^2$ based on the silver halide), exposed to light for a fixed period of time (e.g., 0.01 to 10 sec.), and then developed at 18° C. for 5 min. using the developer A described below (internal developer), and thereafter the maximum density is determined according to a usual photographic density measuring method, compared with the case where the silver halide emulsion coated at the same coverage is exposed in the same manner, and developed at 20° C. for 6 minutes using the developer B described below (surface developer).

| | |
|---|---|
| Internal Developer A | |
| Metol | 2 g |
| Sodium Sulfite (anhydrous) | 90 g |
| Hydroquinone | 8 g |
| Sodium Carbonate (monohydrate) | 52.5 g |
| KBr | 5 g |
| KI | 0.5 g |
| Water to make | 1 l |
| Surface Developer B | |
| Metol | 2.5 g |
| L-ascorbic Acid | 10 g |
| $NaBO_2.4H_2O$ | 35 g |
| KBr | 1 g |
| Water to make | 1 l |

Specific examples of internal latent-image type emulsions include conversion type emulsions disclosed in U.S. Pat. No. 2,592,250, and core/shell type silver halide emulsions disclosed in U.S. Pat. Nos. 3,761,276, 3,850,637, 3,923,513, 4,035,185, 4,395,478 and 4,504,570, JP-A-Nos. 52-156614, 55-127549, 53-60222, 56-22681, 59-208540, 60-107641, 61-3137, 62-215272, and patents disclosed in *Research Disclosure,* No. 23510, p. 236 (Nov. 1983).

The silver halide grains to be used in the present invention may have a regular crystal form, such as a cube, an octahedron, a dodecahedron, a tetradecahedron or so on, an irregular crystal form, such as a sphere or so on, or a tabular form having an aspect ratio (a length/thickness ratio) of 5 or above. In addition, silver halide grains having a composite form of these various crystal forms may be used, or a mixture of emulsions containing various crystal forms of silver halide grains may be used.

Silver halides which may constitute the emulsion grains of the present invention include silver chloride, silver bromide and mixed silver halides. Preferred silver halides in the present invention are silver chloro(iodo)-bromide, silver (iodo)chloride and silver (iodo)bromide, in which the iodide content is below 3 mol %.

The silver halide grains have a mean grain size of preferably from 0.1 to 2 μm, particularly preferably from 0.15 to 1 μm. The size distribution of the silver halide grains to be used in the present invention, though it may be narrow or broad, is preferably "monodisperse" to improve in granularity, sharpness and so on. The term "monodisperse system" as used herein refers to a dispersion system wherein 90% or more of the grains have individual sizes within the range of ±40% of the number or weight average grain size, and preferably within ±20%. In order to satisfy the gradation aimed at, two or more monodisperse silver halide emulsions, which have substantially the same color sensitivity, but different grain sizes, or plural kinds of grains having the same size but different sensitivities can be coated as a mixture in the same layer, or separately in superposed layers. In addition, a combination of two or more of polydisperse silver halide emulsions, or a combination of monodisperse and polydisperse emulsions can be used as a mixture, or coated separately in superposed layers.

The interior or the surface of silver halide emulsion grains to be used in the present invention can be chemically sensitized by using a sulfur or selenium sensitization process, a reduction sensitization process, a noble metal sensitization process and so on individually or in a combination thereof. Specific examples of these processes are described in patents cited, e.g., in *Research Disclosure,* No. 17643-III, p. 23 (Dec. 1978).

The photographic emulsions used in the present invention are spectrally sensitized using photographic sensitizing dyes in accordance with a conventional method. Particularly useful sensitizing dyes are cyanine dyes, merocyanine dyes, and complex merocyanine dyes. These dyes can be used independently or in combination thereof. In addition, the foregoing dyes may be used in combination with supersensitizing agents. Specific examples for these dyes and agents are described in patents cited, e.g., in *Research Disclosure,* No. 17643-IV, pp. 23–24 (Dec. 1978).

The photographic emulsions to be used in the present invention can contain an antifoggant or a stabilizer for the purpose of preventing fog or stabilizing photographic functions during production, storage, or photographic processing. Specific examples of such agents are described in *Research Disclosure,* No. 17643-VI (Dec. 1978), and E. J. Birr, *Stabilization of Photographic Silver Halide Emulsion,* Focal Press (1974).

Various color couplers can be used for forming direct positive color images. The color couplers are compounds capable of producing or releasing substantially nondiffusible dyes by undergoing a coupling reaction with the oxidation products of aromatic primary amine color developing agents, and preferably they themselves also should be nondiffusible. Typical examples of useful color couplers include naphthol or phenol compounds, pyrazolone or pyrazoloazole compounds, and open-chain or heterocyclic ketomethylene compounds. Specific examples of these cyan, magenta and yellow couplers which can be used in the present invention are described in *Research Disclosure,* No. 17643, Item VII-D, p. 25 (Dec. 1978), ibid, No. 18717 (Nov. 1979), JP-A-No. 62-215272, and patents cited therein.

Representative yellow couplers which can be used in the present invention include two-equivalent yellow couplers of the type which have a splitting-off group attached to the coupling active site via an oxygen or nitrogen atom. Of these yellow couplers, α-pivaloylacetoanilide couplers are most advantageous because they can produce dyes excellent in fastness, especially to light, while α-benzoylacetoanilide couplers have an advantage in that they can ensure high color density in the developed image.

The most preferred yellow couplers to be used in the present invention are those represented by the following general formula (I):

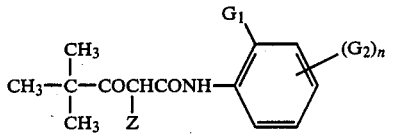

(I)

wherein Z represents a group capable of splitting off upon the coupling reaction with the oxidation product of a developing agent; $G_1$ represents a halogen atom, or an alkoxy group; $G_2$ represents a hydrogen atom, or a substituent; n represents 0 or an integer of from 1 to 4, when n is 2 or more, groups represented by $G_2$ may be the same or different.

Examples for the substituent represented by $G_2$ include an amido group, a carbamoyl group, a sulfonamido group, a halogen, atom, an alkyl group, an alkoxy group, an aryl group, an aryloxy group, an amino group, a nitro group, a hydroxyl group, a carboxyl group, a sulfo group, an alkoxycarbonyl group, an acyloxy group, a sulfamoyl group, and a heterocyclic group. These groups may further substituted with at least one of these groups.

More specifically, a splitting-off group represented by Z includes groups such as to connect an aliphatic group, an aromatic group, a heterocyclyl group, an aliphatic, aromatic or heterocyclyl sulfonyl group, or an aliphatic, aromatic or heterocyclyl carbonyl group to the coupling active carbon via their respective oxygen, sulfur or carbon atom; halogen atoms; aromatic azo groups; and so on. An aliphatic, aromatic or heterocyclic moiety contained in the above-cited splitting-off groups may be substituted. When two or more of substituent groups are present, they may be the same or different, and may be further substituted.

Typical examples of splitting-off groups which can be employed include halogen atoms (e.g., fluorine, chlorine, bromine), alkoxy groups (e.g., ethoxy, dodecyloxy, methoxyethyl-carbamoylmethoxy, car-boxypropyloxy, methylsulfonylethoxy), aryloxy groups (e..g., 4-chlorophenoxy, 4-methoxyphenoxy, 4-carboxyphenoxy), acyloxy groups (e.g., acetoxy, detradecanoyloxy, benzoyloxy), aliphatic and aromatic sulfonyloxy groups (e.g., methanesulfonyloxy, toluenesulfonyloxy), acylamino groups (e.g., dichloroacetylamino, heptafluorobutyrylamino), aliphatic and aromatic sulfonamido groups (e.g., methanesulfonylamido, p-toluenesulfonylamino), alkoxycarbonyloxy groups (e.g., ethoxycarbonyloxy, benzyloxycarbonyloxy), aryloxycarbonyloxy (e.g., phenoxycarbonyloxy), aliphatic, aromatic or heterocyclic thio groups (e.g., ethylthio, phenylthio, tetrazolylthio), carbamoylamino groups (e.g., N-methylcarbamoylamino, N-phenyl-carbamoylamino), 5- and 6-membered nitrogen-containing heterocyclic groups (e.g., imidazolyl, pyrazolyl, triazolyl, tetrazolyl, 1,2-dihydro-2-oxo-1-pyridyl), imido groups (e.g., succinimido, hydantoinyl), aromatic azo groups (e.g., phenylazo), and so on. In addition, as examples of a splitting-off group attached to the coupling active site via a carbon atom, mention may be made of bis-type couplers obtained by condensing four-equivalent couplers by aldehydes or ketones. The splitting-off groups containing a photographically useful group, such as a development inhibitor residue, a development accelerator residue, etc., may be employed in the present invention.

Of the foregoing splitting-off groups, those attaching to the coupling active carbon via an oxygen or a nitrogen atom are preferred.

In particular, those represented by the following general formulae (I-A) to (I-E) are effective as the splitting-off group Z:

(I-A)

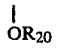

wherein $R_{20}$ represents an aryl group or a heterocyclyl group, which may be substituted;

(I-B)

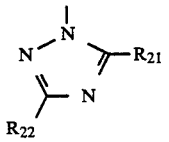

(I-C)

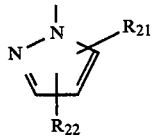

wherein $R_{21}$ and $R_{22}$ may be the same or different, and each represents a hydrogen atom, a halogen atom, a carboxylate group, an amino group, an alkyl group, an alkylthio group, an alkoxy group, an alkylsulfonyl group, an alkylsulfinyl group, a carboxyl group, a sulfo group, or an unsubstituted or substituted phenyl or heterocyclic group;

(I-D)

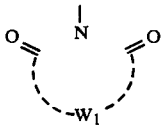

wherein $W_1$ represents nonmetal atoms necessary to complete a 4-, 5- or 6-membered ring together with

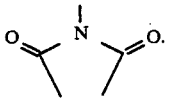

Of the splitting-off groups represented by the general formula (I-D), those of the general formulae (I-E) to (I-G) are preferred:

(I-E)

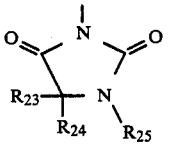

(I-F)

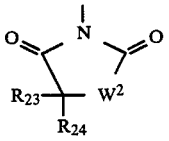

(I-G)

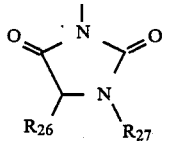

wherein $R_{23}$ and $R_{24}$ each represent a hydrogen atom, an alkyl group, an aryl group, an alkoxy group, an aryloxy group, or a hydroxyl group; $R_{25}$, $R_{26}$ and $R_{27}$ each represents a hydrogen atom, an alkyl group, an aryl group, an aralkyl group, or an acyl group; and $W_2$ represents an oxygen atom or a sulfur atom.

Among yellow couplers represented by formula (I), those which are represented by formula (I)' are preferably used in the present invention.

(I)'

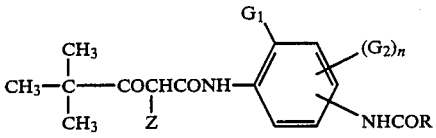

wherein Z, $G_1$, $G_2$ each has the same meanings as described in the definition for formula (I), and R represents an alkyl group, an alkoxy group, an aryl group, an aryloxy group, an amino group, a dialkylamino group, a heterocyclic group (e.g., N-morpholino, N-piperidino, 2-furyl), a halogen atom, a nitro group, a hydroxyl group, a carboxyl group, a sulfo group, an alkoxycarbonyl group.

The compounds of the foregoing general formula (I) can be synthesized according to the methods as described in JP-A-No. 54-48541, JP-B-No. 58-10739 (The term "JP-B" as used herein means an "examined Japanese patent publication"), U.S. Pat. No. 4,326,024, *Research Disclosure,* No. 18053.

Specific examples of the compound represented by the general formula (I) are illustrated below. However, the invention should not be construed as being limited to these examples.

(Y-1)
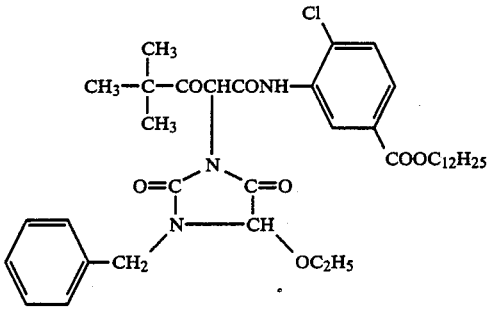
(Y-2)
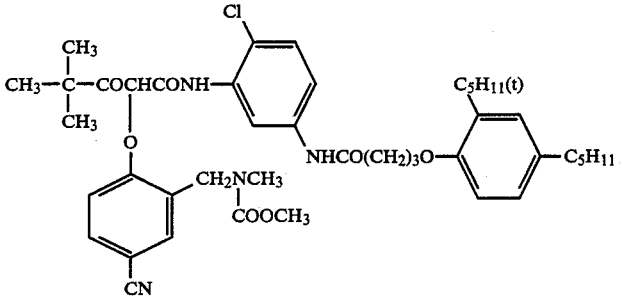
(Y-3)
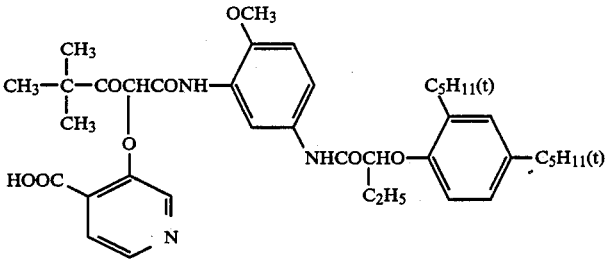
(Y-4)
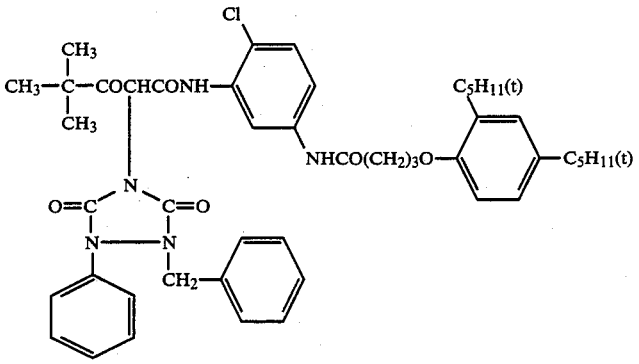
(Y-5)
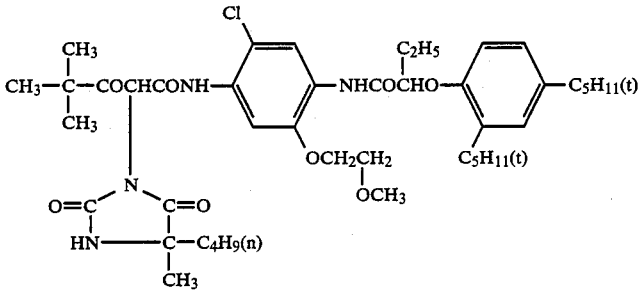

-continued
(Y-6)
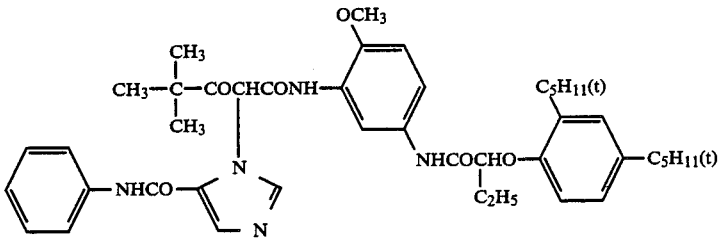
(Y-7)
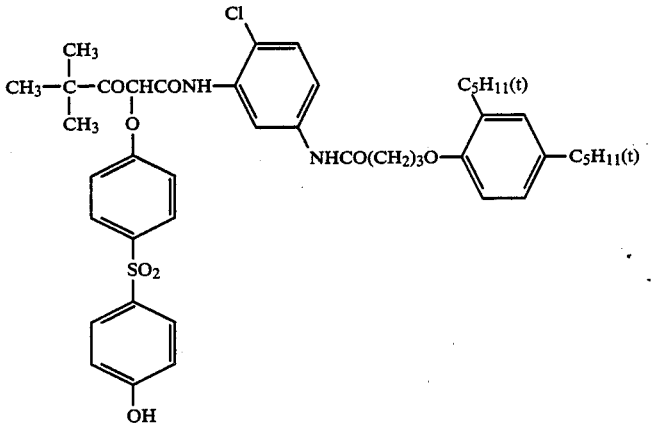
(Y-8)
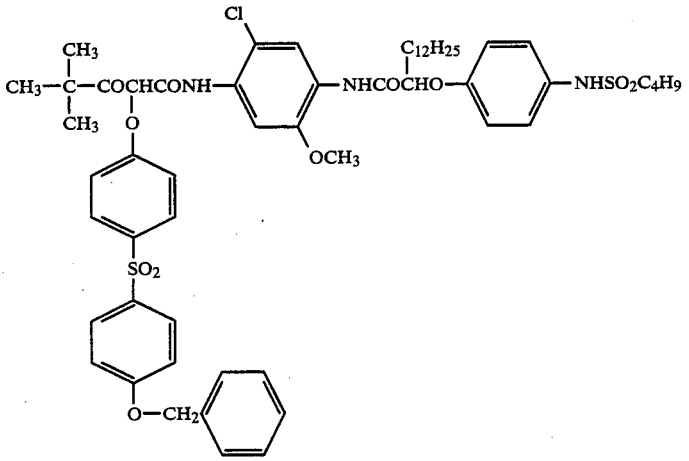
(Y-9)
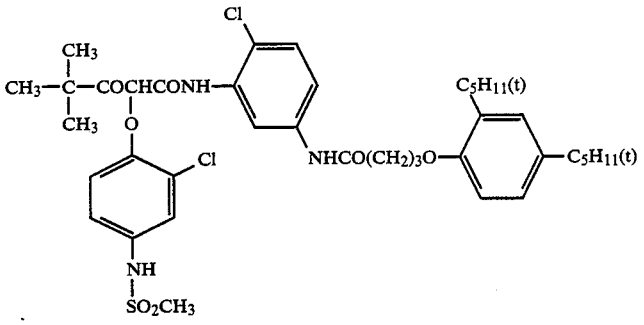

-continued
(Y-10)
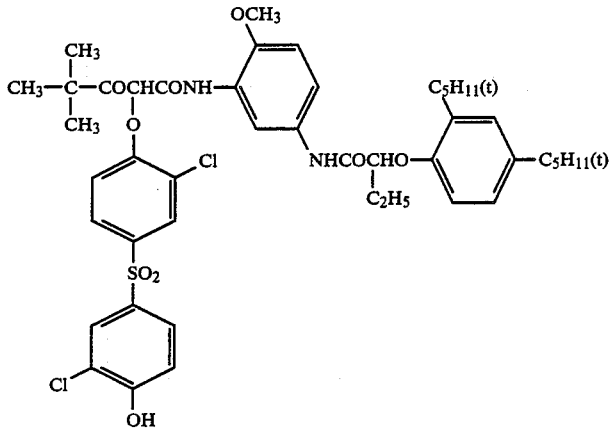
(Y-11)
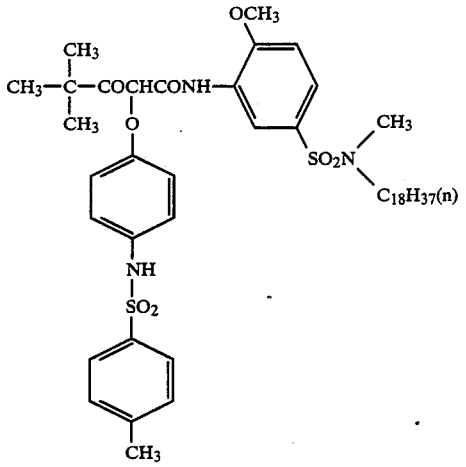
(Y-12)
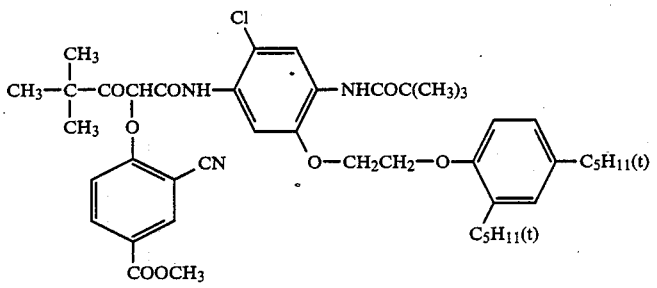
(Y-13)
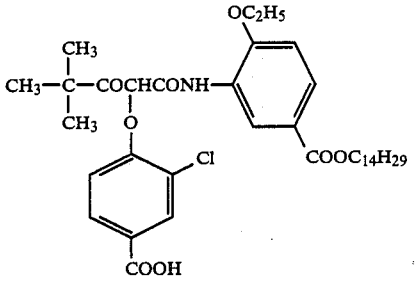

-continued
(Y-14)
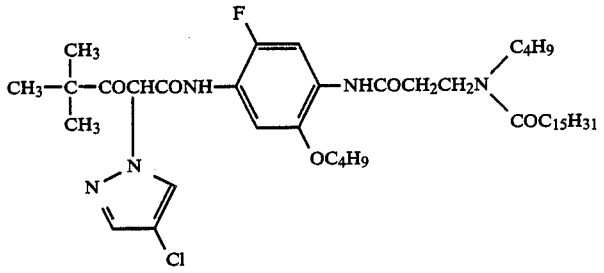
(Y-15)
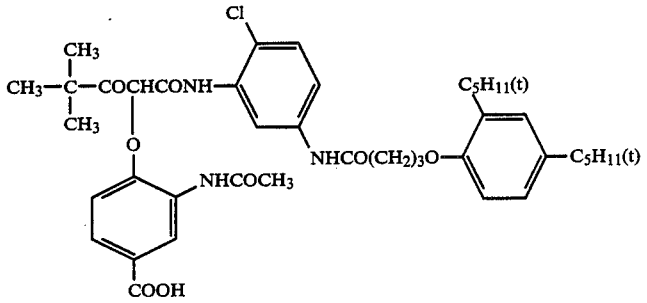
(Y-16)
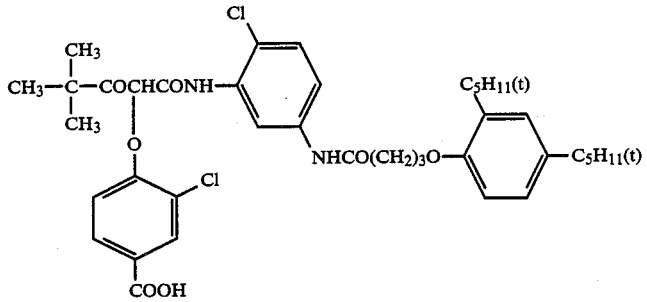
(Y-17)
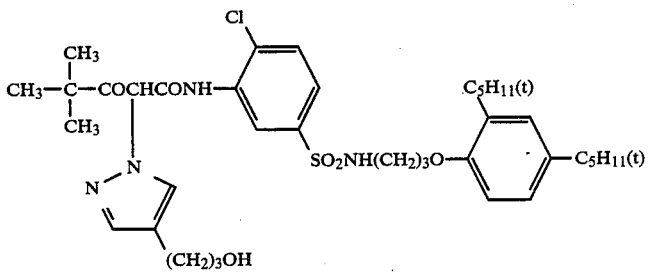
(Y-18)
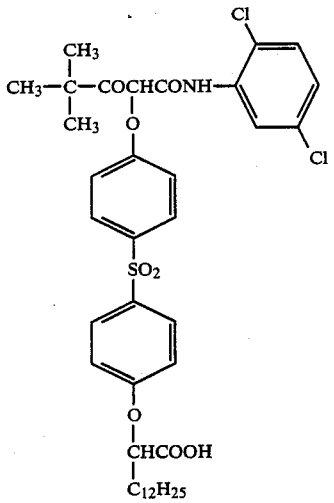

-continued
(Y-19)
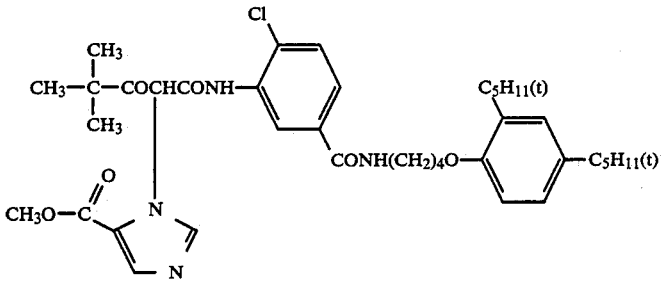
(Y-20)
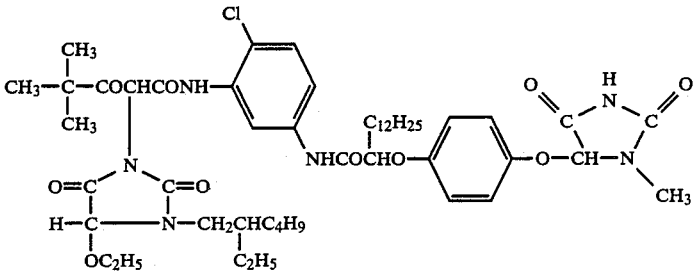
(Y-21)
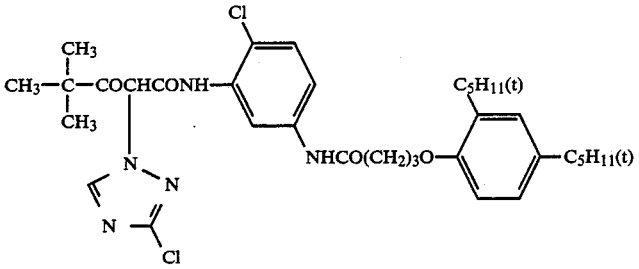
(Y-22)
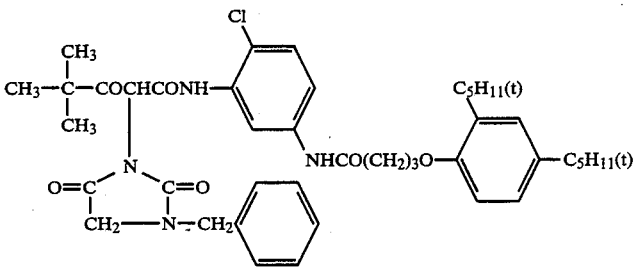
(Y-23)
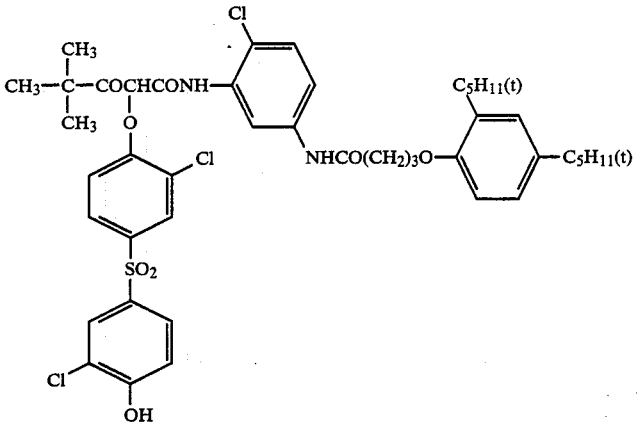

-continued
(Y-24)
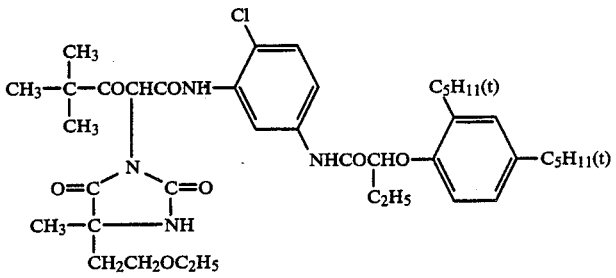
(Y-25)
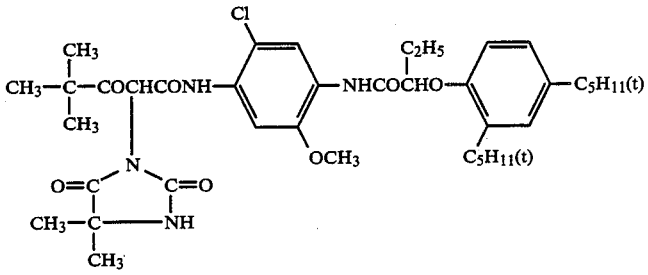
(Y-26)
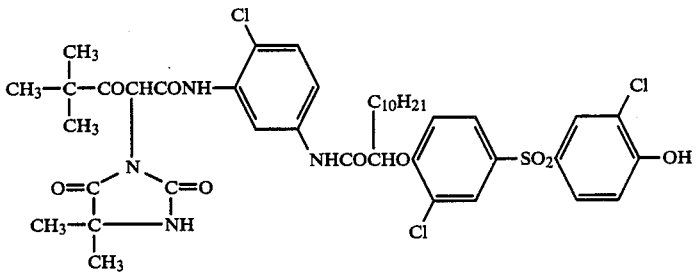
(Y-27)
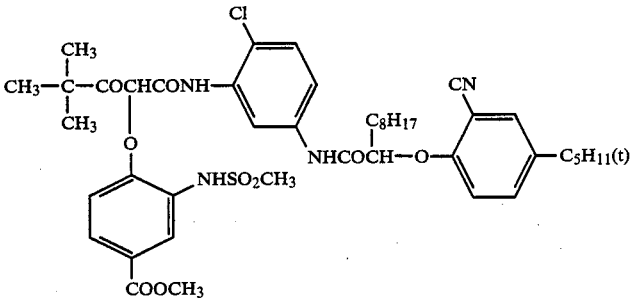
(Y-28)
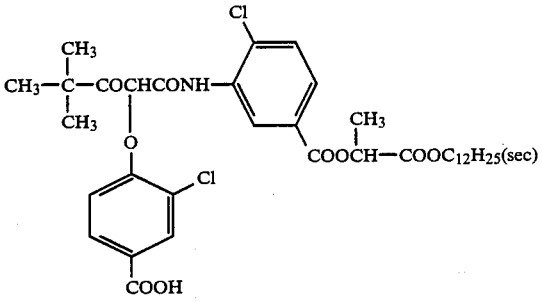

-continued
(Y-29)
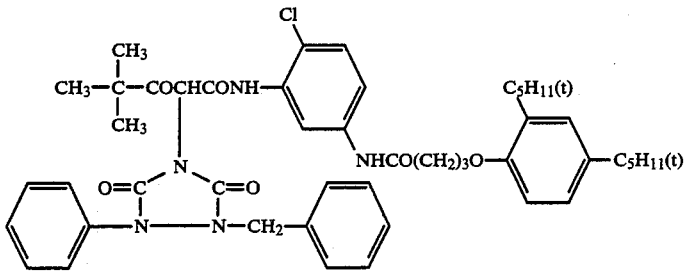
(Y-30)
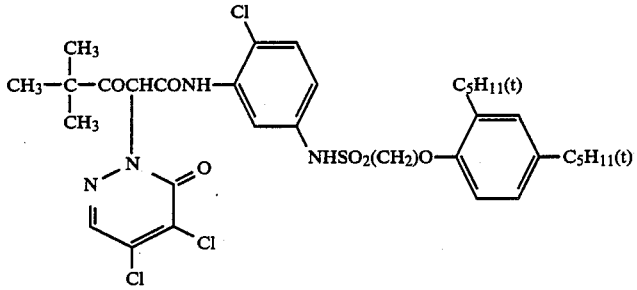
(Y-31)
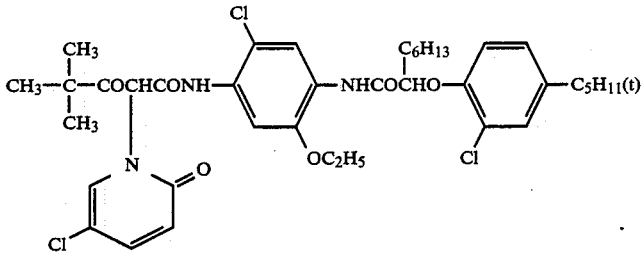
(Y-32)
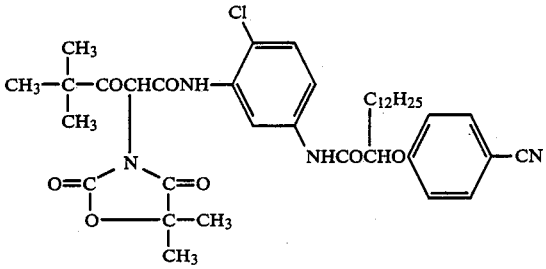
(Y-33)
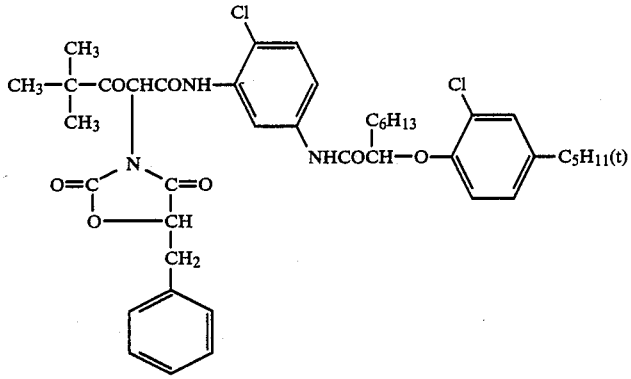

-continued
(Y-34)
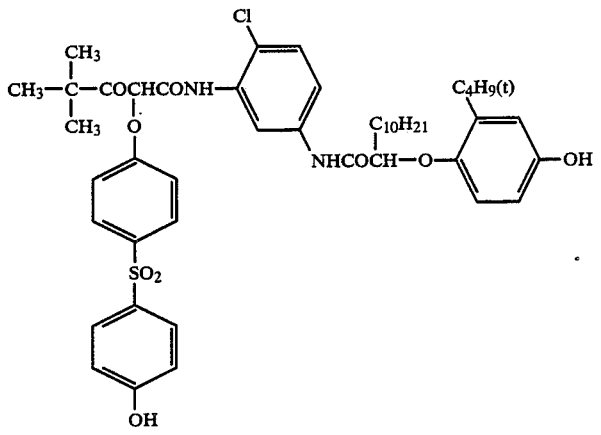
(Y-35)
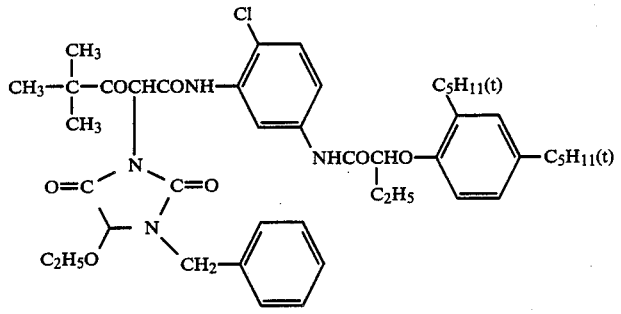
(Y-36)
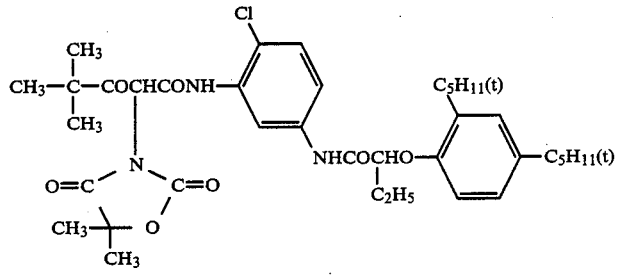
(Y-37)
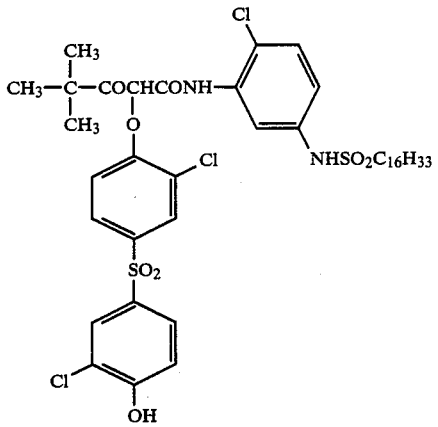

-continued (Y-38)

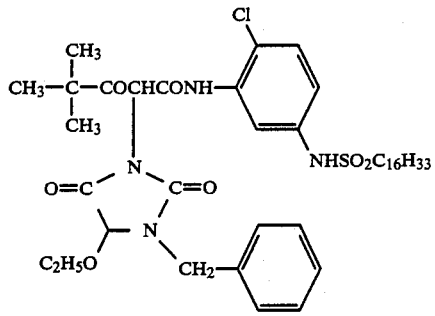

(Y-39)

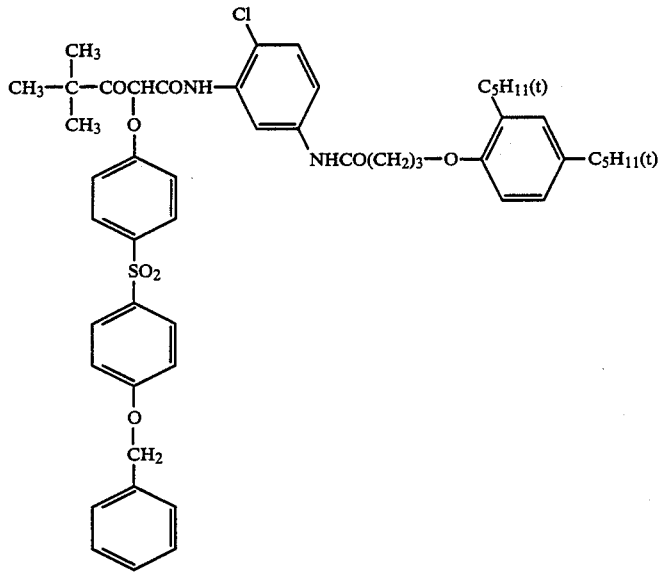

As for the 5-pyrazolone type magenta couplers which can be used in the present invention, those containing an arylamino or acylamino group as a substituent group at the 3-position (particularly those of two-equivalent type, which have a splitting-off group attached to the coupling active site via a sulfur atom) are preferably used.

More preferred magenta couplers are those of pyrazoloazole type, especially pyrazolo[5,1-c][,1,2,4]triazoles disclosed in U.S. Pat. No. 3,725,067. From the viewpoints of reduced yellow side-adsorption and excellence of light fastness of the developed dyes, imidazo[1,2,-b]pyrazoles described in U.S. Pat. No. 4,500,630 are more preferred, and pyrazolo[1,5-b]-[1,2,4]triazoles described in U.S. Pat. No. 4,540,654 are particularly preferred.

When a magenta coupler represented by formula (II) is used a photographic light-sensitive material which can produce an image having a diminished minimum density and an improved maximum density through a short-time development-processing can be obtained.

(II)

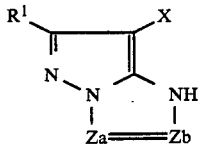

wherein Za and Zb each represent $$=\overset{R_2}{\overset{|}{C}}- \text{ or } =N-;$$

$R^1$ and $R^2$ each represents a hydrogen atom, or a substituent; X represents a hydrogen atom, or a group capable of splitting off by the coupling reaction with the oxidation product of an aromatic primary amine developing agent; when the bond formed by Za and Zb is a C—C double bond, it may constitute a part of an aromatic ring; and further the coupler may form a polymer or a bis-compound, via $R^1$, $R^2$ or X.

We have now found out a striking fact that a direct positive image having not only excellent color reproducibility, but also sufficient maximum density, high contrast and low minimum density can be produced through a short-time development by incorporating at least one magenta coupler represented by the foregoing general formula (II) and at least one nucleation accelerator represented by the foregoing general formula (N-1) in a direct positive photographic light-sensitive material, thus achieving the present invention.

Of the pyrazoloazole type magenta couplers represented by the general formula (II), those represented by the following general formulae (IIa) and (IIb) are preferred over others.

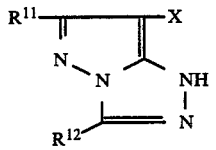

(IIa)

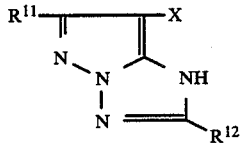

(IIb)

In the foregoing formulae (IIa) and (IIb), $R^{11}$ and $R^{12}$ may be the same or different, and each represents a hydrogen atom, a halogen atom, an alkyl group, an aryl group, a heterocyclyl group, a cyano group, an alkoxy group, an aryloxy group, a heterocyclyloxy group, an acyloxy group, a carbamoyloxy group, a silyloxy group, an aliphatic or aromatic sulfonyloxy group, an acylamino group, an anilino group, an ureido group, an imido group, a sulfamoyl-amino group, a carbamoylamino group, an alkylthio group, an arylthio group, a heterocyclylthio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group. Of the substituent groups described above, an alkyl group, an alkoxy group, an alkylthio group, an aryl group, an aryloxy group, an arylthio group, an acylamino group and an anilino group are particularly preferred over others.

X represents a hydrogen atom, a halogen atom, a carboxyl group, or a coupling eliminable group which is attached to the carbon atom located at the coupling site via its oxygen, nitrogen or sulfur atom.

Further, $R^{11}$, $R^{12}$ or X may represents a divalent group through which the magenta coupler can form a bis body.

Furthermore, the magenta coupler represented by the general formula (IIa) or (IIb) may assume the form of polymer coupler of the type which contains the coupler residues in the main chain or the side chains thereof. In particular, polymers derived from vinyl monomers containing the moiety represented by either of the foregoing two formulae are desirable. In this case, $R^{11}$, $R^{12}$ or X represents a vinyl group, or a linkage group.

A linkage group represented by $R^{11}$, $R^{12}$ or X when the moiety represented by the general formula (IIa) or (IIb) is contained in a vinyl monomer includes those formed by combining two or more of divalent groups selected from among substituted or unsubstituted alkylene groups (e.g., methylene, ethylene, 1,10-decylene) substituted or unsubstituted alkylene-0-alkylene groups, (e.g., $-CH_2CH_2OCH_2CH_2-$), substituted or unsubstituted phenylene groups, (e.g., 1,4-phenylene, 1,3-phenylene,

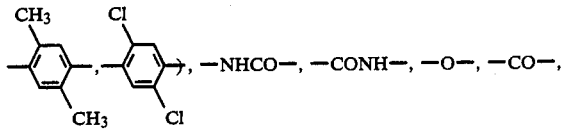

and substituted or unsubstituted aralkylene groups (e.g.,

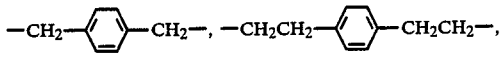

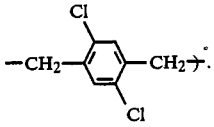

Specifically, —NHCO, $-CH_2CH_2-$,

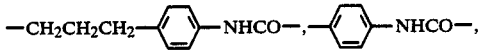

$-CH_2CH_2NHCO-$, $-CH_2CH_2OCO-$, $-CONH-CH_2CH_2NHCO-$, $-CH_2CH_2OCH_2CH_2NHCO-$, and

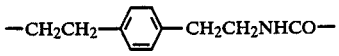

are preferred as the linkage group.

The vinyl group in the above-described vinyl monomer may contain a substituent group in addition to the moiety represented by the general formula (IIa) or (IIb). Preferred examples of such a substituent group include a hydrogen atom, a chlorine atom, or a lower alkyl group having from 1 to 4 carbon atoms (e.g., methyl, ethyl).

The monomer containing the coupler moiety represented by the general formula (IIa) or (IIb) may form a copolymer together with an ethylenically unsaturated monomer of the kind which cannot undergo the coupling reaction with the oxidation product of an aromatic primary amine developing agent, and therefore, cannot produce a color.

As well-known in the field of polymer color couplers, color-nonproducing ethylenically unsaturated monomers to be copolymerized with a solid, water-insoluble coupler monomer can be selected so as to produce desirable effects upon physical and/or chemical properties of the resulting copolymers, for example, solubility, compatibility with a binder, such as gelatin, contained in a photographic colloidal composition, flexibility, thermal stability, and so on.

Polymer couplers to be used in the present invention may be either soluble or insoluble in water, but those assuming the form of latex are particularly preferred.

Couplers and synthetic methods therefor are disclosed, for example, in U.S. Pat. Nos. 4,705,863 and 3,725,067.

Specific examples of representative magenta couplers to be used in the present invention are illustrated below.

(II-1)
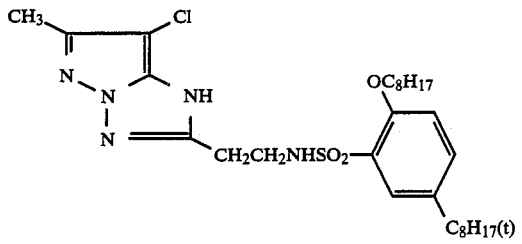
(II-2)
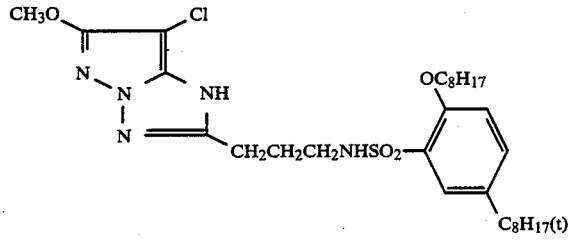
(II-3)
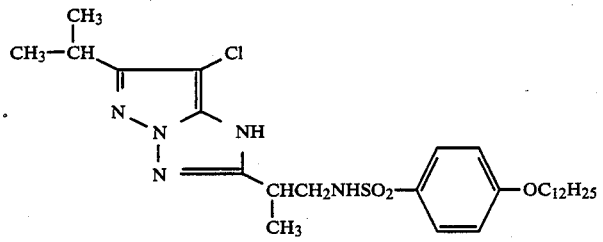
(II-4)
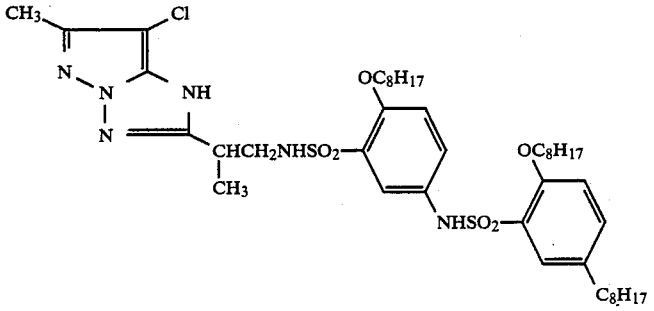
(II-5)
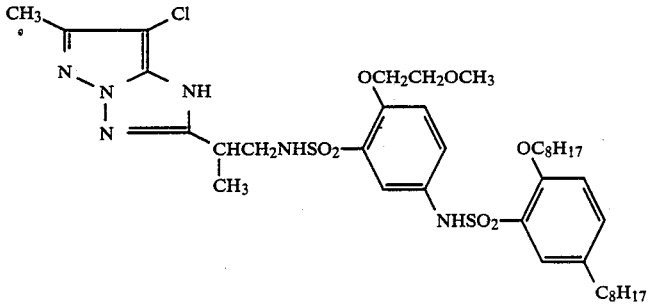
(II-6)
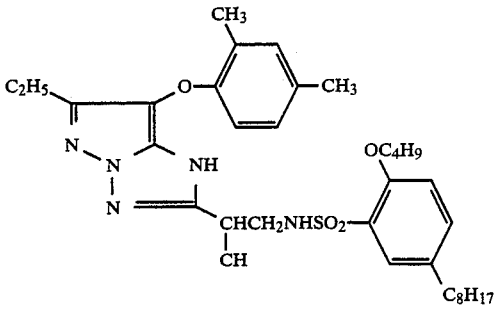

-continued
(II-7)
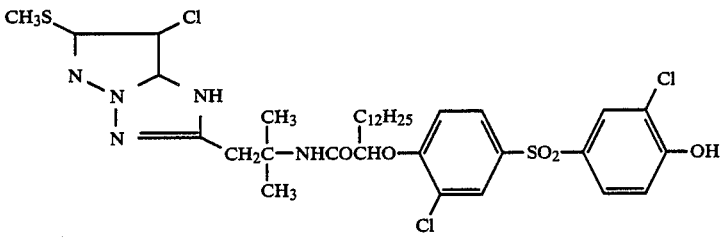
(II-8)
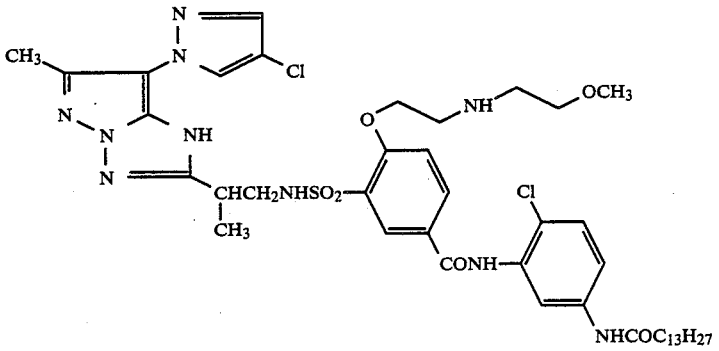
(II-9)
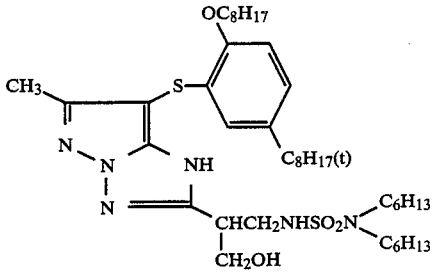
(II-10)
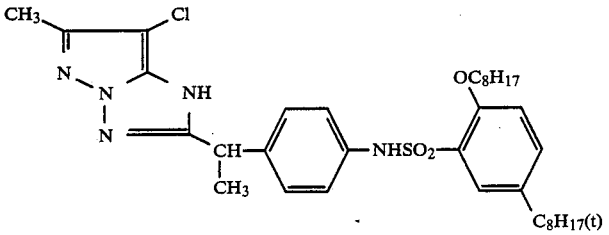
(II-11)
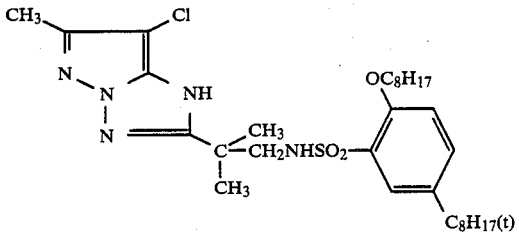
(II-12)
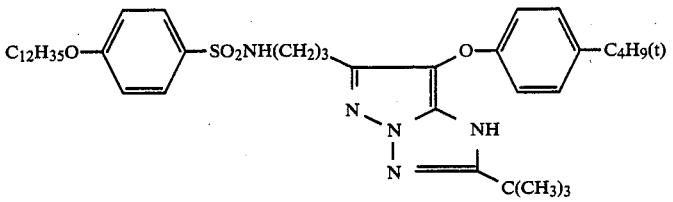

-continued
(II-13)
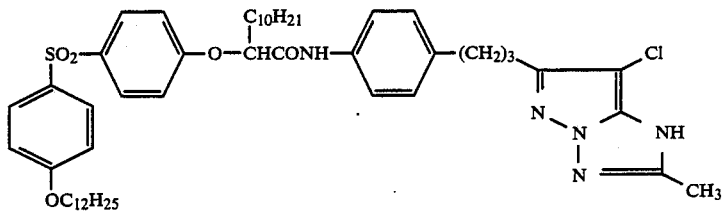
(II-14)
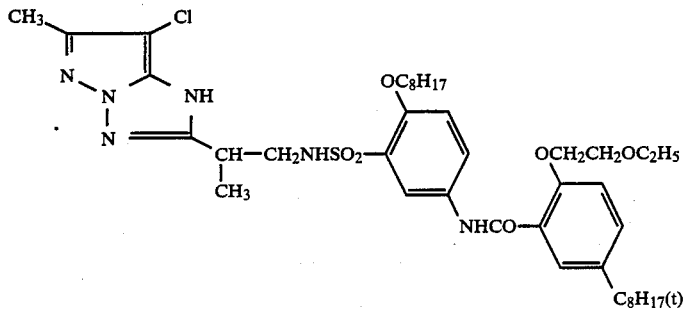
(II-15)
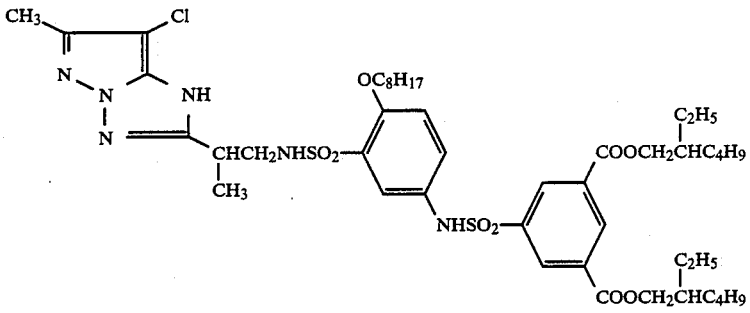
(II-16)
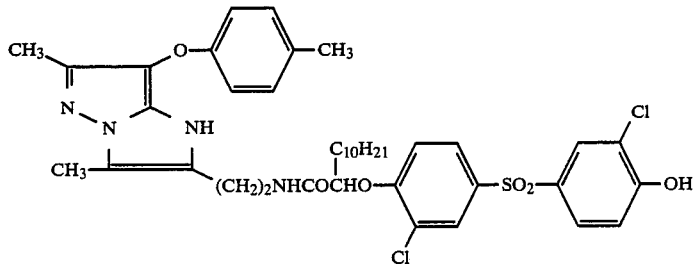
(II-17)
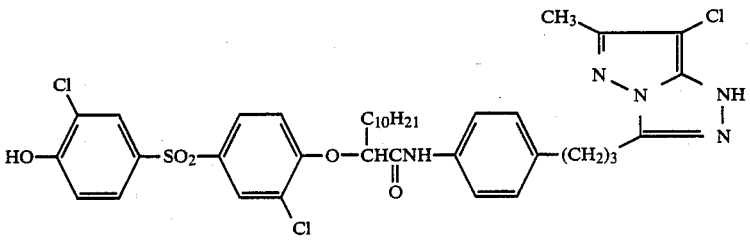
(II-18)
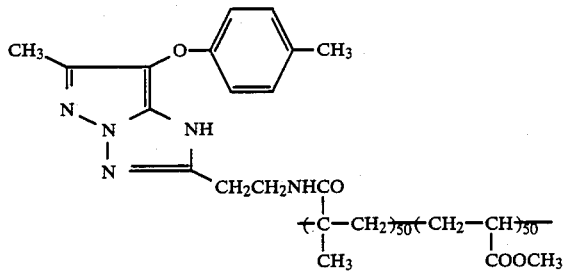

-continued
(weight ratio; the same hereinafter)
(II-19)
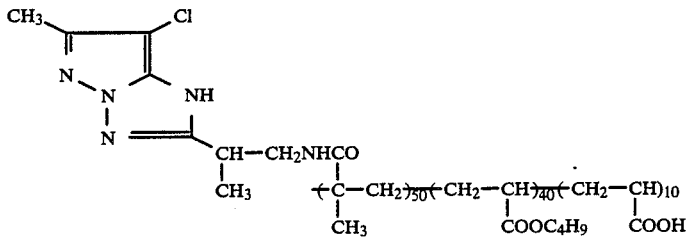
(II-20)
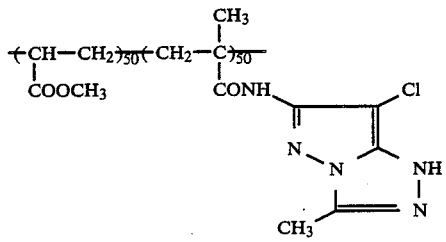
(II-21)
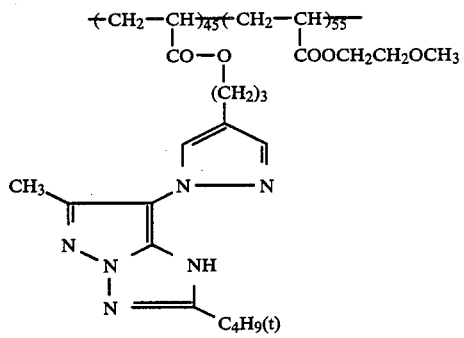
(II-22)
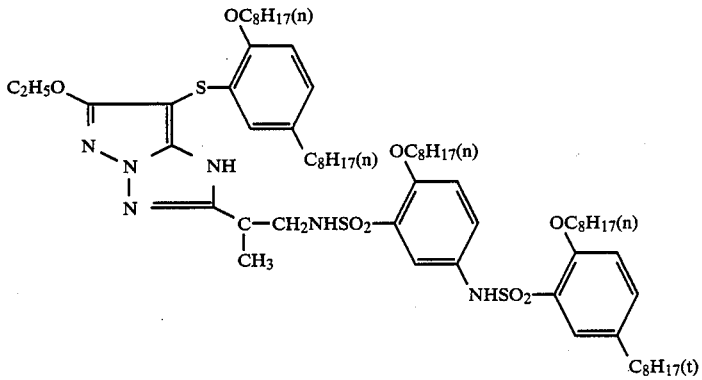
(II-23)
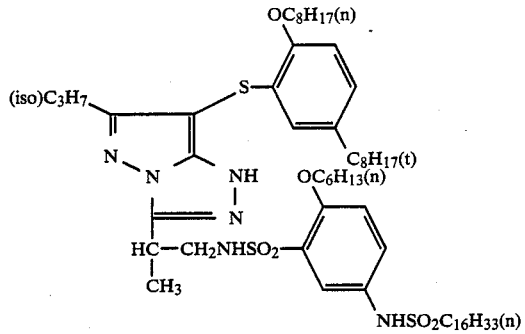

-continued
(II-24)
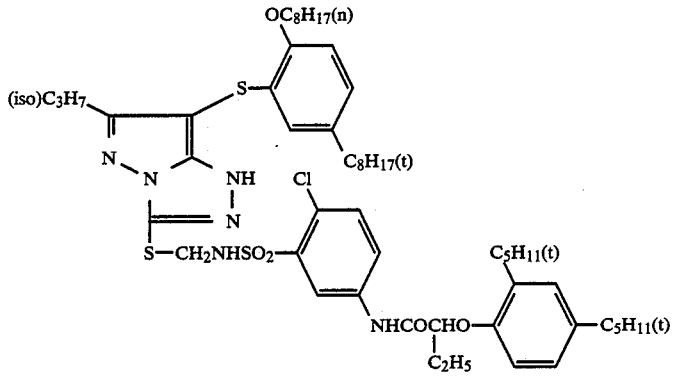
(II-25)
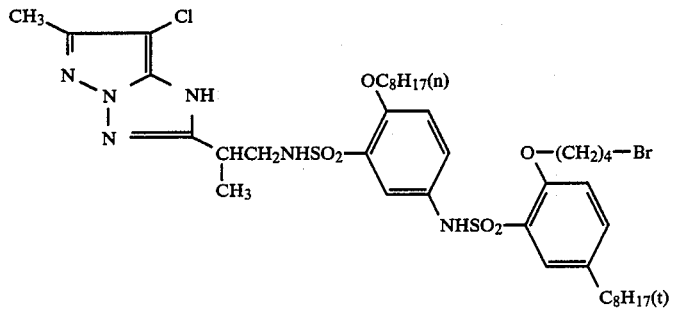
(II-26)
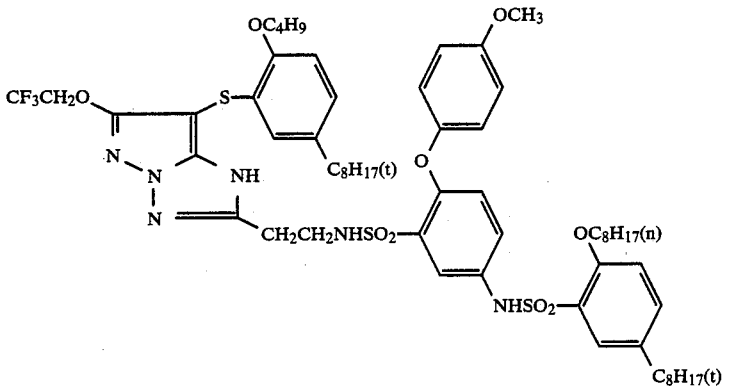
(II-27)
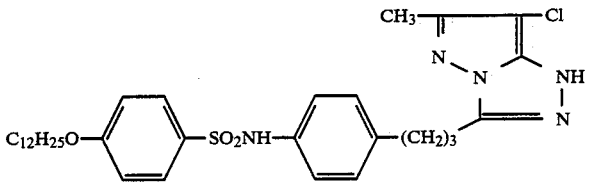
(II-28)
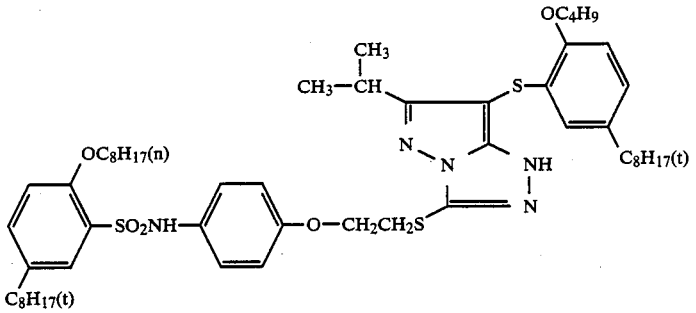

-continued
(II-29)
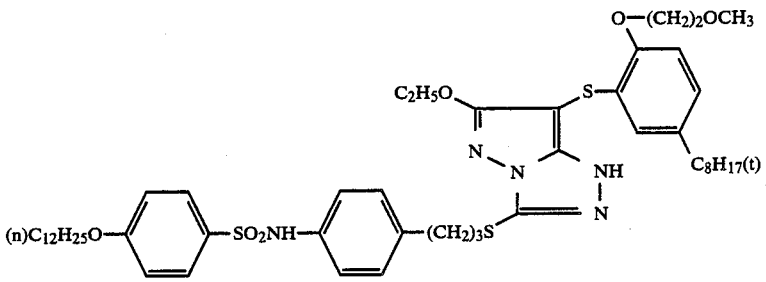
(II-30)
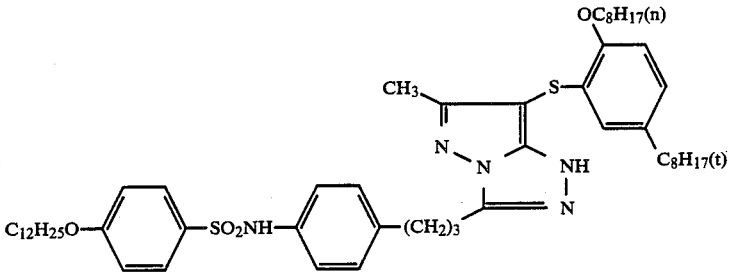
(II-31)
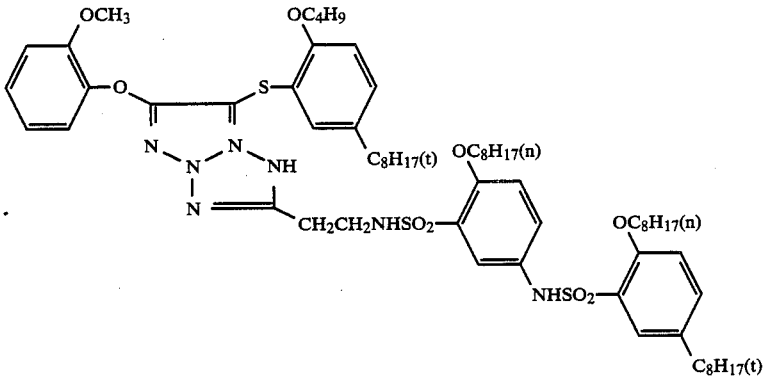
(II-32)
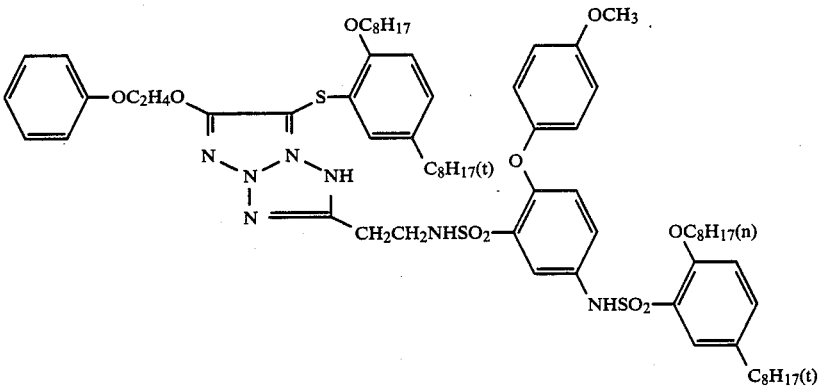
(II-33)
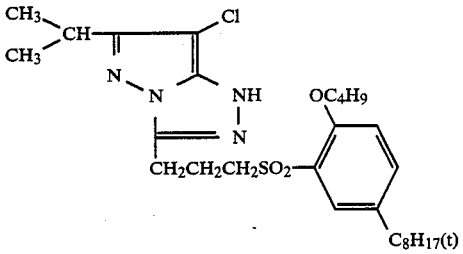

-continued (II-34)

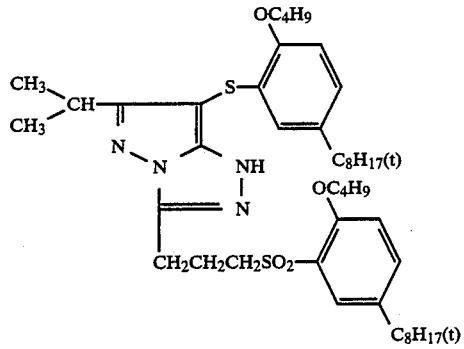

(II-35)

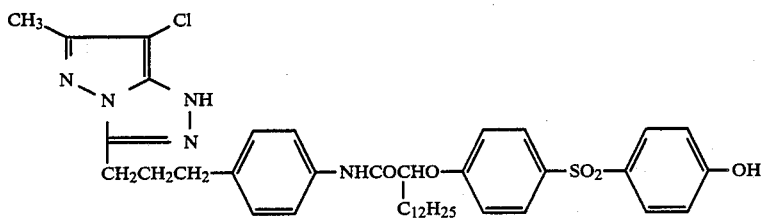

Cyan couplers which can be preferably used in the present invention include naphthol type and phenol type couplers disclosed in U.S. Pat. Nos. 2,474,293 and 4,502,21,2, and phenol type couplers which have an ethyl or higher alkyl group at the meta-position of the phenol nucleus, which are disclosed in U.S. Pat. No. 3,772,002. In addition, couplers of 2,5-di-acylamino-substituted phenol type are advantageous in respect of fastness of the dye images produced.

When a cyan coupler represented by the following formula (C-1) is used in the photographic light-sensitive material of the present invention a direct positive color image having a low sensitivity with regard to re-reversal negative can be obtained even after storage under a high temperature and high humidity condition.

(C-I)

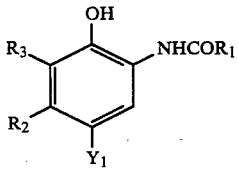

wherein $R_1$ represents an aliphatic group, an aryl group, a heterocyclic group, an arylamino group, or a heterocyclic amino group; $R_2$ represents an aliphatic group containing 2 to 20 carbon atoms; $R_3$ represents a hydrogen atom, a halogen atom, an aliphatic group, an aliphatic oxy group, or an acylamino group; and $Y_1$ represents a hydrogen atom, or a group capable of splitting off upon the coupling reaction with the oxidation product of a developing agent; and further, which may form a polymer of a grade not lower than a dimer or a bis-compound via $R_1$, $R_2$, $R_3$ or $Y_1$.

Cyan couplers which can be represented by the foregoing general formula (C-I) are known in JP-A-No. 60-232550, U.S. Pat. No. 3,772,002.

The term "aliphatic group" as used above is intended to include straight-chain, branched-chain and cyclic alkyl, alkenyl and alkinyl groups, which may further be substituted.

$R_1$ to $R_3$, and $Y_1$ in the general formula (C-I) are described in detail below.

When $Y_1$ represents a splitting-off group in the general formula (C-I), the splitting-off group includes an aliphatic group, an aromatic group, a heterocyclic group, an aliphatic, aromatic or heterocyclic sulfonyl group, and an aliphatic, aromatic or heterocyclic carbonyl group, which are attached to a coupling active carbon via their individual oxygen, nitrogen, sulfur or carbon atom; a halogen atom; an aromatic azo group; and so on. Aliphatic, aromatic or heterocyclic moieties contained in these splitting-off groups may be substituted by one or more of a substituent group as described below in regard to $R_1$. Two or more of substituent groups present therein may be the same as or different from one another, and these substituent groups may further have substituent groups as exemplified in the description of $R_1$.

Specific examples of splitting-off groups as described above include halogen atoms (e.g., fluorine, chlorine, bromine); alkoxy groups (e.g., ethoxy, dodecyloxy, methoxyethylcarbamoylmethoxy, carboxypropyloxy, methylsulfonylethoxy), aryloxy groups (e.g., 4-chlorophenoxy, 4-methoxyphenoxy, 4-carboxyphenoxy), acyloxy groups (e.g., acetoxy, tetradecanoyloxy, benzoyloxy), aliphatic and aromatic sulfonyloxy groups (e.g., methanesulfonyloxy, toluenesulfonyloxy), acylamino groups (e.g., dichloroacetylamino, heptanefluorobutyrylamino), aliphatic and aromatic sulfonamido groups (e.g., methanesulfonylamino, p-toluenesulfonylamino), alkoxycarbonyloxy groups (e.g., ethoxycarbonyloxy, benzyloxycarbonyloxy), aryloxycarbonyloxy groups (e.g., phenoxycarbonyloxy), aliphatic, aromatic and heterocyclic thio groups (e.g., ethylthio, phenylthio, tetrazolylthio), carbamoylamino groups (e.g., N-methylcarbamoylamino, N-phenylcarbamoylamino), 5- and 6-membered nitrogencontaining heterocyclic groups (e.g., imidazolyl, pyrazolyl, triazolyl, tetrazolyl, 1,2-dihydro-2-oxo-1-pyridyl), imido groups (e.g., succinimido, hydantoinyl), aromatic azo groups (e.g. phenylazo), and so on. In addition, bis-type couplers obtained by condensing four-equivalent couplers by aldehydes or ketones can be cited as examples of a splitting-off group attached to the coupling active site via its carbon atom. The splitting-off groups relating to the present invention may contain a photographically useful group, e.g., a group derived from a development inhibitor, a development accelerator.

$R_1$ in the general formula (C-I) represents an aliphatic group containing preferably from 1 to 36 carbon atoms, an romatic group containing preferably from 6 to 36 carbon atoms (e.g., phenyl, naphthyl), a heterocyclic group (e.g., 3-pyridyl, 2-furyl), or an aromatic or heterocyclic amino group (e.g., anilino, naphthylamino, 2-benzothiazolylamino, 2-pyridylamino), which each may further be usbstituted by one or more of a group selected from among an alkyl group, an aryl group, a heterocyclic group, an alkoxy group (e.g., methoxy, 2-methoxyethoxy), an aryloxy group (e.g., 2,4-di-tert-amylphenoxy, 2-chlorophenoxy, 4-cyanophenoxy), an alkenyloxy group (e.g., 2-propenyloxy), an acyl group (e.g., acetyl, benzoyl), an ester group (e.g., butoxycarbonyl, phenoxycarbonyl, acetoxy, benzoyloxy, butoxysulfonyl, toluenesulfonyloxy), an amido group (e.g., acetylamino) a carbamoyl group (e.g., ethylcarbamoyl, dimethylcarbamoyl), a sulfamoyl group (e.g., butylsulfamoyl), a sulfonylamino group (e.g., methanesulfonylamino) a sulfamoylamino group (e.g., dipropylsulfamoylamino), an imido group (e.g., succinimido, hydantoinyl), an ureido group (e.g., phenylureido, dimethylureido), an aliphatic or aromatic sulfonyl group (e.g., methanesulfonyl, phenylsulfonyl), an aliphatic or aromatic thio group (e.g., ethylthio, phenylthio), a hydroxy group, a cyano group, a carboxyl group, a nitro group, a sulfo group, a halogen atom.

Representatives of the aliphatic groups are methyl group, ethyl group, butyl group, dodecyl group, octadecyl group, eicocenyl group, iso-propyl group, tert-butyl group, tert-octyl group, tert-dodecyl group, cyclohexyl group, cyclopentyl group, allyl group, vinyl group, 2-hexadecenyl group, propargyl group, and the like. These groups may further be substituted by a substituent group as described above.

$R_3$ in the general formula (C-I) represents a hydrogen atom, a halogen atom (e.g., fluorine, chlorine, bromine), an aliphatic group containing preferably from 1 to 20 carbon atoms, an aliphatic oxy group containing preferably from 1 to 20 carbon atoms, or an acylamino group containing from 1 to 20 carbon atoms (e.g., acetamido, benzamido, tetradecanamido). Each of these aliphatic, aliphatic oxy and acylamino groups may further be substituted by a substituent group as exemplified in regard to $R_1$.

The couplers of the general formula (C-I) may form a polymer of a grade not lower than a dimer or a bis-compound via one of the substituents $R_1$, $R_2$, $R_3$ and $Y_1$, independently or in combination. In the case of bis-compounds, these substituents represent a mere bonding hand, or a divalent linkage group alkylene, arylene, ether, ester, amido, combinations of two or more thereof). In the case of olygomers or polymers, on the other hand, it is desirable that those groups should constitute the main chain of a polymer, or should be a divalent linkage group as described above to enter into combination with the main chain of a polymer. When the coupler of the general formula (C-I) assumes the form of a polymer, the polymer may be a homopolymer prepared from the coupler derivative alone, or a copolymer prepared from the coupler derivative and one or more of a color nonproducing ethylenic monomer (e.g., acrylic acid, methacrylic acid, methyl acrylate, n-butylacrylamide, β-hydroxymethacrylate, vinyl acetate, acrylonitrile, styrene, crotonic acid, maleic anhydride, N-vinylpyrrolidone).

Preferred groups as $R_1$ in the general formula (C-I) are substituted or unsubstituted alkyl and aryl groups. A particularly preferable substituent group which the alkyl groups may have is a phenoxy group (which may be substituted with an alkyl group, an alkoxy group, a halogen, a sulfonamido group, a sulfamido group), or a halogen atom. As for the aryl groups, phenyl groups substituted with at least one halogen atom, alkyl group, sulfonamido group or acylamino group are particularly preferred.

Preferred groups as $R_2$ in the general formula (C-I) are alkyl groups containing from 2 to 20 carbon atoms, which may be substituted. Preferred substituents of these alkyl groups include an alkoxy group, an aryloxy group, an acylamino group, an alkylthio group, an arylthio group, an imido group, an ureido group, an alkylsulfonyl group, and an arylsulfonyl group.

Preferred groups as $R_3$ in the general formula (C-I) are a hydrogen atom, a halogen atom (particularly fluorine or chlorine atom), and an acylamino group. Of these groups, a halogen atom is especially desirable.

More preferably, $R_2$ in the general formula (C-I) is an alkyl group containing from 2 to 4 carbon atoms. $Y_1$ in the general formula (C-I) is more preferably a halogen atom, particularly a chlorine atom.

The couplers represented by the general formula (C-I) can be used individually or as a mixture of two or more thereof. Further, they can be used together with other conventional cyan couplers.

Specific examples of nondiffusible cyan couplers represented by the general formula (C-I) of the present invention are illustrated below. However, the invention should not be construed as being limited to these examples.

(C-I-1)

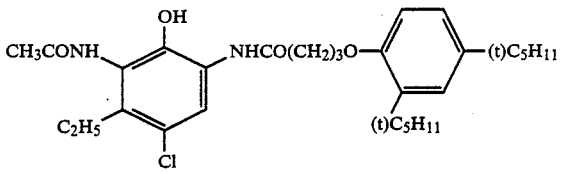

-continued
(C-I-2)
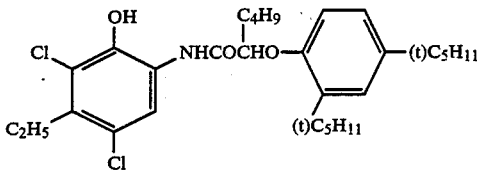
(C-I-3)
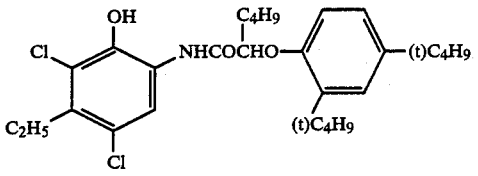
(C-I-4)
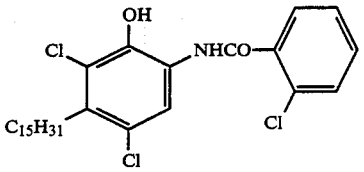
(C-I-5)
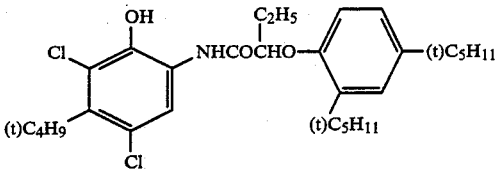
(C-I-6)
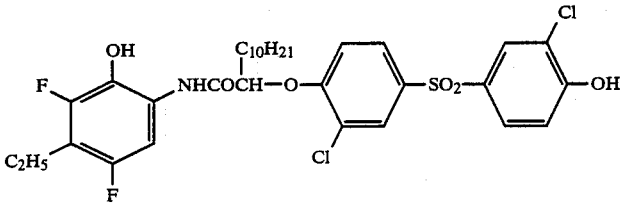
(C-I-7)
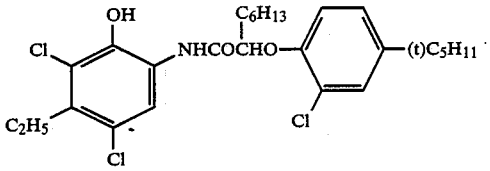
(C-I-8)
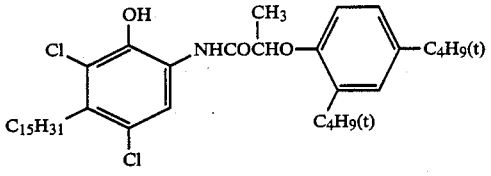
(C-I-9)
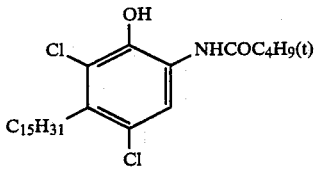

-continued (C-I-10)

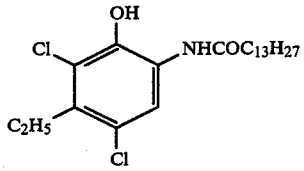

(C-I-11)

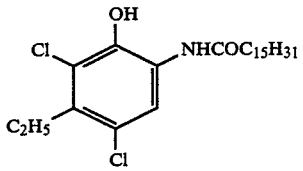

(C-I-12)

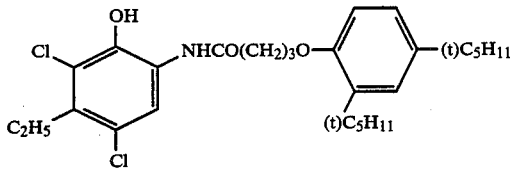

(C-I-13)

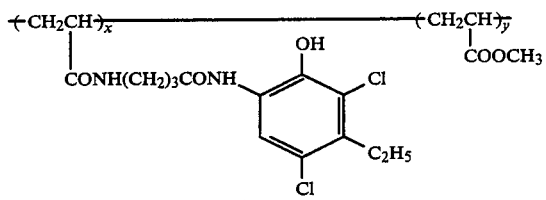

x:y = 1:9 (by weight)

Colored couplers for correction of unnecessary adsorption which the dyes produced have in a short wavelength region, couplers which can be converted to dyes having a moderate diffusibility as the result of color development, colorless couplers, DIR couplers which can release development inhibitors in proportion as the coupling reaction proceeds, and polymeric couplers can also be employed.

As for the above-described couplers and so on, two or more of them can be incorporated in the same layer in order to satisfy characteristics required of the light-sensitive material. Further, they can be used together with other magenta couplers.

The standard amount of a color coupler used ranges from 0.001 to 1 mole per mol of light-sensitive silver halide. More specifically, a preferred amount is within the range of 0.01 to 0.5 mole in the case of a yellow coupler, 0.03 to 0.5 mole in the case of a magenta coupler, and 0.002 to 0.5 mole in the case of a cyan coupler.

For the purpose of improving the color developability of couplers, a color development intensifying agent can be used in the present invention. Typical examples of such an agent are described in JP-A-No. 62-215272, pp. 374–391.

Couplers are dissolved in a high boiling point organic solvent and/or a low boiling point organic solvent, emulsified and dispersed in an aqueous solution of gelatin or another hydrophilic colloid by high-speed stirring with a homogenizer or the like, by mechanical fine grinding with a colloid mill or the like, or by a technique utilizing ultrasonic waves, and then added to a silver halide emulsion. The incorporation of couplers into an emulsion layer, though not always requiring high boiling point organic solvents, is preferably carried out using the compounds described in JP-A-No. 62-215272, pp. 440–467.

Couplers which can be employed in the present invention can be dispersed into a hydrophilic colloid using methods described in JP-A-No. 62-215272, pp. 468–475, or U.S. Pat. No. 2,322,027.

Examples for a high boiling point solvent, such as a phthalic acid alkyl ester (e.g., dibutyl phthalate, dioctyl phthalate), a phosphoric acid ester (e.g., diphenyl phosphate, triphenyl phosphate, tricresyl phosphate, dioctyl butyl phosphate), a citric acid ester (e.g., tributyl acetylcitrate), a benzoic acid ester (e.g., octyl benzoate), an alkylamide (e.g., diethyllaurylamide), a fatty acid ester (e.g., dibutoxyethylsuccinate, diethyl azelate), a trimesic acid ester (e.g., tributyl trimesate)and an organic solvent having a boiling point of about 30° to 150° C., e.g., a lower alkyl acetate such as ethyl acetate, butyl acetate, etc., ethyl propionate, secondary butyl alcohol, methyl isobutyl ketone, β-ethoxyethyl acetate, and methyl cellosolve acetate. The foregoing high and low boiling organic solvents may be used as a mixture thereof.

A photographic material produced in accordance with the present invention may contain as a color fog inhibitor or a color stain inhibitor a hydroquinone derivative, an aminophenol derivative, an amine, a gallic acid derivative, a catechol derivative, an ascorbic acid derivative, a colorless coupler, a sulfonamidophenol derivative, or the like. Typical examples of color fog inhibitors and color stain inhibitors are described in JP-A-No. 62-215272, pp. 600–663.

The photographic material of the present invention can contain various discoloration inhibitors. Typical organic discoloration inhibitors are hydroquinones, 6-hydroxychromanes, 5-hydroxycoumarans, spirochromanes, p-alkoxyphenols, hindered phenols including bisphenols as main members, gallic acid derivatives, methylenedioxybenzenes, aminophenols, hindered amines, and ether or ester derivatives thereof obtained by silylating or alkylating a phenolic hydroxyl group of each of the above-cited compounds. In addition, metal complex salts represented by (bissalicylaldoximato)-nickel complexes and (bis-N,N-dialkyldithiocarbamato)nickel complexes can be employed as discoloration inhibitors.

For the prevention of deterioration of yellow dye images due to heat, moisture and light, compounds having both hindered amine and hindered phenol moieties in the molecule, as described in U.S. Pat. No. 4,268,593, can produce a desirable effect. In order to prevent a magenta dye image from deterioration, particularly due to light, spiroindanes described in JP-A-No. 56-159644, and chromanes substituted by a hydroquinone diether or monoether described in JP-A-No. 55-89835 are employed to advantage.

Typical examples of these discoloration inhibitors are described in JP-A-No. 62-215272, pp. 401–440.

The desired end can be usually achieved when the foregoing compounds are coemulsified with couplers in proportions of 5 to 100 wt % to their corresponding couplers, and then incorporated in light-sensitive layers.

In order to prevent cyan dyes from deterioration due to heat and light, particularly light, it is effective to introduce an ultraviolet absorbent into both layers adjcent to the cyan color-forming layer. In addition, an ultraviolet absorbent can be incorporated into a hydrophilic colloid layer like a protective layer. Typical examples of ultraviolet absorbents are described in JP-A-No. 62-215272, pp. 391–400.

As for the binder or the protective colloid contained in emulsion layers and interlayers of the photographic material of the present invention, gelatin is used to advantage. Also, hydrophilic colloids other than gelatin can be used.

To the photographic material of the present invention ca be added dyes for prevention of irradiation and antihalation, an ultraviolet absorbent, a plasticizer, a brightening agent, a matting agent, an aerial fog inhibitor, a coating aid, a hardener, an antistatic agent, a slippability improving agent and so on. Examples of these additives are described in *Research Disclosure,* No. 17643, Item VIII–XIII, pp. 25–27 (December 1978), and ibid, No. 18716, pp. 647–651 (November 1979).

The present invention can also be applied to a multilayer multicolor photographic material having at least two emulsion layer having different color sensitivities on a support. A multilayer color photographic material has, in general, at least one red-sensitive emulsion layer, at least one green-sensitive emulsion layer and at least one blue-sensitive emulsion layer on a support. The order of these layers can be varied as desired. Preferably, a red-sensitive layer, a green-sensitive layer and a blue-sensitive layer are arranged in this order from the support side, or a green-sensitive layer, a red-sensitive layer and a blue-sensitive layer are arranged in this order from the support side. Each of the above-described emulsion layers may have two or more constituent layers differing in sensitivity, and a nonlight-insensitive layer may be sandwitched in between any two of the constituent layers having the same color sensitivity. Though it is general to incorporate a cyan dye-forming coupler in a red-sensitive emulsion layer, a magenta dye-forming coupler in a green-sensitive emulsion layer, and a yellow dye-forming coupler in a blue-sensitive emulsion layer, combinations other than the above-described one can be employed, if desired.

For the purpose of heightening the maximum image density, lowering of the minimum image density, improving the preservability of the sensitive material, increasing the developing speed, or so on, the following compounds can be incorporated in the sensitive material.

Specifically, there are cited hydroquinones (e.g., those described in U.S. Pat. Nos. 3,227,552 and 4,279,987), chromans (e.g., those described in U.S. Pat. No. 4,268,621, JP-A-No. 54-103031, and *Research Disclosure,* No. 18264, pp. 333–334 (June 1979)), quinones (e.g., those described in *Research Disclosure,* No. 21206, pp. 433–434 (December 1981), amines (e.g., those described in U.S. Pat. No. 4,150,993, and JP-A-No. 58-174757), oxidizers (e.g., those described in JP-A-No. 60-260039, *Research Disclosure,* No. 16936, pp. 10–11 (May 1978)), catechols (e.g., those described in JP-A-Nos. 55-21013 and 55-65944), compounds capable of releasing a nucleating agent upon development (e.g., those described in JP-A-No. 60-107029 (U.S. Pat. No. 4,724,199)), thioureas (e.g., those described in JP-A-No. 60-95533 (U.S. Pat. No. 4,629,678)), and spirobisindanes (e.g., those described in JP-A-No. 55-65944).

In the photographic material used in the present invention, it is desirable to provide, in addition to silver halide emulsion layers, proper auxiliary layers such as a protective layer, an interlayer, a filter layer, an antihalation layer, a backing layer, and a light-reflecting white layer.

Photographic emulsion layers and other layers to constitute the photographic light-sensitive material of the present invention are coated over a support such as described in *Research Disclosure,* No. 17643, Item XVII, p. 28.(December 1978), European Pat. No. 0,182,253, and JP-A-No. 61-97655. Therein, coating methods described in *Research Disclosure,* No. 17643, Item XV, pp. 28–29 can be used.

The present invention can be applied to various kinds of color light-sensitive materials, including color reversal films for slide or television use, color reversal paper, and instant color films. In addition, the invention can be applied to full-color copying machines, color hard copies for preserving CRT (cathode ray tube) images, and the like. Moreover, the invention can be applied to a white-and-black light-sensitive material of the type which utilizes mixing of three color couplers, as described in *Research Disclosure,* No. 17123 (July 1978).

Further, the present invention can be applied to black and white photographic materials.

Black and white (B/W) photographic materials which can utilize the present invention include B/W direct-positive photographic materials described in JP-A-Nos. 59-208540 and 60-260039 (such as X-ray light-sensitive materials, duplicating light-sensitive materials, micrographic materials, photocomposing light-sensitive materials, and light-sensitive materials for printing).

In order to promote the action of the nucleating agent represented by the foregoing general formula (N-I), nucleation accelerators described below can be used in the present invention. As for the nucleation accelerators, tetraazaindenes, triazaindenes and pentazaindenes which each containing at least one mercapto group and optionally be substituted by an alkali metal atom or an ammonium group, and compounds described in JP-A-

No. 63-106506 (European Patent application No. 249,239A) can be added.

Specific examples of nucleation accelerators as described above are set forth below. However, the invention is not to be construed as being limited to these examples.

(A-1) 3-Mercapto-1,2,4-triazolo[4,5-a]pyridine.
(A-2) 3-Mercapto-1,2,4-triazolo[4,5-a]pyrimidine.
(A-3) 5-Mercapto-1,2,4-triazolo[1,5-a]pyrimidine.
(A-4) 7-(2-dimethylaminoethyl)-5-mercapto-1,2,4-triazolo-[1,5-a]pyrimidine.
(A-5) 3-Mercapto-7-methyl-1,2,4-triazolo[4,5-a]pyrimidine.
(A-6) 3,6-Dimercapto-1,2,4-triazolo[4,5-b]pyridazine.
(A-7) 2-Mercapto-5-methylthio-1,3,4-thiadiazole.
(A-8) 3-Mercapto-4-methyl-1,2,4-triazole.
(A-9) 2-(3-Dimethylaminopropylthio)-5-mercapto-1,3,4-thiadiazole hydrochloride.
(A-10) 2-(2-Morpholinoethylthio)-5-mercapto-1,3,4-thiadiazole hydrochloride.
(A-11) Sodium 2-mercapto-5-methylthiomethylthio-1,3,4-thiadiazole.
(A-12) 4-(2-Morpholinoethyl)-3-mercapto-1,2,4-triazole.
(A-13) 2-[2-(2-Dimethylaminoethylthio)ethylthio]-5-mercapto-1,3,4-thiadiazole hydrochloride.
(A-14) 2-(6-Dimethylaminohexylthio)-5-mercapto-1,3,4-thiadiazole hydrochloride.
(A-15) 2-{3-[2-methyl-1-(1,4,5,6-tetrahydropyrimidinyl)]propylthio}-5-mercapto-1,3,4-thiadiazole hydrochloride.

These nucleation accelerators can be contained in not only the light-sensitive material but also in processing solutions. They are preferably incorporated in the light-sensitive layers, particularly in the internal latent-image type silver halide emulsion layers or other hydrophilic colloid layers (e.g., an interlayer, or a protective layer). They are particularly preferably incorporated in silver halide emulsion layers or their adjacent layers. Two or more of nucleation accelerators may also be used in combination.

When the nucleation accelarator is incorporated into a photographic light-sensitive material, it is preferably incorporated in an amount of from $1\times10^{-6}$ to $1\times10^{-2}$ mol, more preferably $1\times10^{-5}$ to $1\times10^{-2}$ mol per mol of silver halide, and when it is incorporated into a processing solution, i.e., a developing solution or a prebath thereof, it is preferably incorporated in an amount of from $1\times10^{-8}$ to $1\times10^{-3}$ mol/l, more preferably from $1\times10^{-7}$ to $1\times10^{-4}$ mol/l.

A color developing solution to be used in the development-processing of the photographic material of the present invention is preferably an alkaline aqueous solution containing an aromatic primary amine type developing agent as a main component. As for the color developing agent, p-phenylenediamine compounds are preferred, though aminophenol compounds are useful, too. Typical examples of p-phenylenediamine compounds are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides or p-toluenesulfonates of these anilines. These compounds can be used in combination of two or more thereof, if desired. The pH of a color developer is preferably not higher than 12, more preferably is from 9 to 12, and most preferably is from 9.5 to 11.5.

After color development, photographic emulsion layers are generally subjected to a bleach processing. The bleach processing may be carried out simultaneously with a fixation processing (a bleach-fix processing), or separately therefrom. For the purpose of reducing the photographic processing time, the bleach processing may be followed by the bleach-fix processing. Also, the processing may be performed with two successive bleach-fix baths, or the fixation processing may be followed by the bleach-fix processing, or the bleach-fix processing may be followed by the bleach processing if desired. Examples of bleaching agents which can be used include compounds of polyvalent metals, such as Fe(III), Co(III), Cr(VI), Cu(II); peracids; quinones; and nitro compounds. More specifically, ferricyanides; dichromates; organic complex salts formed by Fe(III) or Co(III), and aminopolycarboxylic acids, such as ethylene-diaminetetraacetic acid, diethylenetriamine-pentaacetic acid, cyclohexanediaminetetraacetic acid, methylimino-diacetic acid, 1,3-diaminopropanetetraacetic acid, glycol ether diamine tetraacetic acid, citric acid, tartaric acid, malic acid; persulfates; hydrobromides; permanganates; and nitrobenzenes; can be used as bleaching agents. Of these bleaching agents, aminopolycarboxylic acid-Fe(III) complex salts including (ethylenediaminetetra-acetato)iron(III) complex, and persulfates are preferred for rapid processing and prevention of environmental pollution. In particular, aminopolycarboxylic acid-Fe(III) complex salts are useful in both a bleaching bath and bleach-fix bath. The pH of the bleaching or bleach-fix bath which uses an aminopolycarboxylic acid-Fe(III) complex salt generally ranges from 5.5 to 8, but the processing can be performed under a lower pH for the purpose of increasing the processing speed.

In the bleaching bath, the bleach-fix bath and their prebaths, a bleach accelerator can be used, if desired. Specific examples of useful bleach accelerators include compounds containing a mercapto group or a disulfido linkage, as disclosed in U.S. Pat. No. 3,893,858, West German Pat. No. 1,290,812, JP-A-No. 53-95630, *Research Disclosure,* No. 17129 (July 1978), and so on; the thiazolidine derivatives disclosed in JP-A-No. 50-140129; the urea derivatives disclosed in U.S. Pat. No. 3,706,561; the iodides disclosed in JP-A-No. 58-16235; the polyoxyethylene compounds disclosed in West German Pat. No. 2,748,430; the polyamine compounds disclosed in JP-B-No. 45-8836; bromide ion; and so on. Of these compounds, the compounds containing a mercapto group or a disulfido linkage are preferred over others because of their great accelerating effects. In particular, the compounds disclosed in U.S. Pat. No. 3,893,858, West German Pat. No. 1,290,812 and JP-A-No. 53-95630 are advantageous. The compounds disclosed in U.S. Pat. No. 4,552,835 are also preferred. These bleach accelerators may be incorporated in a sensitive material. In case of the bleach-fix processing of color photographic materials for photograph-taking, these bleach accelerators can produce a particularly great effect.

Examples of fixing agents which can be used include thiosulfates, thiocyanates, thioether compounds, thioureas and a large amount of iodide. Of these fixing agents, generally used ones are thiosulfates, especially ammonium thiosulfate. As for the preservatives for a bleach-fix bath, sulfites, bisulfites or adducts of carbonyl compounds and bisulfite are preferably used.

After a desilvering step, the silver halide color photographic material of the present invention is typically subjected to a step of washing with water and/or a stabilizing step. The volume of washing water required can be determined variously depending on the characteristics of photographic materials to be processed (e.g., on what kinds of couplers are incorporated therein), the end-use purposes of photographic materials to be processed, the temperature of washing water, the number of washing tanks (stage number), the way of replenishing washing water (e.g., co-current or counter-current), and other various conditions. Of these conditions, the relation between the number of washing tanks and the volume of washing water in the multistage counter current process can be determined according to the methods described in *Journal of the Society of Motion Picture and Television Engineers,* volume 64, pages 248–254 (May 1955).

According to the multistage counter current process described in the above-cited article, the volume of washing water can be sharply decreased. However, the process has disadvantages, e.g., in that bacteria propagate in the tanks because of an increase in staying time of water in the tanks, and suspended matter produced from the bacteria adheres photographic materials processed therein. In the processing of the color photosensitive material of the present invention, the method of reducing the contents of calcium and magnesium, which is disclosed in JP-A-No. 62-288838, can be employed to great advantage for solving this problem. Further, bactericides such as isothiazolone compounds disclosed in JP-A-No. 57-8542, chlorine-containing germicides such as sodium salt of chlorinated isocyanuric acid, and benzotriazoles, as described in Hiroshi Horiguchi *Bohkin Bohbai Zai no Kagaku* (which means "Chemistry of Antibacteria and Antimolds"), *Biseibutsu no Mekkin Sakkin Bohbai Gijutsu* (which means "Arts of Sterilizing and Pasteurizing Microbe, and Mold Proofing"), compiled by Eisei Gijutsu Kai, and *Bohkin- and Bohbai-zai Jiten* (which means "Thesaurus of Antibacteria and Antimolds"), compiled by Nippon Bohkin Bohbai Gakkai.

Washing water to be used in the processing of the photographic material of the present invention is generally adjusted to pH 4–9, preferably to pH 5–8. The washing temperature and washing time, can be varied depending on the characteristics and the intended use of the photosensitive material to be washed, but are generally in the range of 20 sec. to 10 min. at 15° C.–45° C., preferably 30 sec. to 5 min. at 25° C.–40° C.

Also, the photographic material of the present invention can be processed directly with a stabilizing solution in place of using the above-described washing water. All conventional methods which are described in JP-A-Nos. 57-8543, 58-14834 and 60-220345, can be applied to the stabilization processing in the present invention.

To the stabilizing bath various kinds of chelating agents and antimolds can be added.

The washing water and/or the stabilizing solution overflowing the processing baths with the replenishing thereof can also be reused in other steps, such as the desilvering step.

For the purposes of simplification and speed up of a photographic processing of the silver halide photographic material to be used in the present invention, a color developing agent may be incorporated thereinto. It is preferred that the color developing agent be used in the form of precursors of various types, including compounds of an indoaniline compound described in U.S. Pat. No. 3,342,599, compounds of a Schiff base type described in U.S. Pat. No. 3,342,599 and *Research Disclosure,* Nos. 14850 and 15159, aldol compounds described in Id., No. 13924, metal complex salts described in U.S. Pat. No. 3,719,492, and urethane compounds described in JP-A-No. 53-135628.

In the silver halide photographic material to be used in the present invention, various 1-phenyl-3-pyrazolidones may be incorporated for the purpose of accelerating color development. Typical examples of such compounds are described in JP-A-Nos. 56-64339, 57-144547 and 115438.

The temperature of each processing bath used in the present invention ranges from 10° C. to 50° C. Though a standard temperature is within the range of 33° C. to 38° C., temperatures higher than this can be adopted to reduce processing time through acceleration of the processing, while those lower than this permit improved image quality and enhanced stability of the processing bath. Moreover, processing utilizing a cobalt or hydrogen peroxide intensification method a described in West German Pat. No. 2,226,770 or U.S. Pat. No. 3,674,499 may be carried out for the purpose of saving silver.

It is desirable that the replenisher in each processing step should be used in a small amount rather than large one. A preferred replenishing amount is 0.1 to 50 times, particularly 3 to 30 times the amount of the processing solution brought from the prebath per unit area of the photographic material to be processed.

For development of a black and white photographic material in the present invention, various known developing agents can be employed. Specifically, polyhydroxybenzenes, such as hydroquinone, 2-chlorohydroquinone, 2-methylhydroquinone, catechol, pyrogallol; aminophenols, such as p-aminophenol, N-methyl-p-aminophenol, 2,4-dimethyl-amino-phenol; 3-pyrazolidones, such as 1-phenyl-3-pyrazolidone, 1-phenyl-4,4'-dimethyl-3-pyrazolidone, 1-phenyl-4-methyl-4-hydroxymethyl-3-pyrazolidone, 5,5-dimethyl-1-phenyl-3-pyrazolidone; and ascorbic acids can be used independently or in a combination of two or more thereof. Also, the developers described in JP-A-No. 58-55928 can be employed.

Specific examples of developers, preservatives, buffers and developing methods which can be employed for a black and white photographic material, and their usages are described in *Research Disclosure,* No. 17643, Item XIX–XXI (December 1978).

The present invention will now be illustrated in greater detail by reference to the following specific examples. However, the invention is not to be construed as being limited to these examples.

Unless otherwise indicated, all parts, percents and ratios are by weight.

EXAMPLE A-1

The following first to fourteenth layers were coated on the surface side of a paper support laminated with a polyethylene film on both sides thereof, and further fifteenth and sixteenth layers described below were coated on the back side of the paper support to prepare a multilayer color photographic light-sensitive material. The polyethylene film laminated on the first layer side contained titanium white as a white pigment and a trace amount of ultramarine blue as a bluish dye.

The ingredients used and their coverages, expressed in terms of g/m$^2$, are described below, and each coverage amount of silver halide is represented on a silver basis. Emulsions used for their respective color-sensitive layers were prepared according to the preparation method of the emulsion EM1. However, the emulsion used for the fourteenth layer was a Lippman emulsion whose grain surface had not been chemically sensitized.

| | |
|---|---|
| First Layer (Antihalation layer) | |
| Black colloidal silver | 0.10 |
| Gelatin | 1.30 |
| Second Layer (Interlayer) | |
| Gelatin | 0.70 |
| Third Layer (Slow red-sensitive layer) | |
| Silver bromide (having an average grain size of 0.3 μm, a variation coefficient of 8% in size distribution, and an octahedral crystal form) sensitized spectrally with red sensitizing dyes (ExS-1, ExS-2 and ExS-3) | 0.06 |
| Silver chlorobromide (having silver chloride content of 5 mol %, an average grain size of 0.45 μm, a variation coefficient of 10% in size distribution, and an octahedral crystal form) sensitized spectrally with red sensitizing dyes (ExS-1, ExS-2 and ExS-3) | 0.10 |
| Gelatin | 1.00 |
| Cyan coupler (ExC-1) | 0.11 |
| Cyan coupler (ExC-2) | 0.10 |
| Discoloration inhibitor (equiweight mixture of Cpd-2, Cpd-3, Cpd-4 and Cpd-13) | 0.12 |
| Coupler dispersion medium (Cpd-5) | 0.03 |
| Coupler solvent (equiweight mixture of Solv-7, Solv-2 and Solv-3) | 0.06 |
| Fourth Layer (High-speed red-sensitive layer) | |
| Silver bromide (having an average grain size of 0.60 μm, a variation coefficient of 15% in size distribution, and an octahedral crystal form) sensitized spectrally with red sensitizing dye (ExS-1, ExS-2 and ExS-3) | 0.14 |
| Gelatin | 1.00 |
| Cyan coupler (ExC-1) | 0.15 |
| Cyan coupler (ExC-2) | 0.15 |
| Discoloration inhibitor (equiweight mixture of Cpd-2, Cpd-3, Cpd-4 and Cpd-13) | 0.15 |
| Coupler dispersion medium (Cpd-5) | 0.03 |
| Coupler solvent (equiweight mixture of Solv-7, Solv-2 and Solv-3) | 0.10 |
| Fifth Layer (Interlayer) | |
| Gelatin | 1.00 |
| Color stain inhibitor (Cpd-7) | 0.08 |
| Color stain inhibitor solvent (equiweight mixture of Solv-4 and Solv-5) | 0.16 |
| Polymer latex (Cpd-8) (solid content: the same hereinafter) | 0.10 |
| Sixth Layer (Slow green-sensitive layer) | |
| Silver bromide (having an average grain size of 0.25 μm, a variation coefficient of 8% in size distribution, and an octahedral crystal form) sensitized spectrally with green sensitizing dye (ExS-3) | 0.04 |
| Silver bromide (having an average grain size of 0.45 μm, a variation coefficient of 11% in size distribution, and an octahedral crystal form) sensitized spectrally with green sensitizing dyes (ExS-3 and ExS-4) | 0.06 |
| Gelatin | 0.80 |
| Magenta coupler (equiweight mixture of ExM-1 and ExM-2) | 0.11 |
| Discoloration inhibitor (Cpd-9) | 0.10 |
| Stain inhibitor (equiweight mixture of Cpd-10 and Cpd-22) | 0.014 |

-continued

| | |
|---|---|
| Stain inhibitor (Cpd-23) | 0.001 |
| Stain inhibitor (Cpd-12) | 0.01 |
| Coupler dispersion medium (Cpd-5) | 0.05 |
| Coupler solvent (equiweight mixture of Solv-4 and Solv-6) | 0.15 |
| Seventh Layer (High-speed green-sensitive layer) | |
| Silver bromide (having an average grain size of 0.8 μm, a variation coefficient of 16% in size distribution, and an octahedral crystal form) sensitized with green sensitizing dyes (ExS-3 and ExS-4) | 0.10 |
| Gelatin | 0.80 |
| Magenta coupler (ExM-1 and ExM-2) | 0.11 |
| Discoloration inhibitor (Cpd-9) | 0.10 |
| Stain inhibitor (equiweight mixture of Cpd-10 and Cpd-22) | 0.013 |
| Stain inhibitor (Cpd-23) | 0.001 |
| Stain inhibitor (Cpd-12) | 0.01 |
| Coupler dispersion medium (Cpd-5) | 0.05 |
| Coupler solvent (equiweight mixture of Solv-4 and Solv-6) | 0.15 |
| Eighth Layer (Interlayer) | |
| The same as the fifth layer | |
| Ninth Layer (Yellow filter layer) | |
| Yellow colloidal silver | 0.20 |
| Gelatin | 1.00 |
| Color stain inhibitor (Cpd-7) | 0.06 |
| Color stain inhibitor solvent (equiweight mixture of Solv-4 and Solv-5) | 0.15 |
| Polymer latex (Cpd-8) | 0.10 |
| Tenth Layer (Interlayer) | |
| The same as the fifth layer | |
| Eleventh Layer (Slow blue-sensitive layer) | |
| Silver bromide (having an average grain size of 0.45 μm, a variation coefficient of 8% in size distribution, and an octahedral crystal form) sensitized spectrally with blue sensitizing dyes (ExS-5 and ExS-6) | 0.07 |
| Silver bromide (having an average grain size of 0.60 μm, a variation coefficient of 14% in size distribution, and an octahedral crystal form) sensitized spectrally with blue sensitizing dyes (ExS-5 and ExS-6) | 0.10 |
| Gelatin | 0.50 |
| Yellow coupler (ExY-1) | 0.22 |
| Stain inhibitor (Cpd-11) | 0.001 |
| Discoloration inhibitor (Cpd-6) | 0.10 |
| Coupler dispersion medium (Cpd-5) | 0.05 |
| Coupler solvent (Solv-2) | 0.05 |
| Twelfth Layer (High-speed blue-sensitive layer) | |
| Silver bromide (having an average grain size of 1.2 μm, a variation coefficient of 21% in size distribution, and an octahedral crystal form) sensitized spectrally with blue sensitizing dyes (ExS-5 and ExS-6) | 0.25 |
| Gelatin | 1.00 |
| Yellow coupler (ExY-1) | 0.41 |
| Stain inhibitor (Cpd-11) | 0.002 |
| Discoloration inhibitor (Cpd-6) | 0.10 |
| Coupler dispersion medium (Cpd-5) | 0.05 |
| Coupler solvent (Solv-2) | 0.10 |
| Thirteenth Layer (Ultraviolet absorbing layer) | |
| Gelatin | 1.50 |
| Ultraviolet absorbent (equiweight mixture of Cpd-1, Cpd-3 and Cpd-13) | 1.00 |
| Stain inhibitor (equiweight mixture of Cpd-6 and Cpd-14) | 0.06 |
| Dispersion medium (Cpd-5) | 0.05 |
| Ultraviolet absorbent solvent (equiweight mixture of Solv-1 and Solv-2) | 0.15 |
| Irradiation preventing dye (equiweight mixture of Cpd-15 and Cpd-16) | 0.02 |
| Irradiation preventing dye (equiweight mixture of Cpd-17 and Cpd-18) | 0.02 |
| Fourteenth Layer (Protective layer) | |
| Fine-grained silver chlorobromide | 0.05 |

-continued

| | |
|---|---|
| (having silver chloride content of 97 mol % and an average grain size of 0.2 μm) | |
| Acryl denatured copolymer of polyvinyl alcohol (denatured degree: 17%) | 0.02 |
| Equiweight mixture of polymethylmethacrylate particles (average particle size: 2.4 microns) and silicon oxide (average grain size: 5 μm) | 0.05 |
| Gelatin | 1.50 |
| Gelatin hardener (H-1) | 0.17 |
| Fifteenth Layer (Backing layer) | |
| Gelatin | 2.50 |
| Sixteenth Layer (Back protecting layer) | |
| Equiweight mixture of polymethylmethacrylate particles (average particle size 2.4 microns) and silicon oxide (average grain size: 5 μm) | 0.05 |
| Gelatin | 2.00 |
| Gelatin Hardener (H-1) | 0.11 |

Preparation of Emulsion EM1:

An aqueous solution of potassium bromide (0.15N) and that of silver nitrate (0.15N) were simultaneously added at 75° C. over a 15-minute period to a 1 wt % aqueous solution of gelatin with vigorous stirring to produce octahedral silver bromide grains having an average grain size of 0.40 μm. The resulting emulsion was chemically sensitized by adding thereto, in sequence, 3,4-di-methyl- 1,3-thiazoline-2-thione, sodium thiosulfate and chloroauric acid (tetrahydrate) in amounts of 0.3 g, 6 mg and 7 mg, respectively, per mole of silver, and then by heating it at 75° C. for 80 minutes. The thus obtained grains were employed as core grains, and thereon silver bromide was further grown under the same circumstances as the first precipitation had been performed, resulting in preparation of an octahedral monodisperse core/shell type silver bromide emulsion having the final average size of 0.7 μm. The variation coefficient of the grain sizes was about 10%. This emulsion was chemically sensitized by adding thereto 1.5 mg/mol Ag of sodium thiosulfate and 1.5 mg/mol Ag of chloroauric acid (tetrahydrate), and then heating it at 60° C. for 60 minutes to prepare an internal latent-image type silver halide emulsion.

In each light-sensitive layer, a nucleating agent set forth in Table 1 was used in the prescribed amount. To each layer were further added alkanol XC (Dupont Co.) and sodium alkylbenzenesulfonate as emulsifying dispersion aid, and succinic acid ester and Magefac F-120 (Dai-Nippon Ink & Chemicals, Inc.) as coating aid. Each silver halide- and colloidal silver-containing layer contained a mixture of Cpd-19, Cpd-20 and Cpd-21 as a stabilizer.

ExS-1

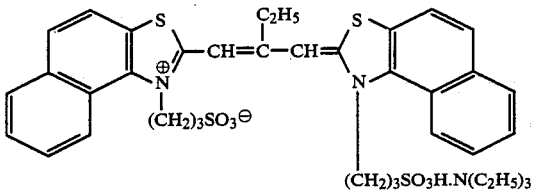

ExS-2

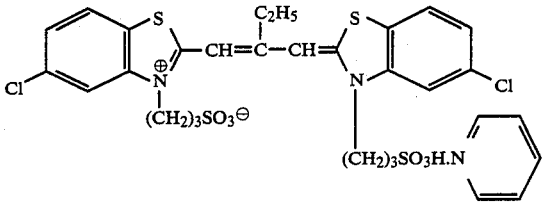

ExS-3

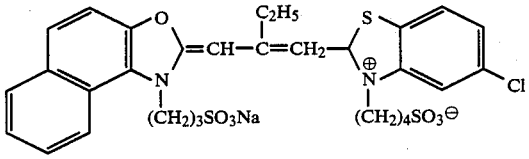

ExS-4

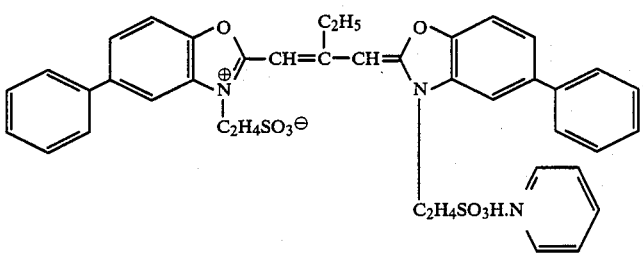

-continued
ExS-5
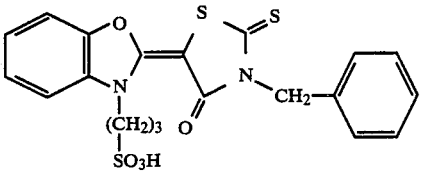
ExS-6
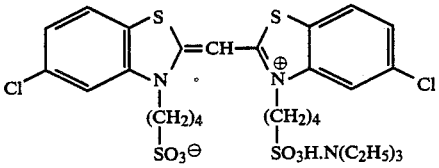
Cpd-1
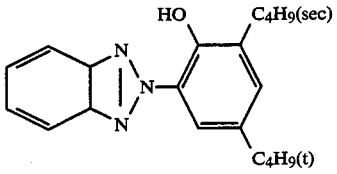
Cpd-2
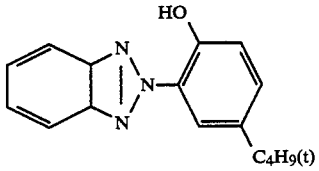
Cpd-3
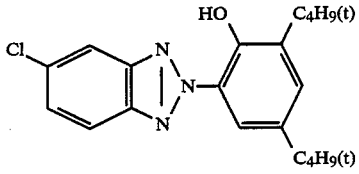
Cpd-4
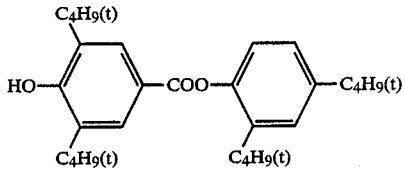
Cpd-5
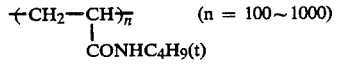
(n = 100~1000)
Cpd-6
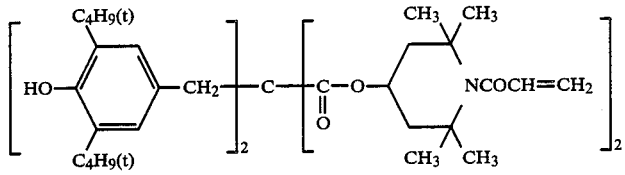
Cpd-7
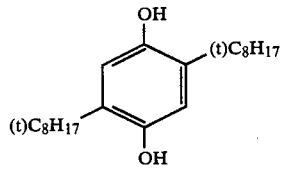
Cpd-8
Polyethylacrylate (particles having 0.02μ diameter)

-continued
Cpd-9
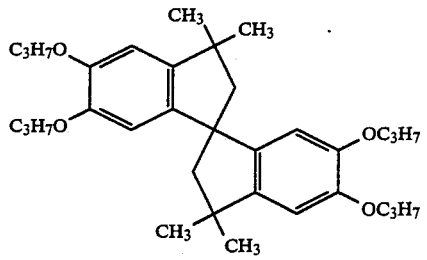
Cpd-10
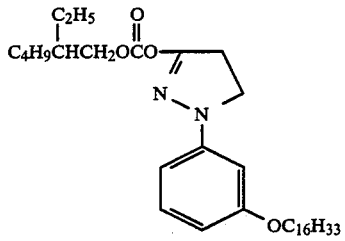
Cpd-11
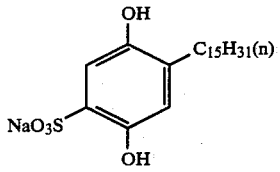
Cpd-12
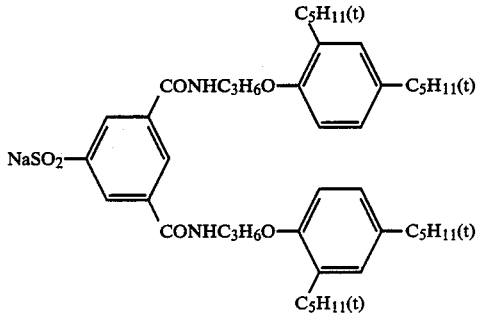
Cpd-13
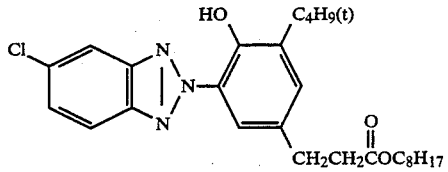
Cpd-14
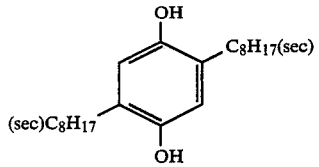
Cpd-15
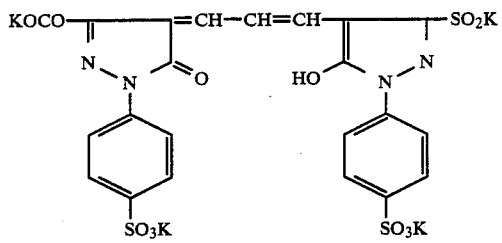

-continued
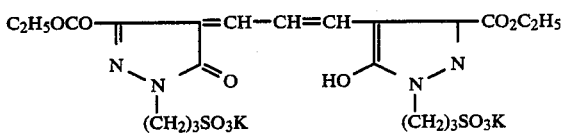
Cpd-16
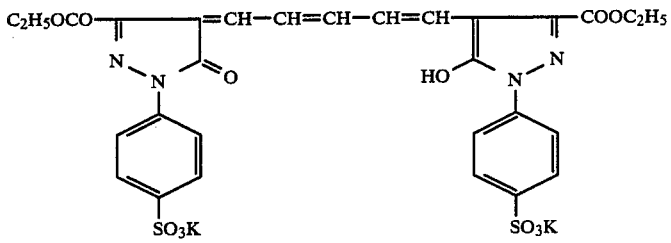
Cpd-17
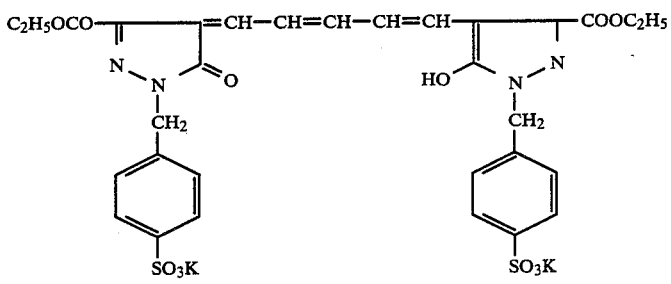
Cpd-18
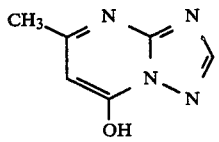
Cpd-19
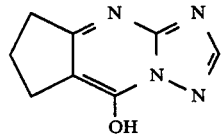
Cpd-20
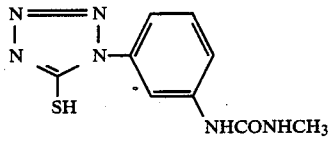
Cpd-21
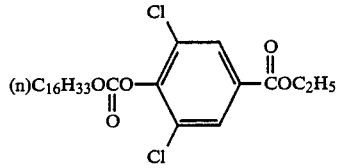
Cpd-22
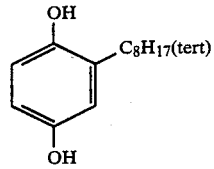
Cpd-23

-continued

EXC-1

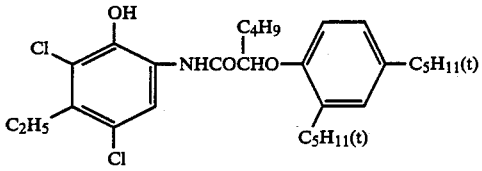

EXC-2

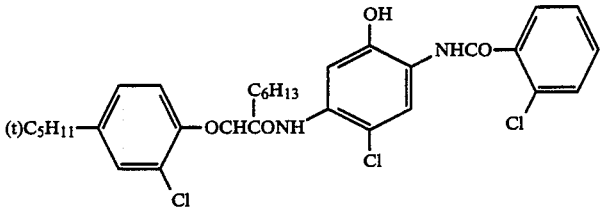

EXM-1

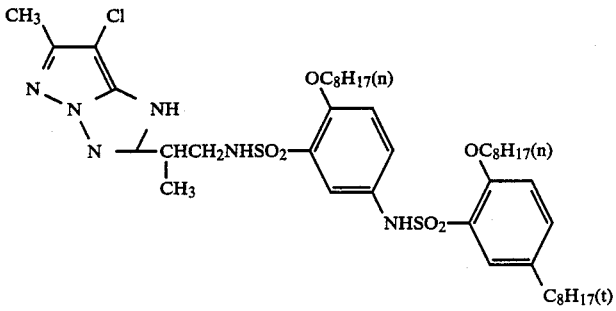

EXM-2

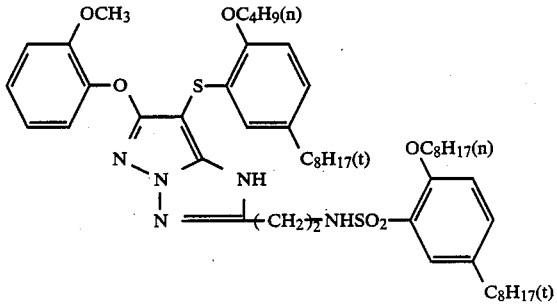

ExY-1

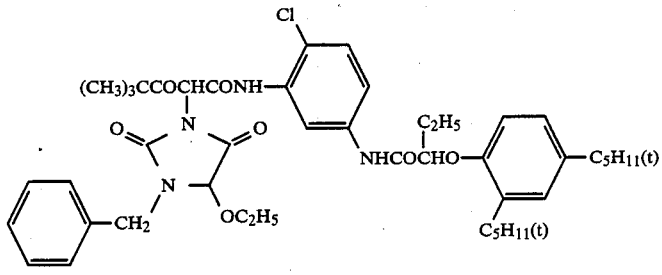

Solv-1 Di(2-ethylhexyl)phthalate
Solv-2 Trinonyl phosphate
Solv-3 Di(3-methylhexyl)phthalate
Solv-4 Tricresyl phosphate
Solv-5 Dibutyl phthalate
Solv-6 Trioctyl phosphate
Solv-7 Di(2-ethylhexyl)sebacate
H-1 1,2-bis(vinylsulfonylacetamido)ethane The thus prepared color photographic paper was wedgewise exposed (3200° K. 0.1 sec., 10 CMS), and then subjected to photographic processing in accordance with the following process $A_1$. Magenta color densities of the developed images (maximum image density: Dmax, and minimum image density: Dmin) were measured. The results obtained are shown in Table 1.

| Process $A_1$ | Time | Temperature | Amount Replenished |
|---|---|---|---|
| Color Development | 90 Sec. | 38° C. | 300 ml/m$^2$ |
| Bleach-Fix | 40 sec. | 35° C. | 300 ml/m$^2$ |
| Washing (1) | 40 sec. | 30–36° C. | |
| Washing (2) | 40 sec. | 30–36 ° C. | |
| Washing (3) | 15 sec. | | 320 ml/m$^2$ |
| Drying | 30 sec. | 75–80° C. | |

The replenishment of washing water was performed by a counter current replenishing process, wherein the washing bath (3) was replenished with washing solution, and the solution overflowing the washing bath (3) was introduced into the washing bath (2), and the solution overflowing the washing bath (2) was introduced into the washing bath (1). Therein, the amount of the processing solution brought by the photographic material from the prebath into the washing bath (1) was 35 ml/m$^2$. Accordingly, the replenishing factor was 9.1.

The composition of the processing solutions used were as follows.

| Color Developer | Solution | Replenisher |
|---|---|---|
| Ethylenediaminetetrakis-methylenephosphonic acid | 0.5 g | 0.5 g |
| Diethylene glycol | 8.0 g | 13.0 g |
| Benzyl alcohol | 12.0 g | 18.5 g |
| Sodium bromide | 0.6 g | — |
| Sodium chloride | 0.5 g | — |
| Sodium sulfite | 2.0 g | 2.5 g |
| N,N-diethylhydroxylamine | 3.5 g | 4.5 g |
| Triethylenediamine(1,4-diazabicyclo[2,2,2]octane) | 3.5 g | 4.5 g |
| 3-Methyl-4-amino-N-ethyl-N-(β-methanesulfonamidoethyl)aniline sulfate | 5.5 g | 8.0 g |
| Potassium carbonate | 30.0 g | 30.0 g |
| Brightening agent (stilbene type) | 1.0 g | 1.3 g |
| Purified water to make | 1,000 ml | 1,000 ml |
| pH | 11.30 | 10.90 |

The pH adjustment was carried out using potassium hydroxide or hydrochloric acid.

| Bleach-fix Bath | Solution = Replenisher |
|---|---|
| Ammonium thiosulfate | 100 g |
| Sodium hydrogen sulfite | 21.0 g |
| Ammonium ethylenediaminetetraacetatoferrate(III) dihydrate | 50.0 g |
| Disodium ethylenediaminetetraacetate dihydrate | 5.0 g |
| Purified water to make | 1,000 ml |
| pH | 6.3 |

The pH adjustment was carried out using aqueous ammonia or hydrochloric acid.

Washing Water

Purified water was used. The term purified water as used herein refers to water obtained by performing an ion exchange treatment for removing all cations other than $H^+$ and all anions other than $OH^-$ from city water until every ion concentration was reduced to 1 ppm or less.

The purified water was also used for preparation of processing solutions and replenishers.

TABLE 1

| Sample No. | Nucleating Agent Compound Example | Amount Added*2 | Dmax | Dmin |
|---|---|---|---|---|
| 1 | N-I-1 | $6.7 \times 10^{-6}$ | 2.3 | 0.11 |
| 2 | N-I-4 | $7.5 \times 10^{-6}$ | 2.3 | 0.11 |
| 3 | N-I-8 | $1.8 \times 10^{-6}$ | 2.3 | 0.10 |
| 4 | N-I-10 | $1.8 \times 10^{-6}$ | 2.4 | 0.10 |
| 5 | N-I-11 | $1.6 \times 10^{-6}$ | 2.4 | 0.10 |
| 6 | N-I-12 | $1.7 \times 10^{-6}$ | 2.4 | 0.10 |
| 7 | N-I-14 | $2.5 \times 10^{-6}$ | 2.4 | 0.10 |
| 8 | N-I-17 | $2.5 \times 10^{-6}$ | 2.4 | 0.10 |
| 9 | N-I-21 | $2.5 \times 10^{-6}$ | 2.4 | 0.10 |
| 10 | N-I-24 | $2.5 \times 10^{-6}$ | 2.4 | 0.10 |
| 11 | N-I-23 | $2.3 \times 10^{-6}$ | 2.4 | 0.10 |
| 12 | Compound A*1 | $7.5 \times 10^{-6}$ | 2.4 | 0.17 |

TABLE 1-continued

| Sample No. | Nucleating Agent Compound Example | Amount Added*2 | Dmax | Dmin |
|---|---|---|---|---|
| 13 | " | $1.6 \times 10^{-6}$ | 1.8 | 0.13 |

*1Compound A

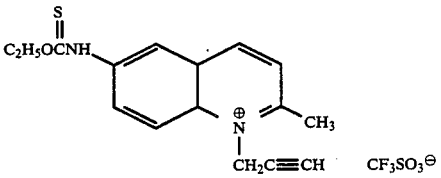

*2Amount expressed in terms of mole/mole Ag.

The samples No. 1 to No. 11, in which the nucleating agents of the present invention were used respectively, showed lower Dmin than the sample No. 12 for comparison, and higher Dmax and lower Dmin than the sample No. 13 for comparison.

Similar results were obtained with respect to densities of developed cyan and yellow-color images.

EXAMPLE A-2

The same samples as prepared in Example A-1, from No. 1 to No. 13, were employed, and each was exposed so that the development rate (developed Ag amount/coated Ag amount) was 60%. The photographic processing of each sample was performed in accordance with the following process B using an automatic developing machine equipped with a 8-liter color developing tank, a 4-liter bleach-fix bath and two 4-liter washing tanks (1) and (2) until the processed area became 20 m$^2$. After the above-described running processing, the samples No. 1 to No. 13 were each exposed in the same manner as in Example A-1, and subjected to the photographic processing in accordance with the following process $B_1$. Then, densities of the developed cyan color images were measured. The results obtained are shown in Table 2.

| Process $B_1$ | Time | Temperature | Amount Replenished |
|---|---|---|---|
| Color Development | 70 Sec. | 38° C. | 260 ml/m$^2$ |
| Bleach-Fix | 30 sec. | 38° C. | 260 ml/m$^2$ |
| Washing (1) | 30 sec. | 38° C. | |
| Washing (2) | 30 sec. | 38° C. | 300 ml/m$^2$ |

Therein, a replenishing factor of the washing solution was 8.6.

| Color Developer | Solution | Replenisher |
|---|---|---|
| Diethylenetriaminepentaacetic acid | 0.5 g | 0.05 g |
| 1-Hydroxyethylidene-1,1-diphosphonic acid | 0.5 g | 0.5 g |
| Diethylene glycol | 8.0 g | 10.7 g |
| Benzyl alcohol | 9.0 g | 12.0 g |
| Sodium bromide | 0.7 g | — |
| Sodium chloride | 0.5 g | — |
| Sodium sulfite | 2.0 g | 2.4 g |
| Hydroxylamine sulfate | 2.8 g | 3.5 g |
| 3-Methyl-4-amino-N-ethyl-N-(β-methanesulfonamidoethyl)aniline sulfate | 2.0 g | 2.5 g |
| Potassium carbonate | 30.0 g | 30.0 g |
| 3-Methyl-4-amino-N-ethyl-N-(β-hydroxyethyl)aniline sulfate | 4.0 g | 4.5 g |

-continued

| Color Developer | Solution | Replenisher |
|---|---|---|
| pH | 10.50 | 10.90 |

The pH adjustment was carried out using potassium hydroxide or hydrochloric acid.

| Bleach-fix Bath | Solution | Replenisher |
|---|---|---|
| Ammonium thiosulfate | 77 g | 100 g |
| Sodium hydrogen sulfite | 14.0 g | 21.0 g |
| Ammonium ethylenediaminetetra-acetatoferrate(III) dihydrate | 40.0 g | 53.0 g |
| Disodium ethylenediaminetetra-acetate dihydrate | 4.0 g | 5.0 g |
| 2-Mercapto-1,3,4-triazole | 0.5 g | 0.5 g |
| Purified water to make | 1,000 ml | 1,000 ml |
| pH | 7.0 | 6.5 |

The pH adjustment was carried out using aqueous ammonia or hydrochloric acid.

Washing Water

Purified water was used as washing water. It was also used in the preparation of the processing solutions and replenishers.

TABLE 2

| Sample No. | Dmax | Dmin |
|---|---|---|
| 1 | 2.3 | 0.11 |
| 2 | 2.3 | 0.11 |
| 3 | 2.4 | 0.10 |
| 4 | 2.4 | 0.10 |
| 5 | 2.4 | 0.10 |
| 6 | 2.4 | 0.10 |
| 7 | 2.4 | 0.10 |
| 8 | 2.4 | 0.10 |
| 9 | 2.4 | 0.10 |
| 10 | 2.4 | 0.10 |
| 11 | 2.4 | 0.10 |
| 12 | 2.3 | 0.14 |
| 13 | 1.6 | 0.12 |

Even when processed with the processing solutions which had been used for the running processing, the samples of the present invention, from No. 1 to No. 11 showed lower Dmin than the comparative sample No. 12, and higher Dmax and lower Dmin than the comparative sample 13. That is, the samples of the invention achieved superior results.

Similar results were accomplished with respect to densities of developed magenta and cyan-color images.

EXAMPLE A-3

The same experiments as in Example A-2, except that the pH of the color developer was altered to 11.2 and the development time was changed to 45 sec., were performed, and similar results were achieved.

EXAMPLE A-4

Color photographic paper was prepared in the same manner as in Example A-1, except that the magenta coupler illustrated below was used in the place of the magenta couplers ExM-1 and ExM-2 and the emulsion EM 2-A described below was used in the place of the emulsion EM1. Furthermore, the sample No. 14 contained no nucleating agent.

These samples were kept for 3 days in the atmosphere of 45° C., 80% RH (for incubation). Thereafter, they were exposed in the same manner as in Example A-1, and then subjected to the photographic processing in accordance with Process $C_1$. Densities of the developed magenta color images were measured. The results obtained are shown in Table 3.

Magenta Coupler

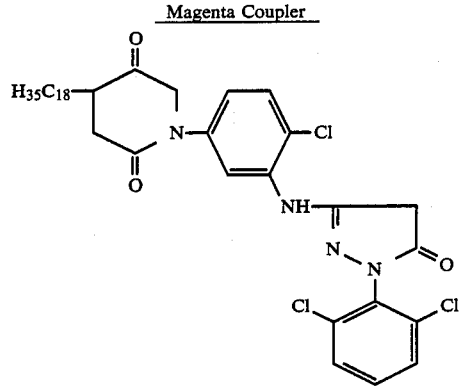

Preparation of Emulsion EM2-A

An aqueous solution of a potassium bromide (0.15N)-sodium chloride (0.15N) mixture and an aqueous solution of silver nitrate (0.15N) were simultaneously added at 65° C. with vigorous stirring over a period of about 21 minutes to a 1 wt % aqueous solution of gelatin containing 3,4-dimethyl-1,3-thiazoline-2-thione in an amount of 0.07 g per mole of silver to produce a monodisperse silver chlorobromide emulsion (silverbromide content: 30 mol %) having an average grain size of about 0.23 μm. The resulting emulsion was chemically sensitized by adding thereto sodium thiosulfate and chloroauric acid (tetrahydrate) in amounts of 45 mg and 42 mg, respectively, per mole of silver, and then by heating at 65° C. for 60 minutes. The thus obtained silver chlorobromide grains were employed as core grains and thereon silver chlorobromide was further grown under the same circumstances as the first precipitation, resulting in production of a monodisperse core/-shell type silver chlorobromide emulsion (silver bromide content: 20 mol %) having the final average size of 0.58 μm. The variation coefficient of the grain sizes was about 15%. This emulsion was chemically sensitized by adding thereto 1.5 mg/mol Ag of sodium thiosulfate and 0.8 mg/mol Ag of chloroauric acid (tetrahydrate), and then heating it at 60° C. for 60 minutes to prepare an internal latent-image type silver halide emulsion EM2-A.

| Process $C_1$ | Time | Temperature | Amount Replenished |
|---|---|---|---|
| Color Development*(1) | 90 sec. | 36° C. | 320 ml/m$^2$ |
| Bleach-Fix | 40 sec. | 36° C. | 320 ml/m$^2$ |
| Stabilization (1) | 40 sec. | 36° C. | |
| Stabilization (2) | 40 sec. | 36° C. | 320 ml/m$^2$ |
| Drying | 40 sec. | 70° C. | |

*(1)After being dipped in a color developer for 15 seconds, the sample was optically fogged by a 15-second exposure to white light of 1 lux while being subjected to color development.

| Color Developer | Solution | Replenisher |
|---|---|---|
| Hydroxyethyliminodi-acetic acid | 0.5 g | 0.5 g |
| β-Cyclodextrin | 1.5 g | 1.5 g |
| Monoethylene glycol | 9.0 g | 10.0 g |
| Benzyl alcohol | 9.0 g | 10.0 g |
| Monoethanolamine | 2.5 g | 2.5 g |
| Sodium bromide | 2.3 g | 1.5 g |

-continued

| Color Developer | Solution | Replenisher |
|---|---|---|
| Sodium chloride | 5.5 g | 4.0 g |
| N,N-diethylhydroxylamine | 5.9 g | 6.5 g |
| 3-Methyl-4-amino-N-ethyl-N-(β-methanesulfonamido-ethyl)aniline sulfate | 2.7 g | 3.0 g |
| 3-Methyl-4-amino-N-ethyl N-(β-hydroxyethyl)aniline sulfate | 4.5 g | 5.0 g |
| Potassium carbonate | 30.0 g | 35.0 g |
| Brightening agent (stilbene type) | 1.0 g | 1.2 g |
| Purified water to make | 1,000 ml | 1,000 ml |
| pH | 10.00 | 10.70 |

The pH adjustment was carried out using potassium hydroxide or hydrochloride acid.

| Bleach-fix Bath | Solution = Replenisher |
|---|---|
| Ammonium thiosulfate | 110 g |
| Sodium hydrogen sulfite | 12 g |
| Ammonium diethylenetriamine pentaacetatoferrate (III) | 80 g |
| Diethylenetriaminepenta-acetic acid | 5 g |
| 2-Mercapto-5-amino-1,3,4-thiadiazole | 0.3 g |
| Purified water to make | 1,000 ml |
| pH | 6.80 |

The pH adjustment was carried out using aqueous ammonia or hydrochloric acid.

| Stabilizing Bath | Solution = Replenisher |
|---|---|
| 1-Hydroxyethylidene-1,1-diphosphonic acid | 2.7 g |
| o-Phenylphenol | 0.2 g |
| Potassium chloride | 2.5 g |
| Bismuth chloride | 1.0 g |
| Zinc chloride | 0.25 g |
| Sodium sulfite | 0.3 g |
| Ammonium sulfate | 4.5 g |
| Brightening agent (stilbene type) | 0.5 g |
| Purified water to make | 1,000 ml |
| pH | 7.2 |

The pH adjustment was carried out using potassium hydroxide or hydrochloric acid.

TABLE 3

| Sample | Before Incubation | | After Incubation | | |
|---|---|---|---|---|---|
| No. | Dmax | Dmin | Dmax | Dmin | Note |
| 1 | 2.3 | 0.11 | 2.2 | 0.11 | Invention |
| 2 | 2.3 | 0.11 | 2.2 | 0.11 | " |
| 3 | 2.3 | 0.11 | 2.2 | 0.11 | " |
| 4 | 2.3 | 0.11 | 2.2 | 0.11 | " |
| 5 | 2.3 | 0.11 | 2.2 | 0.11 | " |
| 6 | 2.4 | 0.11 | 2.3 | 0.11 | " |
| 7 | 2.4 | 0.11 | 2.3 | 0.11 | " |
| 8 | 2.3 | 0.11 | 2.2 | 0.11 | " |
| 9 | 2.3 | 0.11 | 2.2 | 0.11 | " |
| 10 | 2.3 | 0.11 | 2.2 | 0.11 | " |
| 11 | 2.3 | 0.11 | 2.2 | 0.11 | " |
| 12 | 2.4 | 0.14 | 2.0 | 0.15 | Comparison |
| 13 | 1.9 | 0.12 | 1.6 | 0.12 | " |
| 14 | 1.2 | 0.11 | 0.6 | 0.11 | " |

The samples containing the nucleating agents of the present invention, from No. 1 to No. 11, showed lower Dmin than Sample No. 12, higher Dmax and lower Dmin than Sample No. 13, and higher Dmax than Sample No. 14, that is, accomplished superior results.

Similar results were obtained as to densities of developed cyan and yellow-color images.

EXAMPLE A-5

Preparation of Emulsion X

An aqueous solution of silver nitrate ($\frac{1}{8}$ mol) and an aqueous solution of potassium bromide ($\frac{1}{8}$ mol) were simultaneously added over a 5-minute period with vigorous stirring to a 75° C., 1% aqueous gelatin solution (pH: 5.5) containing 20 mg/l of thioether (1,8-dihydroxy-3,6-dithiaoctane) at a constant rate keeping the silver electrode potential constant to produce a monodisperse, sphere silver bromide emulsion having an average grain size of about 0.14 μm. The resulting emulsion was chemically sensitized by adding thereto 20 mg/mol Ag of sodium thiosulfate and 20 mg/mol Ag of chloroauric acid (tetrahydrate), adjusting the pH of the resulting emulsion to 7.5, and then heating at 75° C. for 80 minutes with thoroughly stirring. The thus obtained silver bromide grains were employed as core grains, and a shell was grown thereon at the same temperature by simultaneously adding an aqueous solution containing $\frac{7}{8}$ mole of silver nitrate and an aqueous solution of potassium bromide over a 40-minute period with thorough stirring as the silver electrode potential was kept at such a value to render the grown grains regular octahedral, resulting in production of a monodisperse core/shell type octahedral silver bromide emulsion having an average size of about 0.3 μm. After this emulsion was adjusted to pH 6.5, the shell surface was chemically sensitized by adding 5 mg/mol Ag of sodium thiosulfate and 5 mg/mol Ag of chloroauric acid (tetrahydrate), and then ripening at 75° C. for 60 minutes to finally prepare an internal latent-image type monodisperse octahedral core/shell emulsion (Emulsion X). As a result of determination of a grain size distribution of this emulsion by electron microphotography, the average grain size was 0.30 μm, and the variation coefficient (the value obtained by dividing the statistical standard deviation by the foregoing average grain size, shown as a percentage) was 10%.

After 5 mg/mol Ag of 3,3'-diethyl-9-methylthiacarbocyanine was added to the emulsion X as a panchromatic sensitizing dye, the resulting emulsion was divided into 5 fractions, and thereto were added the nucleating agents set forth in the following table, respectively. The thus obtained emulsion fractions were coated on polyethylene terephthalate supports, respectively, at a silver coverage of 2.8 g/m$^2$. In coating the emulsion, a protective layer constituted with gelatin and a hardener was provided simultaneously. Thus, the samples No. 1 to No. 5, of a direct-positive photographic material which is also sensitive to red light, were prepared.

The foregoing samples were exposed for 0.1 second using a sensitometer equipped with a 1 KW tungsten lamp (color temperature: 2854° K.) through a step-wedge. Then, they were developed at 38° C. for 18 sec. with a developer (pH: 10.7), Kodak Proster Plus developer, in an automatic developing machine (Kodak Proster I Processor). Subsequently, washing with water, fixation, washing with water and drying steps were successively performed in the above-described automatic developing machine. The thus processed samples were each examined for maximum density (Dmax) and minimum density (Dmin) of the direct positive image obtained and the results are shown in Table 4.

TABLE 4

| Sample No. | Nucleating Agent Compound Example | Amount Added | Dmax | Dmin |
|---|---|---|---|---|
| 1 | N-I-23 | $6.5 \times 10^{-6}$ | 2.45 | 0.06 |
| 2 | N-I-21 | " | 2.42 | 0.06 |
| 3 | N-I-24 | " | 2.45 | 0.06 |
| 4 | N-I-14 | " | 2.43 | 0.06 |
| 5 | Compound A | " | 2.15 | 0.07 |

*: mol/mol Ag

The samples containing the nucleating agents of the present invention, from No. 1 to No. 4 were preferred because of their high Dmax and low Dmin, compared with the comparative sample No. 5.

In accordance with the method of the present invention, a direct positive image having a high maximum density and a low minimum density was obtained. A high image quality as described above was achieved in satisfactory condition even after running processing, or even when a photographic material which had been stored under a high temperature and humidity condition was used.

Therefore, the method of the present invention is well suited for practical use.

EXAMPLE B-1

The same tests were conducted as in Example A-1 except the followings;

(i) The magenta coupler in the 6yth and 7th layers were replaced with each of those shown in Table 5.

(ii) Emulsion EM1-B was used instead of EM1-A.

Preparation of Emulsion EM1-B:

An aqueous solution of potassium bromide (0.15N) and that of silver nitrate (0.15N) were simultaneously added at 75° C. over a 12-minute period to a 1 wt % aqueous solution of gelatin with vigorous stirring to produce octahedral silver bromide grains having an average grain size of 0.32 μm. The resulting emulsion was chemically sensitized by adding thereto, in sequence, 3,4-di-methyl- 1,3-thiazoline-2-thione, sodium thiosulfate and chloroauric acid (tetrahydrate) in amounts of 0.2 g, 4.5 mg and 7 mg, respectively, per mole of silver, and then by heating it at 75° C. for 80 minutes. The thus obtained grains were employed as core grains, and thereon silver bromide was further grown under the same circumstances as the first precipitation had been performed, resulting in preparation of an octahedral monodisperse core/shell type silver bromide emulsion having the final average size of 0.7 μm. The variation coefficient of the grain sizes was about 10%. This emulsion was chemically sensitized by adding thereto 1.5 mg/mol Ag of sodium thiosulfate and 1.5 mg/mol Ag of chloroauric acid (tetrahydrate), and then heating it at 60° C. for 45 minutes to prepare an internal latent-image type silver halide emulsion.

(iii) In each light-sensitive layer, a nucleating agent set forth in Table 5 was used, and further Cpd-24 shown below was used as a nucleation accelarator in an amount of $1 \times 10^{-2}$ weight % based on the amount of silver halide.

Cpd-24

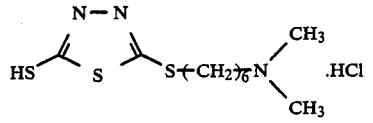

(iv) Instead of H-1 an equimolar mixture of 1,2-bis(-vinylsulfonylaceta-mido)ethane and 2,4,6-trichloro-1,3,5-triazine was used.

Sample 9 was imagewise exposed (0.1 sec., 3,200° K., a halogen lamp, 10 CMS), and then subjected to a running processing, which included the following steps, with an automatic developing machine. The running processing was continued till the accumulated amount of the replenisher for the color developer became three times the tank volume.

| Processing Step | Processing $A_2$ Time | Temperature | Tank Volume | Amount Replenished |
|---|---|---|---|---|
| Color Development | 90 sec. | 38° C. | 8 liter | 300 ml/m² |
| Bleach-Fix | 40 sec. | 33° C. | 3 liter | 300 ml/m² |
| Washing (1) | 40 sec. | 33° C. | 3 liter | — |
| Washing (2) | 40 sec. | 33° C. | 3 liter | — |
| Washing (3) | 15 sec. | 33° C. | 0.5 liter | 320 ml/m² |
| Drying | 30 sec. | 80° C. | | |

The replenishment of washing water was performed in the same manner as in Example A-1. Therein, the amount of the bleach-fixing solution brought by the photographic material from the bleach-fix bath into the washing bath (1) was 35 ml/m². Accordingly, the replenishing factor (the amount of the replenishing water to the amount of bleach-fixing solution brought from the bath) was 9.1.

The composition of the processing solutions used were as follows.

| | Solution | Replenisher |
|---|---|---|
| Color Developer | | |
| Ethylenediaminetetrakis-methylenephosphonic acid | 0.5 g | 0.5 g |
| Diethylene glycol | 10 ml | 10 ml |
| Benzyl alcohol | 12 ml | 14.4 ml |
| Potassium bromide | 0.65 g | — |
| Sodium Sulfite | 2.4 g | 2.9 g |
| N,N-diethylhydroxylamine | 4.0 g | 4.8 g |
| Triethylenediamine(1,4-diazabicyclo[2,2,2]octane) | 4.0 g | 4.8 g |
| N-Ethyl-N-(β-methanesulfonamidoethyl)-3-methylaniline sulfate | 5.6 g | 6.6 g |
| Potassium carbonate | 27.0 g | 25.0 g |
| Brightening agent (diaminostilbene type) | 1.0 g | 1.2 g |
| Water to make | 1,000 ml | 1,000 ml |
| pH (at 25° C.) | 10.50 | 10.80 |
| Bleach-fix Bath | Solution = Replenisher | |
| Disodium ethylenediaminetetraacetate dihydrate | 4.0 g | |
| Ammonium ethylenediaminetetraacetatoferrate(III) dihydrate | 46.0 g | |
| Ammonium thiosulfate (700 g/l) | 155 ml | |
| Sodium p-toluenesulfinate | 20.0 g | |
| Sodium hydrogen sulfite | 12.0 g | |
| Ammonium bromide | 50.0 g | |
| Ammonium nitrate | 30.0 g | |
| Water to make | 1,000 ml | |
| pH (at 25° C.) | 6.20 | |

Washing Water

Washing water was obtained by treating city water by passing it through a column of mixed-bed system packed with a strongly acidic H-type cation exchange resin (Amberlite IR-120B, produced by Rohm & Haas Co.) and a OH-type anion exchange resin (Amberlite IR-400, produced by Rohm & Haas, Co.) till calcium and magnesium ion concentrations were each reduced to 3 mg/l or less, and then adding thereto 20 mg/l of sodium dichloroisocyanurate and 1.5 g/l of sodium sulfate. The pH of the resulting water was within the range of 6.5 to 7.5.

The same water was used for the processing solutions and replenisher.

After the above-described running processing, the Samples 1 to 17 were successively processed, and the densities of the developed magenta color images were measured. The results obtained are shown in Table 5.

TABLE 5

| No. | Magenta Coupler*1 | Nucleating Agent*2 | Dmax | Dmin | Note |
|---|---|---|---|---|---|
| 1 | II-4 | N-1-8 | 2.4 | 0.10 | Invention |
| 2 | " | N-1-9 | 2.5 | 0.10 | " |
| 3 | " | N-1-11 | 2.4 | 0.10 | " |
| 4 | " | N-1-12 | 2.4 | 0.10 | " |
| 5 | " | N-1-25 | 2.4 | 0.10 | " |
| 6 | " | N-1-18 | 2.5 | 0.10 | " |
| 7 | " | N-1-23 | 2.5 | 0.10 | " |
| 8 | " | N-B | 2.0 | 0.11 | Comparison |
| 9 | II-33 | N-1-14 | 2.4 | 0.10 | Invention |
| 10 | " | N-1-17 | 2.4 | 0.10 | " |
| 11 | " | N-1-19 | 2.4 | 0.10 | " |
| 12 | " | N-1-20 | 2.5 | 0.10 | " |
| 13 | " | N-1-21 | 2.5 | 0.10 | " |
| 14 | " | N-1-22 | 2.4 | 0.10 | " |
| 15 | " | N-1-23 | 2.4 | 0.10 | " |
| 16 | " | N-B | 1.9 | 0.11 | Comparison |
| 17 | N-A | N-B | 2.4 | 0.13 | " |

*1 Amount added: $1.25 \times 10^{-4}$ mol/m$^2$
*2 Amount added: $4.5 \times 10^{-6}$ mol/mol Ag.

Magenta Coupler (N-A)

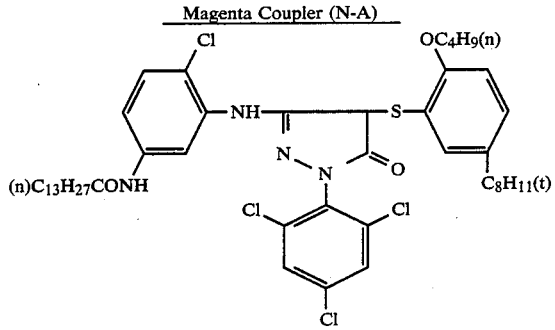

Nucleating Agent (N-B)

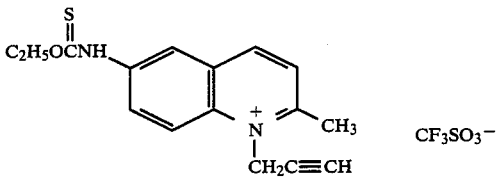

The samples of the present invention, from No. 1 to No. 7 and from No. 9 to No. 15, were advantageous in that they had higher Dmax than the comparative samples No. 8 and No. 16, and higher saturation with respect to reddish colors than the comparative sample No. 17.

EXAMPLE B-2

The same experiment as in Example B-1, except the emulsion EM2-B and the emulsion differing therefrom in grain size were used. Results similar to those of Example B-1 were obtained.

EXAMPLE B-3

The same experiment as in Example B-2, except the processing $B_2$ was employed instead of the processing $A_2$, was carried out to obtain the results similar to those of Example B-2.

Preparation of Emulsion EM2-B:

An aqueous solution of a potassium bromide(0.15N)-sodium chloride (0.15N) mixture and an aqueous solution of silver nitrate (0.15N) were simultaneously added at 65° C. with vigorous stirring over a period of about 7 minutes to a 1 wt % aqueous solution of gelatin containing 3,4-dimethyl-1,3-thiazoline-2-thione in an amount of 0.07 g per mole of silver to produce a monodisperse silver chlorobromide emulsion (silver bromide content: 40 mol %) having an average grain size of about 0.23 μm. The resulting emulsion was chemically sensitized by adding thereto 70 mg/mol Ag of sodium thiosulfate and 70 mg/mol Ag of chloroauric acid (tetrahydrate), and then by heating at 65° C. for 25 minutes. The thus obtained silver chlorobromide grains were employed as core grains, and thereon silver chlorobromide was further grown under the same circumstances as the first precipitation had been performed, resulting in production of a monodisperse core/shell type silver chlorobromide emulsion (silver bromide content: 40 mol %) having the final average size of 0.65 μm. A variation coefficient of the grain sizes was about 15%. This emulsion was chemically sensitized by adding thereto 1.5 mg/mol Ag of sodium thiosulfate and 1.5 mg/mol Ag of chloroauric acid (tetrahydrate), and then heating it at 60° C. for 60 minutes to prepare an internally latent image type silver halide emulsion EM2-B.

| Processing $B_2$ | Time | Temperature |
|---|---|---|
| Color Development | 85 sec. | 36° C. |
| Bleach-Fix | 40 sec. | 36° C. |
| Stabilization (1) | 40 sec. | 36° C. |
| Stabilization (2) | 40 sec. | 36° C. |
| Drying | 40 sec. | 70° C. |

| Color Developer | |
|---|---|
| Hydroxyethyliminodiacetic acid | 0.5 g |
| β-Cyclodextrin | 1.5 g |
| Monoethylene glycol | 9.0 g |
| Benzyl alcohol | 9.0 g |
| Monoethanolamine | 2.5 g |
| Sodium bromide | 2.3 g |
| Sodium chloride | 5.5 g |
| N,N-diethylhydroxylamine | 5.9 g |
| 3-Methyl-4-amino-N-ethyl-N-(β-methanesulfonamidoethyl)aniline sulfate | 2.72 g |
| 3-Methyl-4-amino-N-ethyl N-(β-hydroxyethyl)aniline sulfate | 4.5 g |
| Potassium carbonate | 30.0 g |
| Brightening agent (stilbene type) | 1.0 g |
| Purified water to make | 1,000 ml |
| pH | 10.30 |

The pH adjustment was carried out using potassium hydroxide or hydrochloric acid.

| | |
|---|---|
| Bleach-fix Bath | |
| Ammonium thiosulfate | 110 g |
| Sodium hydrogen sulfite | 12 g |
| Ammonium diethylenetriamine pentaacetatoferrate(III) | 80 g |
| Diethylenetriaminepentaacetic acid | 5 g |
| 2-Mercapto-5-amino-1,3,4-thiadiazole | 0.3 g |
| Purified water to make | 1,000 ml |
| pH | 6.80 |
| Stabilizing Bath | |
| 1-Hydroxyethylidene-1,1-diphosphonic acid | 2.7 g |
| o-Phenylphenol | 0.2 g |
| Potassium chloride | 2.5 g |
| Bismuth Chloride | 1.0 g |
| Zinc chloride | 0.25 g |
| Sodium sulfite | 0.3 g |
| Ammonium sulfate | 4.5 g |
| Brightening agent (stilbene type) | 0.5 g |
| Purified water to make | 1,000 ml |
| pH | 7.2 |

The pH adjustment was carried out using potassium hydroxide or hydrochloric acid.

EXAMPLE B-4

The same experiments as in Example B-1, except the magenta couplers I-2, I-6, I-22, I-31 and I-32, respectively, were used in the place of the magenta coupler I-4, were performed to achieve the results similar to those of Example B-1.

As can be seen in Examples B-1 to B-4 it is evident that in accordance with the present invention, direct positive color photographic materials which can produce images having low minimum density, high maximum density and excellent color reproducibility can be obtained. Moreover, images of the above-described high quality can be obtained by short-time development. Therefore, the invention is of great practical use.

EXAMPLE C-1

The same tests were conducted as in Example A-1 except the followings:

(i) The yellow coupler ExY-1 in each Eleventh Layer and Twelfth Layer was used in an amount of 0.20 g/m$^2$ and 0.38 g/m$^2$, respectively.

(ii) Emulsion EM1-C was used instead of emulsion EM1-A.

Preparation of Emulsion EM1-C:

An aqueous solution of potassium bromide (0.15N) and that of silver nitrate (0.15N) were simultaneously added at 75° C. over a 15-minute period to a 1 wt % aqueous solution of gelatin with vigorous stirring to produce octahedral silver bromide grains having an average grain size of 0.40 μm. The resulting emulsion was chemically sensitized by adding thereto, in sequence, 3,4-di-methyl-1,3-thiazoline-2-thione, sodium thiosulfate and chloroauric acid (tetrahydrate) in amounts of 0.1 g, 4 mg and 7 mg, respectively, per mole of silver, and then by heating it at 75° C. for 25 minutes. The thus obtained grains were employed as core grains, and thereon silver bromide was further grown under the same circumstances as the first precipitation had been performed, resulting in preparation of an octahedral monodisperse core/shell type silver bromide emulsion having the final average size of 0.53 μm. The variation coefficient of the grain sizes was about 10%. This emulsion was chemically sensitized by adding thereto 1.5 mg/mol Ag of sodium thiosulfate and 1.0 mg/mol Ag of chloroauric acid (tetrahydrate), and then heating it at 60° C. for 45 minutes to prepare an internal latent-image type silver halide emulsion.

(iii) To each light-sensitive layer ExZK-1 was added in an amount of $2.0\times10^{-5}$ mol per mol of silver halide as a nucleating agent and Cpd-24 was added in an amount of $4.5\times10^{-4}$ mol per mol of silver halide as a nucleation accelator.

ExZK-1

1-Formyl-2-{4-[3-{3-[3-(5-mercaptotetrazole-1-yl)phenyl]ureido}benzenesulfonamido]phenyl}hydrazine.

Then, samples 102 to 108, in which the yellow coupler incorporated in the eleventh and the twelfth layers, and the nucleating agent incorporated in each emulsion layer were changed to those set forth in Table 6, respectively, were prepared.

TABLE 6

| Sample No. | Yellow Coupler *1 | Nucleating Agent *2 |
|---|---|---|
| 101 | ExY-1 | ExZK-1 |
| 102 | Y-35 | ExZK-1 |
| 103 | " | N-I-23 |
| 104 | " | N-I-8 |
| 105 | Y-22 | N-I-18 |
| 106 | Y-39 | N-I-24 |
| 107 | Y-1 | N-I-25 |
| 108 | Y-37 | N-I-16 |

1*: The amounts of yellow couplers incorporated in the samples 102 to 108, respectively, were the same by mole as that of ExY-1 in the sample 101.
2*: In the samples 103 to 108, the amount of the nucleating agent incorporated in each emulsion layer was $2.0\times10^{-6}$ mole per mole of silver halide.

Each of the thus obtained samples was wedgewise exposed (3200° K, 1/10 sec, 10 CMS), subjected to the following processing $A_3$, and then examined for densities of the developed yellow color images. The results obtained are shown in Table 7.

| Processing $A_3$ | | | | |
|---|---|---|---|---|
| Processing Step | Time | Temperature | Tank Volume | Amount Replenished |
| Color Development | 80 sec. | 38° C. | 8 liter | 300 ml/m$^2$ |
| Bleach-Fix | 40 sec. | 33° C. | 3 liter | 300 ml/m$^2$ |
| Washing (1) | 40 sec. | 33° C. | 3 liter | — |
| Washing (2) | 40 sec. | 33° C. | 3 liter | — |
| Washing (3) | 15 sec. | 33° C. | 0.5 liter | 320 ml/m$^2$ |
| Drying | 30 sec. | 80° C. | | |

The replenishment of washing water was performed in the same manner as in Processing $A_2$.

TABLE 7

| Sample No. | Note | Maximum Developed Color Density | Minimum Developed Color Density |
|---|---|---|---|
| 101 | Comparison | 2.15 | 0.16 |
| 102 | Comparison | 1.72 | 0.11 |
| 103 | Invention | 2.06 | 0.11 |
| 104 | Invention | 2.10 | 0.11 |
| 105 | Invention | 2.08 | 0.10 |
| 106 | Invention | 2.02 | 0.10 |
| 107 | Invention | 2.12 | 0.11 |
| 108 | Invention | 2.04 | 0.10 |

The superiority of the samples 103 to 108, in which the yellow couplers represented by formula (I) and the nucleating agents of the present invention were used in combination, is apparent from their high maximum developed-color densities (Dmax) and low minimum developed-color densities (Dmin).

EXAMPLE C-2

The same experiment as in Example C-1, except said processing was changed to the following processing $B_3$, was carried out. Results similar to those in Example C-1 were obtained.

| Processing $B_3$ | | | |
|---|---|---|---|
| Processing Step | Time | Temperature | Amount Replenished |
| Color Development | 70 sec. | 38° C. | 260 ml/m$^2$ |
| Bleach-Fix | 30 sec. | 38° C. | 260 ml/m$^2$ |
| Washing (1) | 30 sec. | 38° C. | — |
| Washing (2) | 30 sec. | 38° C. | 300 ml/m$^2$ |

Therein, the replenishing factor of the washing water was 8.6.

The composition of the processing solutions used were as follows.

| Color Developer | Solution | Replenisher |
|---|---|---|
| Ethylenediaminetetrakis-methylenephosphonic acid | 0.5 g | 0.5 g |
| Diethylene glycol | 10 ml | 10 ml |
| Benzyl alcohol | 12 ml | 14.4 ml |
| Potassium bromide | 0.52 g | — |
| Sodium chloride | 0.06 g | — |
| Sodium Sulfite | 2.4 g | 2.9 g |
| N,N-diethylhydroxylamine | 4.0 g | 4.8 g |
| Triethylenediamine(1,4-diazabicyclo[2,2,2]octane) | 4.0 g | 4.8 g |
| N-Ehyl-N-(β-methanesulfonamidoethyl)-3-methylaniline sulfate | 5.6 g | 6.6 g |
| Potassium carbonate | 27.0 g | 25.0 g |
| Brightening agent (diaminostilbene type) | 1.0 g | 1.2 g |
| Water to make | 1,000 ml | 1,000 ml |
| pH (at 25° C.) | 10.50 | 10.80 |

| Bleach-fix Bath | Solution = Replenisher |
|---|---|
| Disodium ethylenediaminetetraacetate dihydrate | 4.0 g |
| Ammonium ethylenediaminetetraacetatoferrate(III) dihydrate | 46.0 g |
| Ammonium thiosulfate (700 g/l) | 155 ml |
| Sodium p-toluenesulfinate | 20.0 g |
| Sodium hydrogen sulfite | 12.0 g |
| Ammonium bromide | 50.0 g |
| Ammonium nitrate | 30.0 g |
| Water to make | 1,000 ml |
| pH (at 25° C.) | 6.20 |

Washing Water

Prepared in the same manner as in Example B-1. This water also used for processing solutions.

| Color Developer | Solution | Replenisher |
|---|---|---|
| Diethylenetriamine pentaacetic acid | 0.5 g | 0.5 g |
| 1-Hydroxyethylidene-1,1-diphosphonic acid | 0.5 g | 0.5 g |
| Diethylene glycol | 8.0 g | 10.7 g |
| Benzyl alcohol | 9.0 g | 12.0 g |
| Sodium bromide | 0.7 g | — |
| Sodium chloride | 0.5 g | — |
| Sodium Sulfite | 2.0 g | 2.4 g |
| Hydroxylamine sulfate | 2.8 g | 3.5 g |
| 3-Methyl-4-amino-N-ethyl-N-(β-methanesulfonamidoethyl)aniline sulfate | 2.0 g | 2.5 g |
| 3-Methyl-4-amino-N-ethyl-N-(β-hydroxyethyl)aniline sulfate | 4.0 g | 4.5 g |

-continued

| Color Developer | Solution | Replenisher |
|---|---|---|
| Potassium carbonate | 30.0 g | 30.0 g |
| Brightening agent (stilbene type) | 1.0 g | 1.2 g |
| Purified water to make | 1,000 ml | 1,000 ml |
| pH | 10.50 | 10.90 |

The pH adjustment was carried out using potassium hydroxide or hydrochloric acid.

| Bleach-fix Bath | Solution | Replenisher |
|---|---|---|
| Ammonium thiosulfate | 77 g | 100 g |
| Sodium hydrogen sulfide | 14.0 g | 21.0 g |
| Ammonium ethylenediaminetetraacetatoferrate(III) dihydrate | 40.0 g | 53.0 g |
| Disodium ethylenediaminetetraacetate dihydrate | 4.0 g | 5.0 g |
| 2-Mercapto-1,3,4-triazole | 0.5 g | 0.5 g |
| Purified water to make | 1,000 ml | 1,000 ml |
| pH | 7.0 | 6.5 |

The pH adjustment was carried out using aqueous ammonia or hydrochloric acid.

Washing Water

Purified water were used. Purified water was also used in the processing solutions and replenishers.

EXAMPLE C-3

The samples 301 to 308 prepared in the same manners as the samples 101 to 108 in Example C-1, except the emulsion EM2-C made in the following manner and those made in manners similar thereto were used instead of the emulsion EM1-C and their analogues, respectively, were examined by the same experiment as in Example C-1. Thus, results similar to those in Example C-1 were obtained.

Preparation of Emulsion EM2-C

An aqueous mixture solution of a potassium bromide (0.15N) and sodium chloride (0.15N) and an aqueous solution of silver nitrate (0.15N)were simultaneously added at 65° C. with vigorous stirring over a period of about 30 minutes to a 1 wt % aqueous gelatin solution containing 3,4-dimethyl-1,3-thiazoline-2-thione in an amount of 0.1 g per mole of silver to produce a monodisperse silver chloribromide emulsion (silver bromide content: 30 mol %) having an average grain size of about 0.23 μm. The resulting emulsion was chemically sensitized by adding thereto 25 mg/mol Ag of sodium thiosulfate and 15 mg/mol Ag of chloroauric acid (tetrahydrate), and then by heating at 65° C. for 25 minutes. The thus obtained silver chlorobromide grains were employed as core grains, and thereon silver chlorobromide was further grown under the same circumstances as the first precipitation had been performed, resulting in production of a monodisperse core/shell type silver chlorobromide emulsion (silver bromide content: 25 mol%) having the final average size of about 0.65 μm. A variation coefficient of the grain sizes was about 12%. This emulsion was chemically sensitized by adding thereto 1.5 mg/mol Ag of sodium thiosulfate and 1.5 mg/mol Ag of chloroauric acid (tetrahydrate), and then heating it at 60° C. for 70 minutes to prepare an internally sensitive silver halide emulsion EM2-C.

EXAMPLE C-4

The same samples 301 to 308 as prepared in Example C-3 underwent the same experiments as carried out in Example C-2, whereby results similar to those of Example C-2 were obtained.

EXAMPLE C-5

The same experiments as in Example C-3, except the blue sensitizing dyes contained in the first and the twelfth layers, respectively, of each sample, from No. 301 to No. 308, were changed from ExS-5 and ExS-6 to the sensitizing dye illustrated below, were carried. Results similar to those in Example C-3 were obtained.

Sensitizing Dye

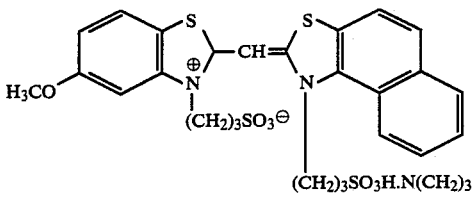

From the above-described results it is evident that when a yellow coupler represented by formula (I) is used in the present invention, a direct positive color photographic material which can provide sufficiently high maximum image density and low minimum image density can be obtained. This effect can be accomplished steadily even when the processing condition fluctuates.

EXAMPLE D-1

The same tests were conducted as in Example A-1 except sample 101 was obtained as follows:

(i) Instead of cyan couplers ExC-1 and ExC-2 in the third and fourth laeyr, cyan coupler ExC-1 was used in an amount of 0.23 g/m$^2$ in the third layer and 0.32 g/m$^2$ in the fourth layer.

(ii) Emulsion EM1-C was used instead of emulsion Em1-A.

(iii) To each light-sensitive layer ExZK-1 shown hereinbefore was added in an amount of $2.0\times10^{-5}$ mol per mol of silver halide as a nucleating agent and Cpd-24 shown hereinbefore was added in an amount of $4.5\times10^{-4}$ mol per mol of silver halide as a nucleation accelerator.

Then, samples 102 to 107, in which the cyan coupler incorporated in the third and the fourth layers, and the nucleating agent incorporated in each emulsion layer, were changed to those set forth in Table 8, respectively, were prepared.

TABLE 8

| Sample No. | Cyan Coupler *1 | Nucleating Agent *2 |
|---|---|---|
| 101 | ExC-1 | ExZK-1 |
| 102 | C-I-3 | ExZK-1 |
| 103 | C-I-3 | N-I-25 |
| 104 | C-I-3 | N-I-23 |
| 105 | C-I-2 | N-I-16 |
| 106 | C-I-5 | N-I-8 |
| 107 | C-I-7 | N-I-8 |

1*: The amounts of cyan couplers incorporated in the samples 102 to 107, respectively, were the same by mole as that of ExC-1 in the sample 101.
2*: In the samples 103 to 107, the amount of the nucleating agent incorporated in each emulsion layer was $2.0\times10^{-6}$ mole per mole of silver halide.

Each of the thus obtained samples were edgewise exposed (3200° K., 1/10 sec, 10 CMS), subjected to the above-described processing $A_3$, and then examined for densities of the developed cyan color images. The results obtained are shown in Table 9.

TABLE 9

| Sample No. | Note | Maximum Developed Color Density | Minimum Developed Color Density |
|---|---|---|---|
| 101 | Comparison | 1.91 | 0.14 |
| 102 | Comparison | 1.86 | 0.13 |
| 103 | Invention | 2.24 | 0.10 |
| 104 | Invention | 2.19 | 0.10 |
| 105 | Invention | 2.22 | 0.09 |
| 106 | Invention | 2.26 | 0.10 |
| 107 | Invention | 2.24 | 0.09 |

The superiority of the samples 103 to 107, in which the cyan couplers-represented by formula (C-I) and the nucleating agents of the present invention were used in combination, is apparent from their high maximum developed-color densities (Dmax) and low minimum developed-color densities (Dmin).

EXAMPLE D-2

The same experiment as in Example D-1, except said processing was changed to the processing $B_3$, was carried out. Results similar to those in Example D-1 were

EXAMPLE D-3

After the samples obtained in Example D-1 were allowed to stand for 3 days under the condition of 45° C., 80% RH, they were subjected to wedgewise exposure (3200° K., 1/10 sec., 10 CMS) and subsequently to the processing $A_3$, and then examined for densities of the developed cyan color images. Similarly, the samples preserved for 3 days at room temperature were also examined. Based on these experiments, sensitivities of re-reversal negative images were compared. The results obtained are shown in Table 10.

TABLE 10

| Sample No. | Note | Sensitivity of Re-reversal Negative *1 | |
|---|---|---|---|
| | | 3 days' lapse at room temp. | 3 days' lapse at 45° C., 80% RH |
| 101 | Comparison | 100 | 152 |
| 102 | Comparison | 103 | 146 |
| 103 | Invention | 81 | 83 |
| 104 | Invention | 83 | 86 |
| 105 | Invention | 89 | 91 |
| 106 | Invention | 80 | 83 |
| 107 | Invention | 85 | 89 |

*1: The sensitivities of the re-reversal negative images are shown as relative values, with the sample 101 preserved at room temperature for 3 days being taken as 100.

It is apparent from the above data that the samples 103 to 107 prepared in accordance with the present invention are superior in that they are hard to generate re-reversal negative images even when stored under high temperature and high humidity conditions.

EXAMPLE D-4

The samples 401 to 407 prepared in the same manners as the samples 101 to 107 in Example D-1, except the emulsion EM2-D made in the following manner and those made in manners similar thereto were used instead of the emulsion EM1-C and their analogues, respectively, were examined by the same experiment as in Example D-1. Thus, results similar to those in Example D-1 were obtained.

Preparation of Emulsion EM2-D

An aqueous mixture solution of a potassium bromide (0.15N) and sodium chloride (0.15N) and an aqueous solution of silver nitrate (0.15N) were simultaneously added at 65° C. with vigorous stirring over a period of about 30 minutes to a 1 wt % aqueous gelatin solution containing 3,4-dimethyl-1,3-thiazoline-2-thione in an amount of 0.3 g per mole of silver to produce a monodisperse silver chloribromide emulsion (bromide content: 30 mol %) having an average grain size of about 0.23 μm. The resulting emulsion was chemically sensitized by adding thereto 25 mg/mol Ag of sodium thiosulfate and 15 mg/mol Ag of chloroauric acid (tetrahydrate), and then by heating at 65° C. for 25 minutes. The thus obtained silver chlorobromide grains were employed as core grains, and thereon silver chlorobromide was further made to grow under the same circumstances as the first precipitation had been performed, resulting in production of a monodisperse core/shell type silver chlorobromide emulsion (bromide content: 25 mol %) having the final average size of about 0.65 μm. A variation coefficient of the grain sizes was about 12%. This emulsion was chemically sensitized by adding thereto 1.5 mg/mol Ag of sodium thiosulfate and 1.5 mg/mol Ag of chloroauric acid (tetrahydrate), and then heating it at 60° C. for 70 minutes to prepare an internally sensitive silver halide emulsion EM2-D.

EXAMPLE D-5

The same samples 401 to 407 as prepared in Example D-4 underwent the same experiments as carried out in Example D-2, whereby results similar to those of Example D-2 were obtained.

EXAMPLE D-6

The same samples 401 to 407 as prepared in Example D-4 underwent the same experiments as carried out in Example D-3, whereby results similar to those of Example D-3 were obtained.

From the results obtained above it is clear that the direct positive color photographic materials of the present invention containing the cyan coupler represented by formula (C-I) have proved to ensure sufficiently high maximum and low minimum densities to the developed color images, and to have low re-reversal negative sensitivities. These effects can be achieved steadily even when the photographic materials are stored under high temperature and high humidity conditions, or the processing condition is changed.

While the invention has been described in detail and with reference to specific embodiments thereof, it will be apparent to one skilled in the art that various changes and modifications can be made therein without departing from the spirit and scope thereof.

What is claimed is:

1. A method for forming a direct positive image comprising the steps of:

(a) imagewise exposing a photographic light-sensitive material composed of a support having thereon at least one unprefogged internal latent image type silver halide light-sensitive emulsion layer; and (b) developing the exposed photographic light-sensitive material to form a direct positive image in the presence of at least one nucleating agent represented by formula (N-I);

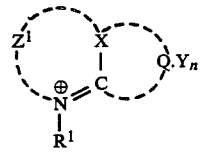

(N-I)

wherein $Z^1$ represents nonmetal atomic group necessary for forming a 5-membered or 6-membered heterocyclic ring, a 5-membered or 6-membered heterocycic ring fused with an aromatic ring, or a 5-membered or 6-membered heterocyclic ring fused with another heterocyclic ring; $R^1$ represents an aliphatic group; X represents $$=\underset{|}{C}- \text{ or } -\underset{|}{N}-;$$

Q represents a nonmetallic atomic group necessary for forming a 4-membered to 12-membered nonaromatic hydrocarbon ring or a 4-membered to 12-membered nonaromatic heterocyclic ring; provided that at least one of $R^1$, $Z^1$ and Q is substituted with an alkynyl group; Y represents a counter ion required for charge balance; and n is a number required for charge balance; or $Z^1$ contains a heterocyclic quaternary ammonium salt completed by said $Z^1$ via a linkage group.

2. A method for forming a direct positive image as claimed in claim 1, wherein at least one of $R^1$, $Z^1$, and Q has a substituent containing a group capable of accelerating adsorption to silver halide grains.

3. A method for forming a direct positive image as claimed in claim 1, wherein the heterocyclic ring completed by $Z^1$ is selected from the group consisting of quinolinium, benzimidazolium, pyridinium, thiazolium, selenazolium, imidazolium, tetrazolium, indolenium, pyrrolinium, acridinium, phenanthridinium, isoquinolinium and naphthopyridinium nuclei.

4. A method for forming a direct positive image as claimed in claim 1, wherein the heterocyclic ring completed by $Z^1$ is substituted with at least one group selected from the group consisting of an alkyl group, an alkenyl group, an aralkyl group, an aryl group, an alkynyl group, a hydroxyl group, an alkoxy group, an aryloxy group, a halogen atom, an amino group, an alkylthio group, an arylthio group, an acyloxy group, an acylamino group, an aliphatic and aromatic sulfonyl group, an aliphatic and aromatic sulfonyloxy group, an aliphatic and aromatic sulfonylamino group, a carboxyl group, an acyl group, a carbamoyl group, a sulfamoyl group, a sulfo group, a cyano group, a ureido group, a urethane group, a carboxylate group, a hydrazino group, a hydrazono group, and an imino group, or the substituted heterocyclic ring is further substituted with at least one of these substituents.

5. A method for forming a direct positive image as claimed in claim 1, wherein the aliphatic group represented by $R^1$ is selected from the group consisting of a substituted or unsubstituted alkyl group and a substituted or unsubstituted alkynyl group.

6. A method for forming a direct positive image as claimed in claim 5, wherein the substituent of the aliphatic group is a substituent selected from the group consisting of an alkyl group, an alkenyl group, an aralkyl group, an aryl group, an alkynyl group, a hydroxyl group, an alkoxy group, an aryloxy group, a halogen atom, an amino group, an alkylthio group, an arylthio group, an acyloxy qroup, an acylamino group, an aliphatic and aromatic sulfonyl group, an aliphatic and aromatic sulfonyloxy group, an aliphatic and aromatic sulfonylamino group, a carboxyl group, an acyl group, a carbamoyl group, a sulfamoyl group, a sulfo group, a cyano group, a ureido group, a urethane group, a carboxylate group, a hydrazino group, a hydrazono group, and an imino group.

7. A method for forming a direct positive image as claimed in claim 1, wherein the 4- to 12-membered nonaromatic hydrocarbon ring or the 4- to 12-membered heterocyclic ring represented by Q is substituted with a substituents selected from the group consisting of an alkyl group, an alkenyl group, an aralkyl group, an aryl group, an alkynyl group, a hydroxyl group, an alkoxy group, an aryloxy group, a halogen atom, an amino group, an alkylthio group, an arylthio group, an acyloxy group, an acylamino group, an aliphatic and aromatic sulfonyl group, an aliphatic and aromatic sulfonyloxy group, an aliphatic and aromatic sulfonylamino group, a carboxyl group, an acyl group, a carbamoyl group, a sulfamoyl group, a sulfo group, a cyano group, a ureido group, a urethane group, a carboxylate group, a hydrazino group, a hydrazono group, and an imino group.

8. A method for forming a direct positive image as claimed in claim 1, wherein the 4- to 12-membered nonaromatic heterocyclic ring represented by Q is a ring containing at least one atom selected from the group consisting of nitrogen, oxygen, sulfur and selenium atoms.

9. A method for forming a direct positive image as claimed in claim 1, wherein the 4- to 12-membered nonaromatic heterocyclic ring represented by Q is a ring selected from the group consisting of cyclopentane, cyclohexane, cyclohexene, cycloheptane, indane, tetralin, tetrahydrofuran, tetrahydropyran, butyrolactone, pyrrolidone, tetrahydrothiophene, pyrrolidine, piperidine, pyridone, piperazine, perhydrothiazine, tetrahydroquinoline, and indoline rings.

10. A method for forming a direct positive image as claimed in claim 2, wherein the substituent containing a group capable of accelerating adsorption to silver halide grains is represented by the formula $X^1-(L^2)_m-$, wherein $X^1$ represents a group capable of accelerating the adsorption to silver halide grains, $L^2$ represents a divalent linkage group, and m is 0 or 1.

11. A method for forming a direct positive image as claimed in claim 10, wherein $X^1$ represents a thioamido group, mercapto group and 5- or 6-membered nitrogen-containing heterocyclic groups.

12. A method for forming a direct positive image as claimed in claim 11, wherein the mercapto group is a heterocyclic mercapto group.

13. A method for forming a direct positive image as claimed in claim 1, wherein Y represents a counter ion selected from the group consisting of bromide ion, chloride ion, iodide ion, a p-toluenesulfonic acid ion, an ethylsulfonic acid ion, a perchloric acid ion, a trifluoromethanesulfonic acid ion, a thiocyanic acid ion, $BF_4^-$, and $PF_6^-$.

14. A method for forming a direct positive image as claimed in claim 1, wherein said nucleating agent is incorporated in the photographic light-sensitive material.

15. A method for forming a direct positive image as claimed in claim 14, wherein said nucleating agent is incorporated in a silver halide emulsion layer.

16. A method for forming a direct positive image as claimed in claim 1, wherein said nucleating agent is incorporated in a hydrophilic colloid layer adjacent to a silver halide emulsion layer.

17. A method for forming a direct positive image as claimed in claim 15, wherein said nucleating agent is incorporated in an amount of from $1\times10^{-3}$ to $1\times10^{-2}$ mol per mol of silver in the silver halide emulsion layer.

18. A method for forming a direct image as claimed in claim 16, wherein said nucleating agent is incorporated in an amount of from $1\times10^{-8}$ to $1\times10^{-3}$ g/m$^2$.

19. A method for forming a direct positive image as claimed in claim 1, wherein said nucleating agent is incorporated into at least one of a developing solution and a prebath thereof.

20. A method for forming a direct positive image as claimed in claim 19, wherein said nucleating agent is incorporated in an amount of from $1\times10^{-5}$ to $1\times10^{-1}$ mol/l.

21. A method for forming a direct positive image as claimed in claim 1, wherein the photographic light-sensitive material contains a yellow coupler represented by the following formula (I):

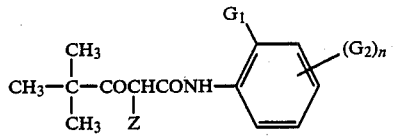

(I)

wherein Z represents a group capable of splitting off upon the coupling reaction with the oxidation product of a developing agent; $G_1$ represents a halogen atom, or an alkoxy group; $G_2$ represents a hydrogen atom, or a substituent; n represents 0 or an integer of from 1 to 4, when n is 2 or more, groups represented by $G_2$ may be the same or different.

22. A method for forming a direct positive image as claimed in claim 21, wherein the substituent represented by $G_2$ is a group selected from the group consisting of a halogen atom, an alkyl group, an alkoxy group, an aryl group, an aryloxy group, an amino group, a nitro group, a hydroxyl group, a carbocyl group, a sulfo group, an alkoxycarbonyl group, a sulfamoyl group, a heterocyclic group, and those groups which are fomed by further substitution of the substituted groups with at least one of these substituents.

23. A method for forming a direct positive image as claimed in claim 1, wherein the photographic light-sensitive material contains a magenta coupler represented by the following formula (II):

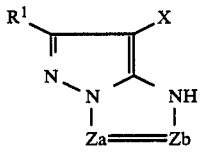

(II)

wherein Za and Zb each represents

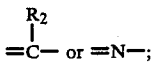

$R^1$ and $R^2$ each represents a hydrogen atom, or a substituent; X represents a hydrogen atom, or a group capable of splitting off by the coupling reaction with the oxidation product of an aromatic primary amine developing agent; when the bond formed by Za and Zb is a C—C double bond, it may constitute a part of an aromatic ring; and further the coupler may form a polymer or a bis-compound, via $R^1$, $R^2$ or X.

24. A method for forming a direct positive image as claimed in claim 1, wherein the photographic light-sensitive material contains a cyan coupler represented by the following formula (C-1):

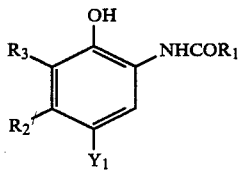

(C-I)

wherein $R_1$ represents an aliphatic group, an aryl group, a heterocyclic group, an arylamino group, or a heterocyclic amino group; $R_2$ represents an aliphatic group containing 2 to 20 carbon atoms; $R_3$ represents a hydrogen atom, a halogen atom, an aliphatic group, an aliphatic oxy group, or an acylamino group; and $Y_1$ represents a hydrogen atom, or a group capable of splitting off upon the coupling reaction with the oxidation product of a developing agent; and further, which may form a polymer of a grade not lower than a dimer or a bis-compound via $R_1$, $R_2$, $R_3$ or $Y_1$.

25. A method for forming a direct positive image as claimed in claim 1, wherein developing is conducted under the presence of a nucleation accelerator.

26. A method for forming a direct positive image as claimed in claim 1, wherein developing is conducted using a developer having a pH of not higher than 12.

27. A photographic light-sensitive material composed of a support having thereon at least one unprefogged internal latent image type silver halide light-sensitive emulsion layer, at least one coupler and at least one nucleating agent represented by formula (N-I);

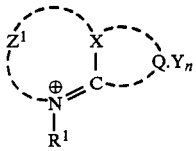

(N-I)

wherein $Z^1$ represents nonmetal atomic group necessary for forming a 5-membered or 6-membered heterocyclic ring, a 5-membered or 6-membered heterocyclic ring fused with an aromatic ring, or a 5-membered or 6-membered heterocyclic . ring fused with another heterocyclic ring; $R_1$ represents an aliphatic group; X represents Q represents a nonmetallic atomic group necessary for forming a 4-membered to 12-membered nonaromatic hydrocarbon ring or a 4-membered to 12-membered nonaromatic heterocyclic ring; provided that at least one of $R^1$, $Z^1$ and Q is substituted with an alkynyl group; Y represents a counter ion required for charge balance; and n is a number required for charge balance, or $Z^1$ contains a heterocyclic quaternary ammonium salt completed by said $Z^1$ via a linkage group; said coupler is at least one of a yellow coupler represented by formula (I), a magenta coupler represented by formula (II), and a yellow coupler represented by formula (C-1):

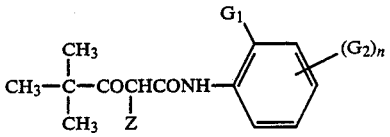

(I)

wherein Z represents a group capable of splitting off upon the coupling reaction with the oxidation product of a developing agent; $G_1$ represents a halogen atom, or an alkoxy group; $G_2$ represents a hydrogen atom, or a substituent; n represents 0 or an integer of from 1 to 4, when n is 2 or more, groups represented by $G_2$ may be the same or different;

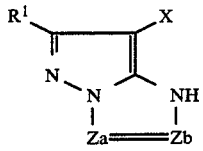

(II)

wherein Za and Zb each represents

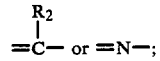

$R^1$ and $R^2$ each represents a hydrogen atom, or a substituent; X represents a hydrogen atom, or a group capable of splitting off by the coupling reaction with the oxidation product of an aromatic primary amine developing agent; when the bond formed by Za and Zb is a C—C double bond, it may constitute a part of an aromatic ring; and further the coupler may form a polymer or a bis-compound, via $R^1$, $R^2$ or X;

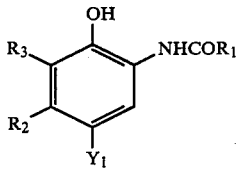

(C-I)

wherein $R_1$ represents an aliphatic group, an aryl group, a heterocyclic group, an arylamino group, or a heterocyclic amino group; $R_2$ represents an aliphatic group containing 2 to 20 carbon atoms; $R_3$ represents a hydrogen atom, a halogen atom, an aliphatic group, an aliphatic oxy group, or an acylamino group; and $Y_1$ represents a hydrogen atom, or a group capable of splitting off upon the coupling reaction with the oxidation product of a developing agent; and further, which may form a polymer of a grade not lower than a dimer or a bis-compound via $R_1$, $R_2$, $R_3$ or $Y_1$.

28. A method for forming a direct positive image as claimed in claim 21, wherein the substituent represented by $G_2$ is a group selected from the group consisting of an amido group, a carbamoyl group, a sulfonamido group, an acyloxy group, and those groups which are formed by further substitution of the substituted groups with at least one of these substituents.

* * * * *